US008760477B2

(12) United States Patent
Hudson et al.

(10) Patent No.: US 8,760,477 B2
(45) Date of Patent: Jun. 24, 2014

(54) PIXEL CIRCUIT AND DISPLAY SYSTEM COMPRISING SAME

(75) Inventors: Edwin Lyle Hudson, San Jose, CA (US); John Gray Campbell, San Carlos, CA (US); Warren Robert Ong, Menlo Park, CA (US)

(73) Assignee: Jasper Display Corp., Hsinchu (TW)

( * ) Notice: Subject to any disclaimer, the term of this patent is extended or adjusted under 35 U.S.C. 154(b) by 303 days.

(21) Appl. No.: 13/252,356

(22) Filed: Oct. 4, 2011

(65) Prior Publication Data

US 2012/0086733 A1 Apr. 12, 2012

Related U.S. Application Data

(63) Continuation-in-part of application No. 10/435,427, filed on May 9, 2003.

(60) Provisional application No. 61/390,750, filed on Oct. 7, 2010, provisional application No. 60/379,567, filed on May 10, 2002, provisional application No. 60/427,814, filed on Nov. 20, 2002.

(51) Int. Cl.
*G09G 5/10* (2006.01)

(52) U.S. Cl.
USPC ..... 345/690; 345/212

(58) Field of Classification Search
USPC ..... 345/204–215
See application file for complete search history.

(56) References Cited

U.S. PATENT DOCUMENTS

| | | | | |
|---|---|---|---|---|
| 6,005,558 | A | 12/1999 | Hudson et al. | |
| 6,046,716 | A * | 4/2000 | McKnight | 345/95 |
| 6,476,792 | B2 * | 11/2002 | Hattori et al. | 345/102 |
| 7,088,329 | B2 | 8/2006 | Hudson | |
| 7,443,374 | B2 | 10/2008 | Hudson | |
| 7,468,717 | B2 | 12/2008 | Hudson | |
| 2002/0043610 | A1 * | 4/2002 | Lee et al. | 250/208.1 |
| 2003/0174117 | A1 * | 9/2003 | Crossland et al. | 345/100 |

* cited by examiner

*Primary Examiner* — Abbas Abdulselam
*Assistant Examiner* — Gerald Oliver
(74) *Attorney, Agent, or Firm* — Han IP Corporation

(57) ABSTRACT

A display system which includes a display controller, a display unit, and a light source is disclosed. The display controller includes a processor unit, a memory device, a voltage source and, optionally, a light source control unit. The display unit includes an array of pixel cells and circuitry to receive logic and control voltages and data and operate the display, a transparent counter electrode, and a liquid crystal layer disposed between the two alignment layers. The pixel cell includes a storage element, a DC balance control switch, a pixel voltage override circuit, an inverter able to select between two voltages available to it, and a pixel electrode/mirror. In different modes of operation the pixel mirror voltage may be determined by the storage element or by the pixel voltage override circuit. The display system may display images in one period and reset to a fixed state in another period.

25 Claims, 32 Drawing Sheets

| | Data Driven "Normal" Mode | | | | | | | | "Isolate" Mode | | | | Defective Modes | | "Override" Mode | | | | Defective Mode |
|---|---|---|---|---|---|---|---|---|---|---|---|---|---|---|---|---|---|---|---|
| Column→ Control Logic ↓ | 1 | | 2 | | 3 | | 4 | | 5 | | 6 | | 7 | 8 | 9 | | 10 | | 11 |
| $V_{SWA\ L}$ | On | | On | | Off | | Off | | Off | | Off | | On | On/Off | Off | | Off | | Off |
| $V_{SWA\ H}$ | On | | On | | Off | | Off | | Off | | Off | | On/Off | On | Off | | Off | | Off |
| $V_{SWB\ L}$ | Off | | Off | | On | | On | | Off | | Off | | On | On/Off | Off | | Off | | Off |
| $V_{SWB\ H}$ | Off | | Off | | On | | On | | Off | | Off | | On/Off | On | Off | | Off | | Off |
| $V_{OVR\ H}$ | Off | | Off | | Off | | Off | | Off | | Off | | Off | Off | On | | Off | | On |
| $V_{OVR\ L}$ | Off | | Off | | Off | | Off | | Off | | Off | | Off | Off | Off | | On | | On |
| Data ↓ | | | | | | | | | | | | | | | | | | | |
| $S_{POS}$ | 1 | | 0 | | 1 | | 0 | | N/A – 6T SRAM can be reloaded without changing display state. | | | | N/A – Memory state will likely reset | | N/A – 6T SRAM can be reloaded without changing display state. | | | | |
| $S_{NEG}$ | 0 | | 1 | | 0 | | 1 | | | | | | | | | | | | |
| States↓ | | | | | | | | | | | | | | | | | | | |
| $V_{PIX}$ | $V_0$ | | $V_1$ | | $V_1$ | | $V_0$ | | $V_1$ | | $V_0$ | | Unknown | | $V_1$ | | $V_0$ | | Unknown |
| $V_{ITO}$ | L | H | L | H | L | H | L | H | L | H | L | H | N/A | N/A | L | H | L | H | N/A |
| Drive State (NB) | D | B | B | D | B | D | D | B | B | D | D | B | Unknown | | B | D | D | B | Unknown |
| Drive State (NW) | B | D | D | B | D | B | B | D | D | B | B | D | Unknown | | D | B | B | D | Unknown |

Note:
D = Dark State
B = Bright State

FIG. 10

| | Data Driven "Normal" Mode | | | | | | | | "Isolate" Mode | | | | Defective Modes | | | | "Override" Mode | | | | Defective Mode |
|---|---|---|---|---|---|---|---|---|---|---|---|---|---|---|---|---|---|---|---|---|---|
| Column→ Control Logic ↓ | 1 | | 2 | | 3 | | 4 | | 5 | | 6 | | 7 | | 8 | | 9 | | 10 | | 11 |
| $V_{SW_L}$ | On | | Off | | ~~Off~~ | | ~~Off~~ | | Off | | Off | | On | | On/Off | | Off | | Off | | Off |
| $V_{SW_H}$ | Off | | On | | ~~Off~~ | | ~~Off~~ | | Off | | Off | | On | | On | | Off | | Off | | Off |
| $V_{OVR_H}$ | Off | | Off | | ~~Off~~ | | ~~Off~~ | | Off | | Off | | Off | | Off | | On | | Off | | On |
| $V_{OVR_L}$ | Off | | Off | | ~~Off~~ | | ~~Off~~ | | Off | | Off | | Off | | Off | | Off | | On | | On |
| Data ↓ | | | | | | | | | | | | | | | | | | | | | |
| $S_{POS}$ | 1 | | 0 | | 1 | | 0 | | N/A – 6T SRAM can be reloaded without changing display state. | | | | N/A – Memory state will likely reset | | | | N/A – 6T SRAM can be reloaded without changing display state. | | | | |
| $S_{NEG}$ | 0 | | 1 | | 0 | | 1 | | | | | | | | | | | | | | |
| States↓ | | | | | | | | | | | | | | | | | | | | | |
| $V_{PIX}$ | $V_0$ | | $V_1$ | | $V_1$ | | $V_0$ | | $V_1$ | | $V_0$ | | Unknown | | | | $V_1$ | | $V_0$ | | Unknown |
| $V_{ITO}$ | L | H | L | H | L | H | L | H | L | H | L | H | L | H | L | H | L | H | L | H | N/A |
| Drive State (NB) | D | W | W | D | W | D | D | W | W | D | D | W | Unknown | | | | W | D | D | W | Unknown |
| Drive State (NW) | W | D | D | W | D | W | W | D | D | W | W | D | Unknown | | | | D | W | W | D | Unknown |

FIG. 21

Display Rows
3052
3050
3048
3046
3044
3042
3041
Display Mod. Frame Color 1
3051
Data Load Frame
3049
Display Modulation Frame Color 3
3047
Data Load Frame
3045
Display Modulation Frame Color 2
3043
Data Load Frame
3041
Display Modulation Frame Color 1
Start Row
End Row Modulation State
"On"
"Off"
3061
Color 1 Data
3063
Color 2 Data
3065
3067
Color 3 Data
3069
3071
Color 1 Data
3061

LED State
"On"
"Off"
3081
Color 1
3083
Color 2
3085
3087
Color 3
3089
3091
Color 1
3081
Time

PIXEL CIRCUIT AND DISPLAY SYSTEM COMPRISING SAME

CROSS-REFERENCE TO RELATED APPLICATIONS

This application is a continuation-in-part of pending U.S. patent application Ser. No. 10/435,427, filed May 9, 2003, entitled "MODULATION SCHEME FOR DRIVING DIGITAL DISPLAY SYSTEMS", which claims priority to U.S. provisional patent application Ser. No. 60/379,567, filed May 10, 2002, and to U.S. provisional patent application Ser. No. 60/427,814, filed Nov. 20, 2002.

This application also claims the benefit of U.S. provisional patent application Ser. No. 61/390,750, filed Oct. 7, 2010, entitled "IMPROVED PIXEL CIRCUIT AND DISPLAY SYSTEM COMPRISING SAME" which is also incorporated herein by reference.

BACKGROUND OF THE INVENTION

1. Field of the Invention

The present invention pertains to liquid crystal on silicon (LCOS) displays, and more particularly to improved pixel cell design for liquid crystal on silicon displays with enhanced voltage control.

2. Description of the Prior Art

To enhance the luminance and fill factor of liquid crystal projection displays, reflective LCD pixels are often used. These systems, referred to as Liquid Crystal on Silicon microdisplays (LCOS), utilize a large array of image pixels to achieve a high-resolution output of the input image. Each pixel of the display includes a liquid crystal layer sandwiched between a transparent electrode and a reflective pixel electrode. Typically, the transparent electrode is common to the entire display while the reflective pixel electrode is operative to an individual image pixel. A storage element, or other memory cell, is mounted beneath the pixels and can selectively direct a voltage on the pixel electrode. By controlling the voltage difference between the common transparent electrode and each of the reflective pixel electrodes, the optical characteristics of the liquid crystal can be controlled according to the image data being supplied. The storage element can be either an analog or a digital storage element although digital storage elements have become more common because of their resistance to charge decay in environments with high thermal or light loads Liquid crystal on silicon (LCOS) microdisplay technology is still challenged by a need to reduce the cost of projection systems for consumer markets in the United States and abroad. One proposed method that has achieved limited success is to implement a system wherein a single LCOS microdisplay is able to modulate the needed three primary colors without exhibiting unacceptable flicker or image breakup. Previous LCOS projection systems have exhibited outstanding performance but have required complex optics and three separate microdisplays, one for each color. Successful single panel architectures to date have involved small, low resolution microdisplays operating in field sequential color mode because of the need to write two full sets of color fields (RGB) in the time previously allocated for one RGB frame to mitigate artifacts. Alternatively single panel frames have required the use of color filter material applied directly to the pixels of the display before assembly. This has also limited resolution because three times as many sub-pixels are required—one for each color.

Both approaches have limitations that must be overcome. Lower resolution is objectionable to some consumers. The continuing consumer trend to expect higher resolution has resulted in displays now being fielded in a new class of mobile telephones with a resolution of 900 by 600 (540,000 pixels) over a previous resolution of 480 pixels by 320 pixels (153, 600 pixels)—a more than three fold increase in resolution in a display with an image diagonal of 3.5 inches. The color filter approach is more difficult to implement because of the inherent difficulties involved in applying filter material to pixels with dimensions on the order of 15 micrometers. For comparison the dimension of pixels in direct view displays are typically 100 micrometers. Improvements to resolution and function are clearly needed.

There are additional considerations beyond the problems cited above. As previously noted, operating in field sequential color mode requires substantial increases in the data rate to mitigate artifacts. The common artifacts include flicker, color breakup, and color cross coupling. Lesser artifacts that must be considered include dynamic false contours, lateral field artifacts, and motion blurring.

The perception of flicker is a fundamental aspect of human vision. Experimentation with flashing lights in the late 19th and early 20th centuries revealed that humans perceive flicker when a light is flashed at a rate between ½ Hertz and 60 Hertz. There is some variance among individuals as is often the case when dealing with different aspects of human vision. The upper limit of 60 Hz is at best approximate. The preceding description is often referred to as the Ferry-Porter Law.

This effect is important in the field of displays and especially in the field of color sequential displays. Inspection of the photopic curve (not presented here) plotting the sensitivity of the eye to color reveals a peak at about 550 nanometer wavelength; i.e., in the green spectrum. Thus displaying three colors (red, green, blue) in sequence 180 Hz creates a green flash rate of 60 Hz that is perceived as flicker. If a field sequential color display is operated at the same rate then observers will likely complain about flicker. Raising the rate to 75 Hz may reduce this somewhat but there are factors that may raise the minimum rate required to eliminate flicker. These include the overall brightness of the image, the depth of modulation, and the apparent size of the image (on the retina.) The upper limit of the flicker frequency rises as the brightness of the display rises. Depth of modulation is related in that raising the level of red and blue may reduce the perception of flicker. The effects of image size are less predictable but still a consideration. Practical field sequential color displays to date have been operated at a level of at least 360 color frames per second.

Color breakup occurs in part because much underlying data available for display is collected at 60 Hz and in part because the eye will follow moving objects moving faster than that as a part of its normal action. When a moving object is replicated in a field sequential color display the observer will tend to see color spreading because vision will move the eye to a predicted position for the object but the colors will be generated at the old position. This can be solved by motion interpolation but at some substantial cost. A better solution for a low cost display is to raise the frame rate for the green data. This changes the perception of the speed of the object and reduces the objectionable artifacts somewhat. Again, the solution requires increased data rates that translate into increased bandwidth.

A third artifact is color cross coupling. This occurs in a nematic liquid crystal display because the liquid crystal has a response time limit that may cause it to retain a slight memory of the state it was in for a previous color when the next LED generates its color. The observed effects of this problem are difficult to predict but in general objects created this way are often perceived as being less crisp than other images. To solve this problem several actions are possible. First the LEDs can all be gated off momentarily to allow the liquid crystal to settle to its new state. This, of course, causes a loss of brightness but it helps alleviate the problem. Second, the display can be driven to a dark state at the end of any given color field and may then be reloaded with data for the new color. This often takes place in conjunction with the gating of the LEDs. This requires that the drive to dark state take place as quickly as possible; an action that is limited by the time it takes to write the image array to the darks state as well as by the characteristics of the liquid crystal mode selected.

Solutions to the remaining artifacts are well known in the art. Each requires a level of data rate performance to implement solutions. Dynamic false contours are limited in nematic liquid crystal displays but may still somewhat visible if large temporal differences exist between adjacent gray levels. Reduction of temporal differences throughout the gray scale curve is the best way to reduce this. This same technique will reduce some of the lateral field effects in liquid crystal but ultimately the anchoring energy of the liquid crystal alignment and the pretilt of the cell. Motion blurring in particular may require motion interpolation as previously noted but an enhanced liquid crystal response time may assist with this as well. All of these require a substantial investment of time and resources that are normal for the development of products.

A brief review of the functioning of liquid crystal in a display is appropriate to support the disclosure of the invention. In a nematic liquid crystal display the liquid crystal layer rotates the polarization of light that passes through it, the extent of the polarization rotation depending on the root-mean-square (RMS) voltage that is applied across the liquid crystal layer. (The incident light on a reflective liquid crystal display thus is of one polarization and the reflected light associated with "on state" is normally of the orthogonal polarization.) The reason that the degree of polarization change depends on the RMS voltage is well known to those skilled in the art—it is the foundation of all liquid crystal displays.

Therefore, by applying varying voltages to the liquid crystal, the ability of the liquid crystal device to transmit light can be controlled. Since in a digital control application, the pixel drive voltage is either turned to dark state (off) or to bright state (on), certain modulation schemes must be incorporated into the voltage control in order to achieve a desired gray scale that is between the totally on and totally off positions. It is well known that the liquid crystal will respond to the RMS voltage of the drive waveform in those instances where the liquid crystal response time is slower than the modulation waveform time. The use of pulse-width modulation (PWM) is a common way to drive these types of digital circuits. In one type of PWM, varying gray scale levels are represented by multi-bit words (i.e. a binary number) that are converted into a series of pulses. The time averaged RMS voltage corresponds to a specific voltage necessary to maintain a desired gray scale.

Various methods of pulse width modulation are known in the art. One such example is binary-weighted pulse-width-modulation, where the pulses are grouped to correspond to the bits of a binary gray scale value. The resolution of the gray scale can be improved by adding additional bits to the binary gray scale value. For example, if a four-bit word is used, the time in which a gray scale value is written to each pixel, often referred to as frame time, is divided into fifteen intervals, often referred to as subframes, resulting in sixteen possible gray scale values ($2^4$ possible values). An 8-bit binary gray scale value would result in 255 intervals and 256 possible gray scale values ($2^8$ possible values).

Since most nematic liquid crystal materials only respond to the magnitude of an applied voltage, and not to the polarity of a voltage, a positive or negative voltage, of the same magnitude, applied across the liquid crystal material will normally result in the same optical properties (polarization) of the liquid crystal. However, the inherent physical characteristics of liquid crystal materials cause deterioration in the performance of the liquid crystal material due to an ionic migration or "drift" when a DC voltage is applied to them. A DC current will cause the contaminants always present in liquid crystal materials to drift toward one alignment surface or the other, if the same voltage polarity is continuously applied. This will result in the contaminants plating out onto the alignment layer with the result in that the liquid crystal material will begin to "stick" at an orientation and not respond fully to the drive voltages. This effect is manifested by the appearance of a ghost image of the previous image that is objectionable to viewers. Even highly purified liquid crystal materials have a certain level of ionic impurities within their composition (e.g. a negatively charged sodium ion). In order to maintain the accuracy and operability of the liquid crystal display, this phenomenon must be controlled. In order to prevent this type of "drift", the RMS voltage applied to the liquid crystal must be modified so that alternating voltage polarities are applied to the liquid crystal. In this situation, the frame time of the PWM is divided in half During the first half of the frame the modulation data is applied on the pixel electrode according to the predetermined voltage control scheme. During the second half of the frame time, the complement of the modulation data is applied to the pixel electrode. When the common transparent electrode is maintained at its initial voltage state, typically high, this results in a net DC voltage component of zero volts. This technique generally referred to as "DC Balancing" technique is applied to avoid the deterioration of the liquid crystal without changing the RMS voltage being applied across the liquid crystal pixel and without changing the image that is displayed through the LCD panel. The requirement for DC balance is well known in the art.

Modulation schemes that are employed to drive the liquid crystal pixel elements must therefore be able to accurately control the amount of time the pixel "on" and "off", in order to achieve a desired gray scale from the pixel. The degree of rotation of light that occurs follows the RMS voltage across the liquid crystal pixel. The degree of rotation in turn affects directly the intensity of the light that is visible to the observer. In this manner modulating voltages influences the intensity perceived by an observer. In this manner gray scale differences are created. The combination of all of the pixels in a display array results in an image being displayed through the LC device. In addition to controlling the root-mean square (RMS) voltage that applied to the pixel, the polarity of the voltage must be continuously reversed so that deterioration of the liquid crystal is avoided.

The electro-optical properties of many liquid crystal devices cause them to produce a maximum brightness at a certain RMS voltage ($V_{SAT}$), and a minimum brightness at another RMS voltage ($V_{TT}$). The relationship between the two voltages changes depending on whether the electro-optic mode is normally-black (NB) or normally-white (NW) with "normal" meaning un-driven or only lightly driven. Applying an RMS voltage of $V_{SAT}$ results in a bright cell, or full light reflection, while applying an RMS voltage of $V_{TT}$ results in a dark cell, or minimal light output. In the case of a normally white material decreasing the RMS voltage to a value below that of $V_{SAT}$, may reduce the brightness of the cell rather than maintaining it at the full light reflection level. Likewise increasing the RMS voltage to a value above that of $V_{TT}$, may normally increase the brightness of the cell somewhat rather than maintaining it at the zero light reflection level. At RMS voltages between $V_{SAT}$ and $V_{TT}$ in a NW mode the brightness decreases as the RMS voltage increases. The voltage range between $V_{TT}$ and $V_{SAT}$ therefore defines the useful range of the electro-optical curve for a particular liquid crystal material. It follows that RMS voltages outside of this range are not useful and will cause gray scale distortions if applied to the crystal pixels. It is therefore desirable to confine the RMS voltages applied to the pixels to this useful range between $V_{SAT}$ and $V_{TT}$. Many known display systems drive the logic circuitry with voltages that are outside of the useful range of the liquid crystal, and applying these voltages directly onto the pixel electrode results in. wasted power. For example, logic circuitry may operate at 0 and 5 volts or 0 and 3.3 volts. If the useful range of the liquid crystal material is inside of this range, more time and power must be expended to achieve RMS voltages that are within the useful range. In a system that has a useful $V_{TT}$ to $V_{SAT}$ range of 1.0 to 2.5 volts and that has logic circuitry that operates at 0 to 5 volts, in order to achieve an RMS voltage of 2.5 volts, the pixel must see an equal amount of the 0 volt state and the 5 volt state over a time frame in order to achieve an RMS voltage of 2.5 volts. It is much more efficient for the liquid crystal drive logic circuitry to operate at the $V_{SAT}$ and $V_{TT}$ levels, rather than at levels outside of the $V_{SAT}$ to $V_{TT}$ range. This would make the time averaging simpler and faster and less power would be required to drive the same systems. For these reasons, it is desirable to confine the RMS voltages to the useful range of the electro-optical response curve of the liquid crystal material.

Another example of display system is disclosed in U.S. Pat. No. 6,005,558. A display system includes a memory element coupled to a multiplexer. Depending on the state of the memory element, the multiplexer directs one of two predetermined voltages onto a pixel electrode. The multiplexer is situated externally to the memory cell and is controlled by external circuitry to operate in conjunction with DC balance and data load operations. In the disclosed invention, operation of the multiplexer external to the cell requires that the voltages delivered via the rails to the cell be modulated to provide DC balance. This adds substantially to the complexity of the device because the modulated voltage must be correct in all respects as these same voltages are used to drive the pixel mirrors and thus achieve DC balance. Design of a line that can propagate a number of different voltages across long lines that must accurate in all cases is a significant design constraint. Furthermore, the disclosed invention requires that all elements be globally addressed to function. All these technical difficulties limit the effectiveness of the above inventions in providing practical solutions to the above-mentioned limitations.

patent application Ser. No. 10/329,645, now U.S. Pat. No. 7,468,717, filed by an inventor of this Application, discloses a pixel display configuration by providing a voltage controller in each pixel control circuit for controlling the voltage inputted to the pixel electrodes. The controller includes a function of multiplexing the voltage input to the pixel electrodes and also a bit buffering and decoupling function to decouple and flexibly change the input voltage level to the pixel electrodes. The rate of DC balancing can be increased to one KHz and higher to mitigate the possibility of DC offset effects and the image sticking problems caused by slow DC balancing rates. U.S. Pat. No. 7,468,717 further discloses an enabling technology for switching from one DC balance state to another without rewriting the data onto the panels. Therefore, the difficulties of applying a high voltage CMOS designs are resolved. Standard CMOS technologies can be applied to manufacture the storage and control panel for the LCOS displays with lower production cost and higher yields. The DC-balancing controller of U.S. Pat. No. 7,468,717 is implemented with a ten-transistor (10-T) configuration comprising two p-channel MOSFET transistors. While the controller is efficiently implemented, it does have a technical limitation due to a constraint that the p-channel MOSFET transistors are not effective in pulling down the voltage of the pixel mirror. The lower voltage limit $V_0$ that the controller can assert on the pixel must set to 1.0 to 1.3 volts above the semiconductor ground voltage $V_{SS}$ with the precise voltage depending on the design details of the circuits. The limitation occurs due to the fact that a p-channel MOSFET transistor is strong in pulling the voltage up to $V_{DD}$ while weak in pulling down the voltage to $V_{SS}$.

application Ser. No. 10/413,649, now U.S. Pat. No. 7,443,374, filed by an inventor of this application, discloses an improvement on the previously mentioned invention that eliminates the voltage restriction on the drive voltage by replacing the DC balance circuit with a new circuit that is able to operate in a voltage environment with $V_0$ as low as $V_{SS}$ or perhaps even lower. Implementing the improved DC balance does solve the problem but requires two additional transistors and also requires that break-before-make circuits be added to the peripheral circuitry.

application Ser. No. 10/742,262, now U.S. Pat. No. 7,088,329, filed by an inventor of this application, discloses a different operating mode for the circuits disclosed in Ser. No. 10/413,649, wherein the operation of the DC balance circuit is modified to decouple the pixel voltage from the 6T SRAM memory cell and thereby enable the writing of new data to the 6T cell while relying on circuit capacitance to hold the last voltage state on the pixel mirror for a limited period of time. The ability to load data while holding a previous state is a common requirement for field sequential color display systems wherein the color fields are shown in a time sequence rather than simultaneously, thus enabling all colors to be generated by a single display. Various techniques such as added memory devices within the pixel have been disclosed in competing products, but at some expense in design complexity and subsequent yield.

A weakness of this approach is that because the voltage on the cell cannot be changed during that time the liquid crystal cell cannot be DC balanced during that interval. Various obvious schemes such as alternating the field direction between successive instances are available but not ideal.

Another weakness of this approach is that it does not allow the liquid crystal cell to be reset to a known state during the re-write interval. If there is a need to drive the display to a known dark state to minimize color channel data cross-coupling then that must be done by writing the entire array to a dark state logic setting before the DC balance circuit is invoked to permit rewriting the display memory array to a new data state. This requires that the illumination source be interrupted to permit these operations to take place without degrading the appearance of the display.

application Ser. No. 10/435,427 ('427 application), filed by an inventor of this application, discloses a modulation method compatible with the digital display system disclosed herein. A first row write action takes place on a given row, followed by a second row write action separated from the first row write action by one or more rows, this being following by a third row write action separated from the second row write action by one or more rows, and so forth until a predetermined number of rows have been written with a plurality of different row spacings, whereupon the pattern is repeated after moving the initial row write action by a predetermined spacing, normally one row. The rate of movement of the set of row write actions along the rows of the display and the spacing between the row write actions determines how long the pixels of a row modulates the display according to the data loaded into them. Through practice and experimentation, predetermined spacings may be set up that generate a desired gray scale range. The application also discloses a method of ordering data for higher order bits into thermometer segments in which the higher order bits are always populated in the same order, thereby reducing the data phase errors that cause dynamic false contours and nematic liquid crystal lateral field effects. The use of multiple write actions in this manner is often referred to by the inventor as "multiple write pointers", "swath modulation" or "MegaMod".

The modulation method disclosed in the '427 application must be adapted and modified for use in field sequential color displays because of the extended time the method of '427 require to render the entire display into an image data state for a new color.

application Ser. No. 11/740,244 ('244 application), filed by an inventor of this application, discloses a modulation method compatible with the display disclosed herein, in which data displayed on a row is terminated through an instruction embedded in the write data delivered to a different row that writes all storage elements on that row to a single predetermined data value, normally representing a dark state. The selection of a row write action in which to embed to embed the termination instruction is based primarily on the desired elapsed time since the first row write action and secondarily on the availability the embedded instruction slot on the second row write action. The invention was originally conceived as a means for reducing errors in the length of the modulation segments created according to application Ser. No. 10/435,427 ('427 application) previously described. One form of correction disclosed in the '244 application is means for providing a gray scale modulation segment of shorter duration than the shortest bit duration available in the modulation method of the '427 application.

For these reasons, there is still need in the art of LCOS display to provide improved system configurations and to provide alternative means to deliver voltages to pixel mirrors that overcome these limitations.

SUMMARY OF THE PRESENT INVENTION

It is therefore an object of the present invention to further improve the pixel display configuration by providing a circuit that may be operated to drive the pixels of the display to one of a set of predetermined voltage drive levels while new data is being loaded, thereby maintaining the accuracy of gray levels, enabling DC balancing during the drive to a predetermined voltage level, enhancing system contrast by enabling a reduction in the time required to write and display new data, and reducing artifacts associated with field sequential color systems. In addition to the features that a controller includes a function of multiplexing the voltage input to the pixel electrodes and also a bit buffering and decoupling function to decouple and flexibly change the input voltage level to the pixel electrodes, the controller is now enabled to pull down and pull up the pixel mirror as an array to a voltage corresponding to a dark state or other predetermined state.

In summary, this invention discloses a method for displaying an image data on a pixel display element. The method includes a step of configuring an alternate voltage control means including a MOSFET p-channel transistor and a MOSFET n-channel transistor, each means capable of selecting an electrode voltage for applying to an inverter that asserts a predetermined voltage onto the electrode of the pixel display element.

These and other objects and advantages of the present invention will no doubt become obvious to those of ordinary skill in the art after having read the following detailed description of the preferred embodiment, which is illustrated in the various drawing figures.

BRIEF DESCRIPTION OF THE DRAWINGS

FIG. 10 presents a table describing the interactions between the data states and control states supplied to the pixel cells and the resulting gray scale images.

FIG. 21 shows a table describing the interactions of the signals associated with FIG. 22 shows the voltage scale for the voltage controller and for the ITO volt when multiplexed according to the present invention.

DETAILED DESCRIPTION OF THE PREFERRED EMBODIMENT

Figure 1:
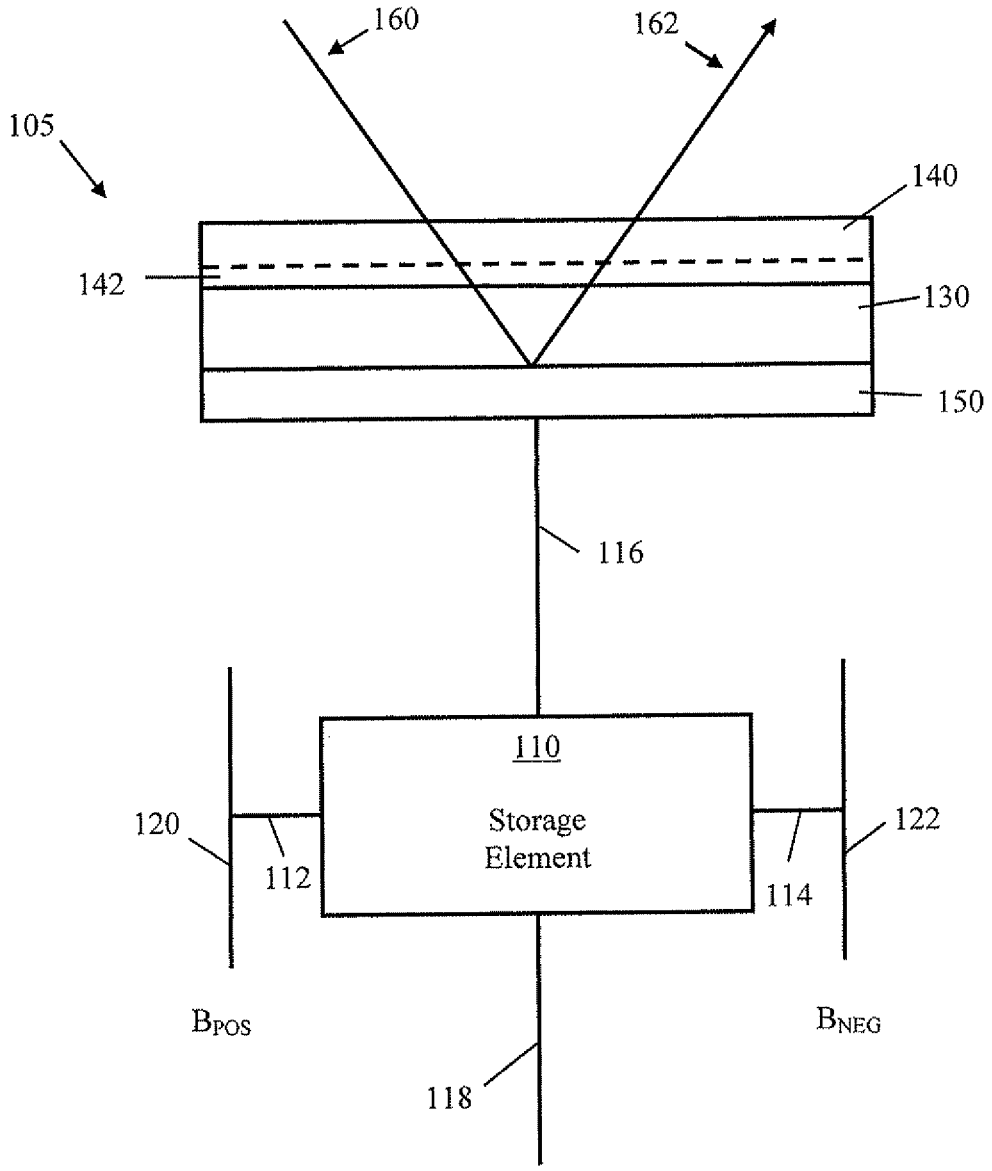
FIG. 1 is a block diagram of a single liquid crystal pixel cell that utilizes a reflective pixel electrode.
Figure 2:
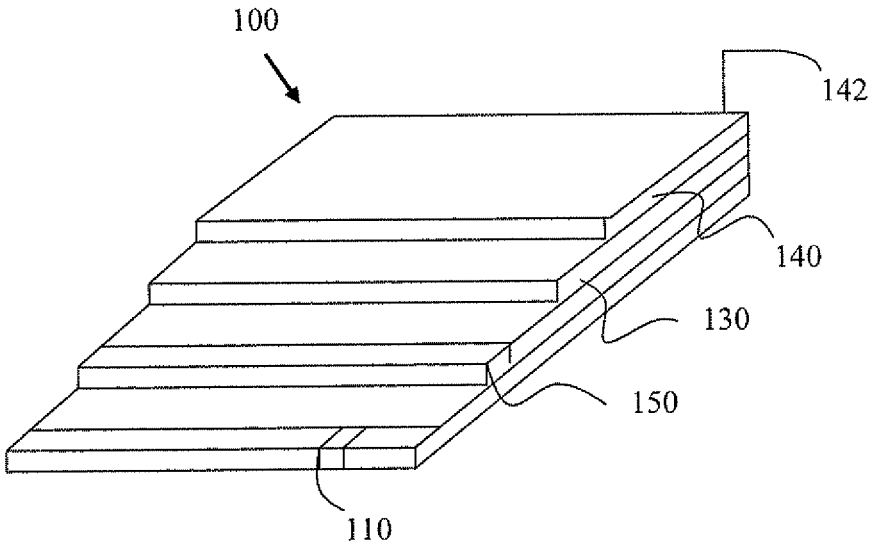
FIG. 2 is a perspective diagram of a liquid crystal on silicon display panel.

FIGS. 1 and 2 show the general construction of a liquid crystal on silicon (LCOS) micro-display panel 100. A single pixel cell 105 comprises a liquid crystal layer 130 between transparent common electrode 140, and pixel electrode 150. A storage element 110 is coupled to the pixel electrode 150, and comprises complementary data input terminals 112 and 114, data output terminal 116, and control terminal 118. The storage element 110 is responsive to a write signal placed on control terminal 118, reads complementary data signals asserted on a pair of bit lines ($B_{POS}$ and $B_{NEG}$) 120 and 122, and latch the data signal through the output terminal 116. Since the output terminal 116 is coupled to the pixel electrode 150, the data (i.e. high or low voltage) passed by the storage element 110 is imparted on the pixel electrode 150. The pixel electrode 150 is preferably formed from a highly reflective polished aluminum. In the LCD display panel in accordance with the present invention, a pixel electrode 150 is provided for each pixel in the display. For example, in an SXGA display system that requires an array of 1280×1024 pixels, there would be an individual pixel electrode 150 for each of the 1,310,720 pixels in the array. The transparent common electrode 140 is a uniform sheet of conductive glass preferably made from Indium Tin-Oxide (ITO). A voltage ($V_{ITO}$) is applied to the common electrode 140 through common electrode terminal 142, and in conjunction with the voltage applied to each individual pixel electrode, determines the magnitude and polarity of the voltage across the liquid crystal layer 130 within each pixel cell 105 in the display 100.

When an incident polarized beam 160 is directed at the pixel cell 105, passes through the transparent common electrode 140 the polarization state of the incident light is modified by the liquid crystal material 130. The manner in which the liquid crystal material 130 modifies the state of polarization of the incident light beam 160 is dependent on the RMS voltage applied across the liquid crystal. A voltage applied across the liquid crystal material 130 affects the manner in which the liquid crystal material will transmit light. For example, applying a certain voltage across the liquid crystal material 130 may only allow a fraction of the incident polarized light to be reflected back through the liquid crystal material and the transparent common electrode 140 in a modified polarization state that will pass through subsequent polarizing elements. After passing through the liquid crystal material 130, the incident light beam 160 is reflected by the pixel electrode 150 and back through the liquid crystal material 130. The intensity of an exiting light beam 162 is thus dependent on the degree of polarization rotation imparted by the liquid crystal material 130, which is in turn dependent on the voltage applied across the liquid crystal material 130.

The storage element 110 is preferably formed from a CMOS transistor array in the form of an SRAM memory cell, i.e., a latch, but may be formed from other known memory logic circuits. SRAM latches are well known in semiconductor design and manufacturing and provide the ability to store a data value, as long as power is applied to the circuit. Other control transistors may be incorporated into the memory chip as well. The physical size of a liquid crystal display panel utilizing pixel cells 105 is largely determined by the resolution capabilities of the device itself as well as industry standard image sizes. For instance, an SVGA system that requires a resolution of 800.times.600 pixels requires an array of storage elements 110 and a corresponding array of pixels electrodes 150 that are 800 long by 600 wide (i.e. 48,000 pixels). An SXGA display system that requires a resolution of 1280×1024 pixels, requires an array of storage elements 110 and a corresponding array of pixels electrodes 150 that are 1280 long by 1024 wide (i.e. 1,310,720 pixels). Various other display standards may be supported by a display in accordance with the present invention, including XGA (1024×768 pixels), UXGA (1600×1200 pixels), and high definition wide screen formats (1920×1080 pixels). Any combination of horizontal and vertical pixel resolution is possible. The precise configuration is determined by industry applications and standards. Since the transparent common electrode 140 (ITO glass) is a single common electrode, its physical size will substantially match the total physical size of the pixel cell array with some margins to permit external electrical contact with the ITO and space for gaskets and a fill hole to permit the device to be sealed after it is filled with liquid crystal.

Note that by changing the thickness of liquid crystal layer 130 to approximately one-half wave at the wavelength of interest and by changing the orientation of the alignment layers on the two surfaces a microdisplay may be configured as a phase only modulator for coherent light. The orientation of the alignment layers on the two surfaces should be anti-parallel, as is well known in the art, and should be parallel to the polarization of the incident coherent light.

Figure 3:
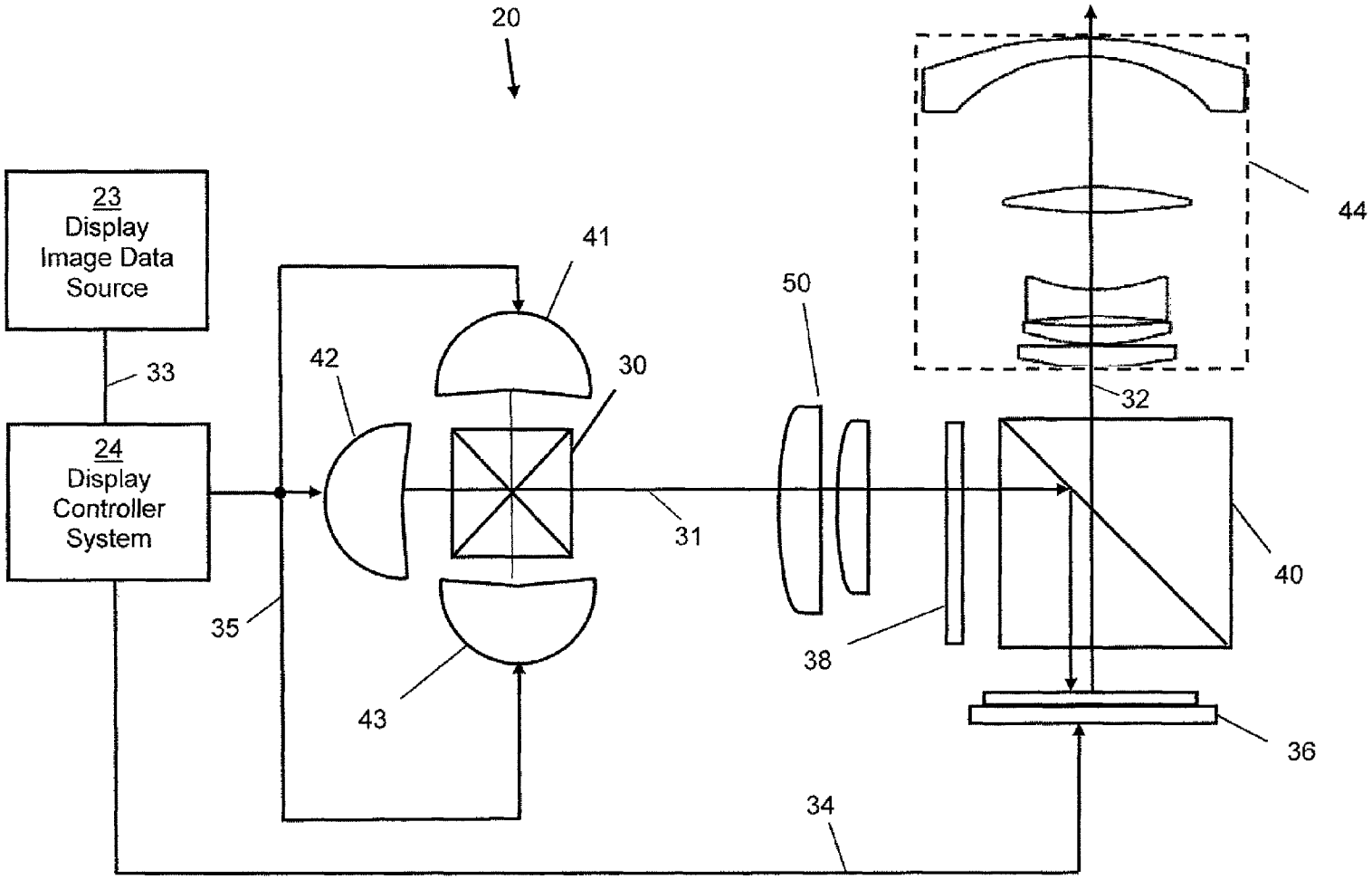
FIG. 3 is a diagram of a projection display system utilizing a liquid crystal display panel.

FIG. 3 presents a system diagram of a typical field sequential color projection system 20 comprising reflective liquid crystal microdisplay 36 (hereafter microdisplay 36) after the type disclosed in the present application, display controller system 24, red LED 41, green LED 42, blue LED 43, color combining prism (x-cube) 30, polarizing beam splitter 40, projection optics 44, and various other components.

Display controller system 24 receives multi-color image data from display image data source 23 over link 33. Link 33 may be wire, optical, data bus, wireless RF or other means known in the art. Display controller system 24 processes the received data to segregate the data by color and performs any other transformations needed to prepare the data for delivery to microdisplay 36. To display data for a predetermined color, display controller system 24 send formatted data for that color to microdisplay 36 over link 34 and sends a signal to the selected color LED among 41, 42 and 43 over link 34 that causes that LED to radiate. Red LED 41, green LED 42 and blue LED 43 are arrayed around color combining prism (x-cube) 30 such that all colors are relayed to the optical components along a common optical path represented as light beam 31. Optional condensing lens 50 acts upon light beam 31 so as to direct it to the imaging area of microdisplay 36. Optional pre-polarizer 38 is arrayed so as to block p-polarized light and to pass s-polarized light to polarizing beam splitter (PBS) 40. PBS 40 will reflect s-polarized light from its internal angled surface and will pass p-polarized light. Microdisplay 36 acts upon the now polarized light beam 31 so as to modify the polarization state of those parts of the beam over pixels in an "on" condition and not to modify the polarization state of those parts of the beam over pixels in an "off" condition. The PBS now passes those parts of light beam 32 in a p-polarized state and reflects those parts of light 32 in an s-polarized state from its angled surface. The same process is repeated for each color according to a predetermined scheme, thus resulting in the display of a series of single color images that recur fast enough to be perceived by human observers as colored images.

Figure 4:
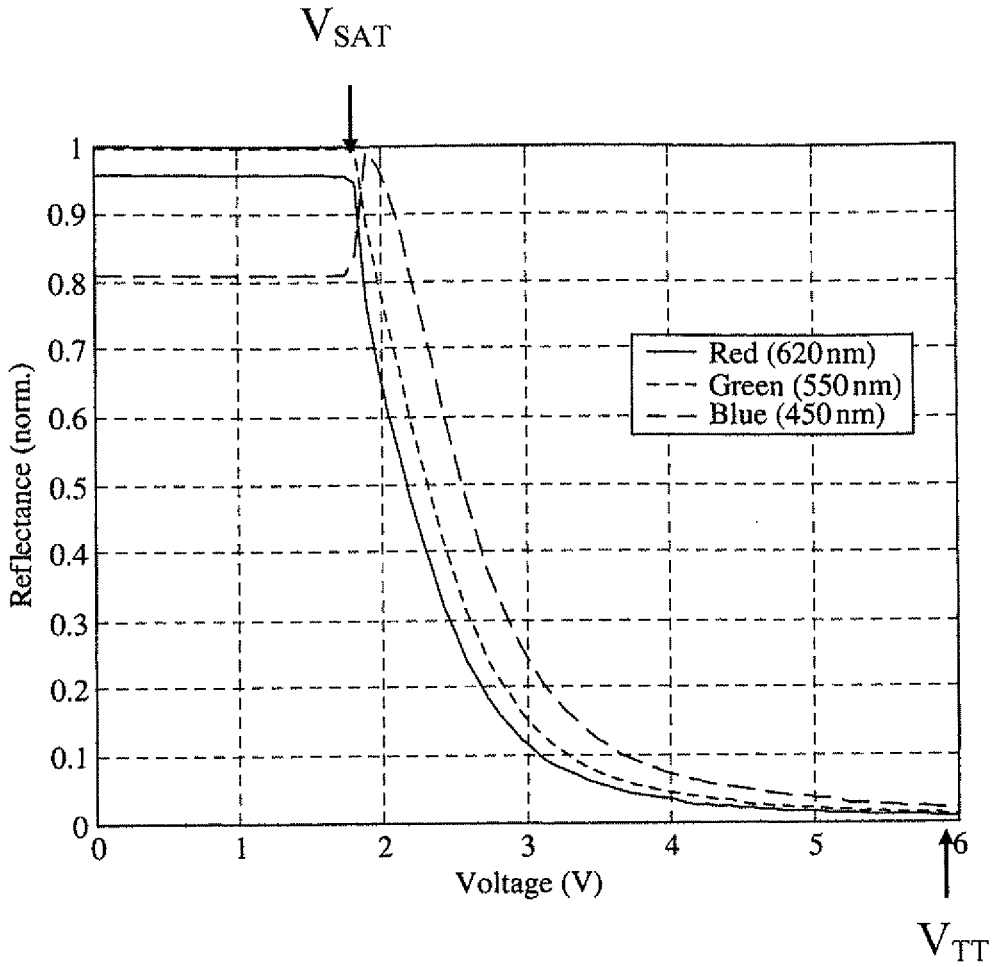
FIG. 4 is an electro-optical response curve for a liquid crystal material.

FIG. 4 shows an electro-optical curve (EO-curve or liquid crystal response curve) for a typical liquid crystal mode known as a 63.6° mixed-mode-twisted-nematic (MTN) with optical compensation operated in the normally white (NW) mode from Robinson et al, "Polarization Engineering for LCD Projection", page 123. Three curves are presented for three different wavelengths of light. MTN modes are often cited as optimal for field sequential color applications because of their low drive voltages, relatively high efficiency and the available of device configurations allow the use of a single dark state voltage and a single bright state voltage for all colors. As illustrated in FIG. 4, as the voltage applied to the liquid crystal increases, the degree of rotation that is induced onto the polarization state of the reflected light is decreased. The liquid crystal material 130 (FIG. 2) has an RMS voltage $V_{SAT}$, where its degree of polarization rotation is at a maximum (white display) and an RMS voltage $V_{TT}$ where the polarization rotation is at a minimum (black display). Within the range between $V_{TT}$ and $V_{SAT}$, as the RMS voltage increases; the brightness of the light that is transmitted through the liquid crystal material 130 (FIG. 2) will decrease from a brighter state to a darker state. At an RMS voltage that corresponds to the point of 100% brightness, the liquid crystal components are aligned substantially in a fan of liquid crystal molecules, thus allowing the light to completely pass through and reflect off of the pixel electrode 150. At an RMS voltage that corresponds to the point of 0% brightness, the crystal components are aligned in a vertical stack of liquid crystal molecules such that the polarization of the reflected light is substantially identical to that of the incoming light source, thus preventing the light from passing through the polarizing element for display. The useful portion of the EO curve is the voltage range between $V_{TT}$ and $V_{SAT}$.

Figure 5:
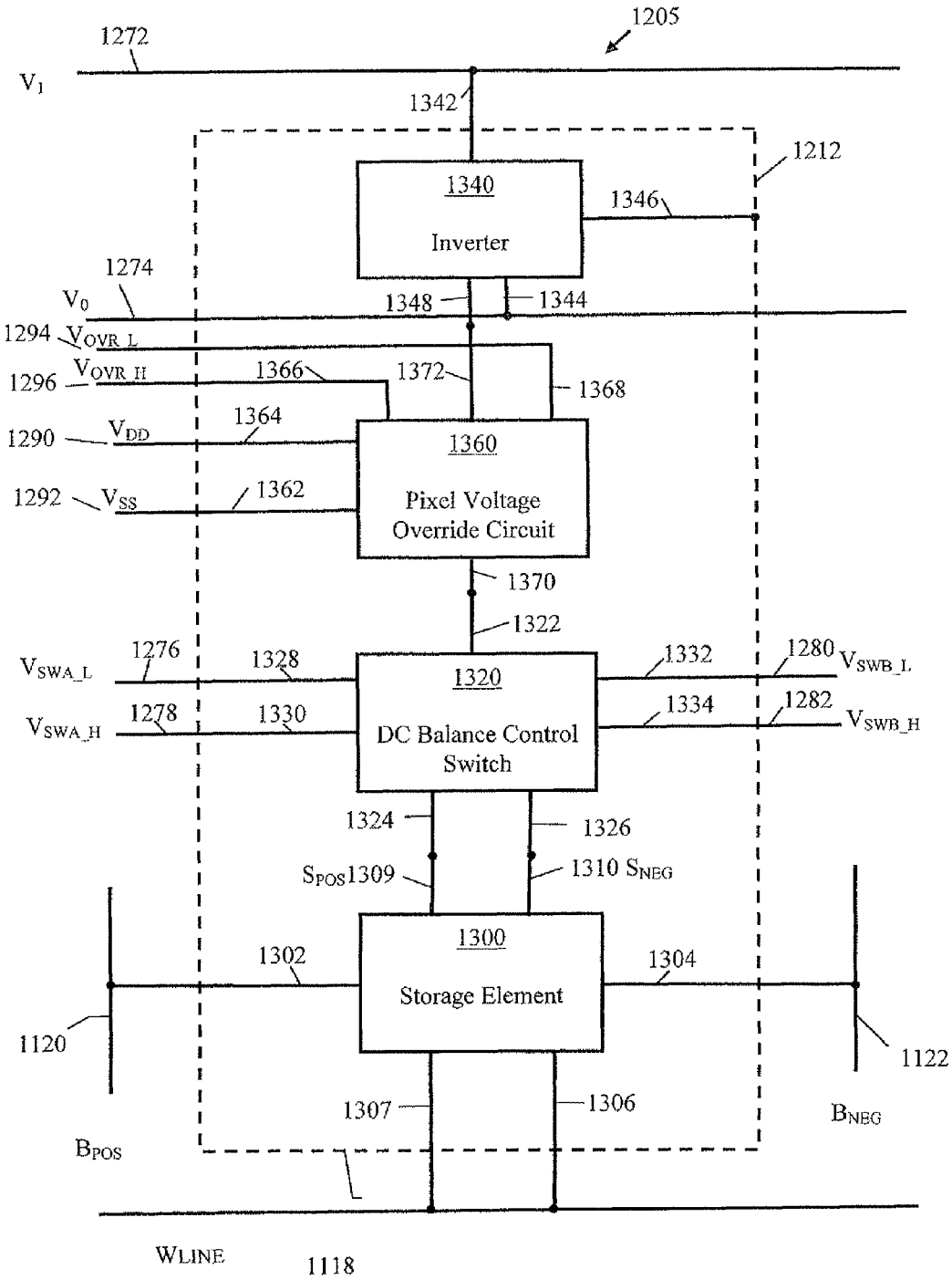
FIG. 5 is a block diagram for showing an independent control and buffering of a binary bit for driving a single pixel.

FIG. 5 shows a block diagram of a single pixel cell 1205 of a display in accordance with the present invention. Pixel cell 1205 comprises storage element 1300, control switch 1320, pixel voltage override element 1360, inverter 1340, and pixel electrode/mirror 1212. DC balance control switch 1320 is preferably a CMOS based logic device that can selectively pass to another device one of several input voltages. Storage element 1300 comprises complementary input terminals 1302 and 1304, respectively coupled to data lines ($B_{POS}$) 1120 and ($B_{NEG}$) 1122. Storage element 1300 also comprises complementary enable terminals 1306 and 1307 coupled to word line ($W_{LINE}$) 1118, and a pair of complementary data output terminals ($S_{POS}$) 1308, and ($S_{NEG}$) 1310. In the present embodiment, storage element 1300 is an SRAM latch, but those skilled in the art will understand that any storage element capable of receiving a data bit, storing the bit, and asserting the complementary states of the stored bit on complementary output terminals may be substituted for the SRAM latch storage element 1300 described herein.

DC balance control switch 1320 comprises a pair of complementary data input terminals 1324 and 1326 which are coupled respectively to data output terminals ($S_{POS}$) 1308 and ($S_{NEG}$) 1310 of storage element 1300. DC balance control switch 1320 also comprises a first voltage supply terminal 1328, and a second voltage supply terminal 1330, which are coupled respectively to the third voltage supply terminal ($V_{SWA_L}$) (logic) 1276, and the fourth voltage supply terminal ($V_{SWB_H}$) (logic) 1278 of voltage controller 1220 (referring to FIG. 11). DC balance control switch 1320 further comprises a third voltage supply terminal 1332, and a fourth voltage supply terminal 1334, which are coupled respectively to the fifth voltage supply terminal ($V_{SWB_L}$) (logic) 1280, and the sixth voltage supply terminal ($V_{SWA_H}$) (logic) 1282 of voltage controller 1220 (referring to FIG. 11). DC balance control switch 1320 further comprises data output terminal 1322 that is coupled to data input terminal 1370 of pixel voltage override circuit 1360.

Pixel voltage override circuit 1360 comprises a data input terminal 1370 that is coupled to data output terminal 1322 of DC balance control switch 1320. Pixel voltage override circuit further comprises a first voltage supply terminal 1362 that is coupled to global voltage supply $V_{SS}$ 1292, a second voltage supply terminal 1364 that is coupled to global voltage supply $V_{DD}$ 1290, a third voltage supply terminal 1366 that is coupled to voltage (logic) supply $V_{OVR_H}$ 1296 a fourth voltage supply terminal 1368 that is coupled to voltage (logic) supply $V_{OVR_L}$ 1294 and a voltage (logic) output terminal 1372 that is coupled to input voltage supply terminal 1348 of inverter 1340.

Inverter 1340 comprises first voltage supply terminal 1342, and second voltage supply terminal 1344, which are coupled respectively to first voltage supply terminal (V1) 1272, and second voltage supply terminal (V0) 1274 of the voltage switch 1320. Inverter 1340 also comprises data input terminal 1348 coupled to the data output terminal 1372 of pixel voltage override circuit 1360, and a pixel voltage output terminal ($V_{PIX}$) 1346 coupled to pixel mirror 1212. The function of the inverter and voltage application circuit is to insure that the correct voltage between $V_0$ and $V_1$ is delivered to the pixel mirror.

Figure 6:
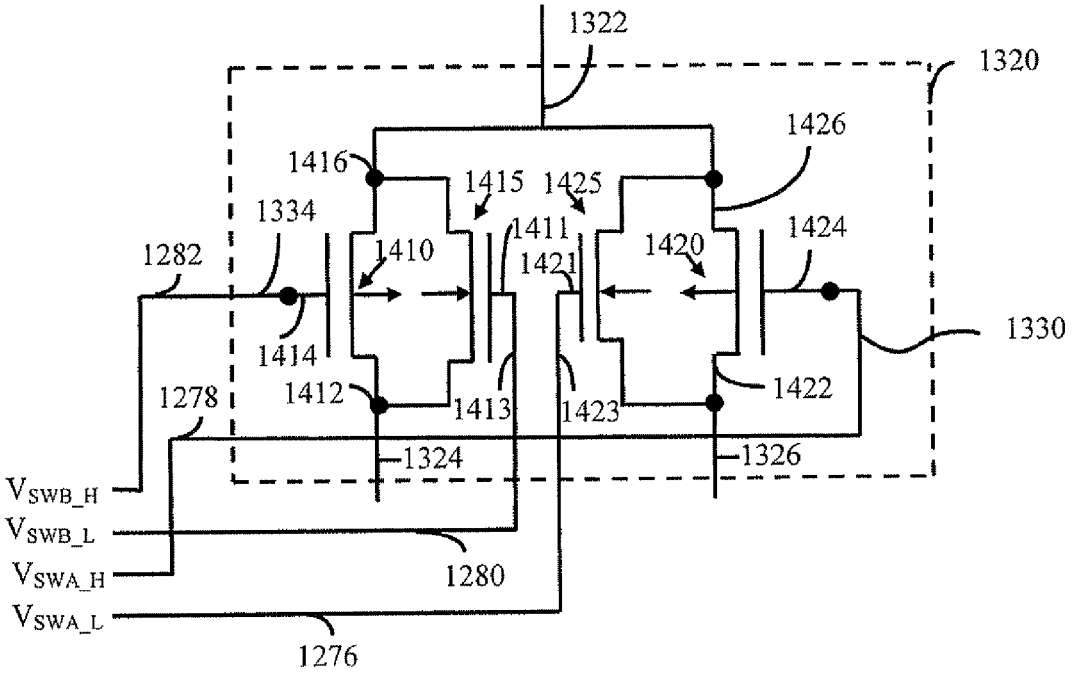
FIG. 6 is a schematic diagram of a preferred DC balance control switch implemented in accordance with one embodiment of the present invention.

FIG. 6 shows a schematic of preferred embodiment of DC balance control switch 1320. DC balance control switch 1320 comprises a first p-channel CMOS transistor 1410 connected in parallel with an n-channel transistor 1415 and a second p-channel CMOS transistor 1420 connected in parallel with a second n-channel transistor 1425. First p-channel transistor 1410 and first n-channel transistor 1415 include a source terminal 1412 coupled to data input terminal 1324. Second p-channel transistor 1420 and second n-channel transistor 1425 comprise source terminal 1422 coupled to input terminal 1326. Input terminal 1324 and input terminal 1326 are coupled to output terminal $S_{POS}$ 1309 and output terminal $S_{NEG}$ 1310 respectively of storage element 1300. Drain terminals 1416 and 1426 of first and second p-channel and n-channel transistors respectively are connected to data output terminal 1322. Data output terminal 1322 is coupled to data input terminal 1370 of pixel voltage override circuit 1360. Gate 1414 of the first p-channel transistor 1410 is connected to terminal 1334 that is in turn coupled to a voltage terminal supply $V_{SWB_H}$ (logic) 1282, gate 1411 of first n-channel transistor 1415 is connected to terminal 1413 that is coupled to voltage supply terminal $V_{SWB_L}$ (logic) 1280. Gate 1424 of second p-channel transistor 1420 is connected to terminal 1330 that is in turn coupled to a voltage supply terminal $V_{SWA_H}$ (logic) 1278, gate 1421 of second n-channel transistor 1425 is connected to terminal 1423 that is coupled to a voltage supply terminal $V_{SWA_L}$ (logic) 1276.

The state of DC balance control switch 1320 where $V_{SWA_H}$="Off", $V_{SWA_L}$="Off", $V_{SWB_H}$="Off", and $V_{SWB_L}$="Off" isolates output terminals $S_{POS}$ 1309 and $S_{NEG}$ 1310 of 6T SRAM storage element 1300 from the elements that follow DC balance control switch 1320. In normal operation a pair of logic voltages $V_{SWA_L}$ 1276 and $V_{SWA_B}$ 1278 will be configured to "On" and a second pair of logic voltages $V_{SWB_L}$ 1280 and $V_{SWB_H}$ 1282 will be configured to "Off" or vice versa. A transition from one pair on to the other pair on requires a momentary transition through the state described in the first sentence of this paragraph to avoid directly connecting $S_{POS}$ 1309 and its complement $S_{NEG}$ 1310, thereby shorting 6T SRAM storage element 1300

Figure 7:
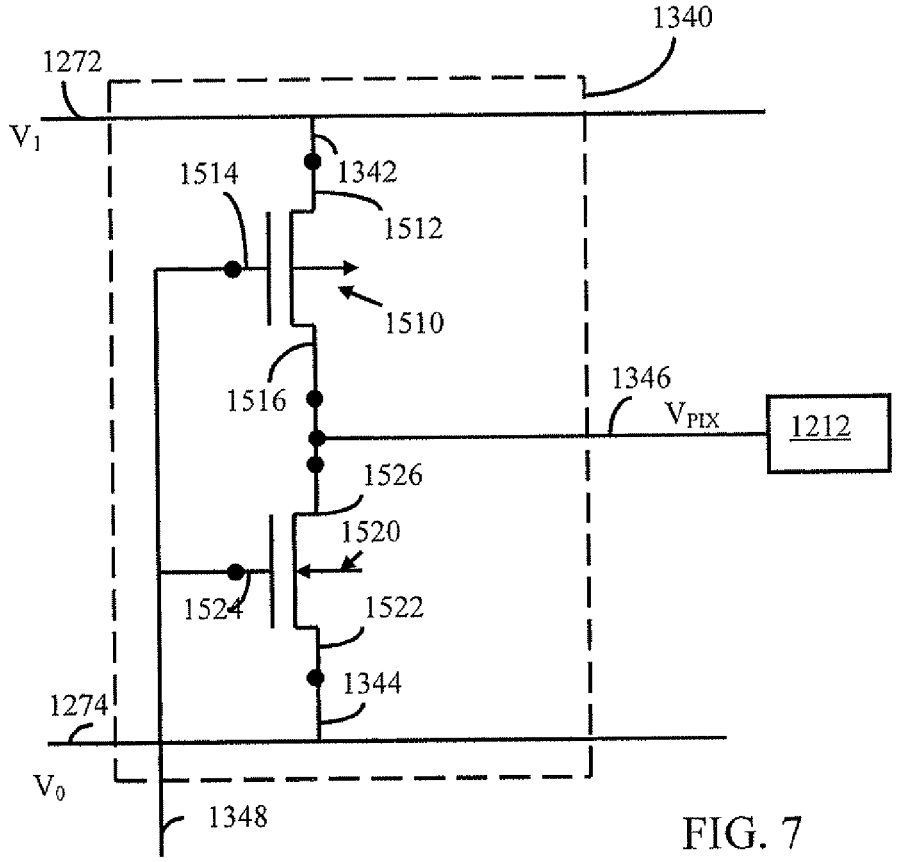
FIG. 7 is a schematic diagram of a preferred buffering and voltage application circuit implemented in FIG. 5 in accordance with the present invention.

FIG. 7 shows a schematic of a preferred embodiment of inverter 1340. Inverter 1340 comprises p-channel CMOS transistor 1510 and n-channel transistor 1520. P-channel transistor 1510 comprises source terminal 1512 connected to first voltage supply terminal (V1) 1342, gate terminal 1514 coupled to data input terminal 1348, and drain terminal 1516 coupled to the pixel voltage output terminal ($V_{PIX}$) 1346. N-channel transistor 1520 comprises source terminal 1522 coupled to second voltage supply terminal (V0) 1344, gate terminal 1524 coupled to data input terminal 1348, and drain terminal 1526 coupled to pixel voltage output terminal ($V_{PIX}$) 1346. Pixel voltage output terminal ($V_{PIX}$) 1346 is coupled to pixel mirror 1212.

Figure 8:
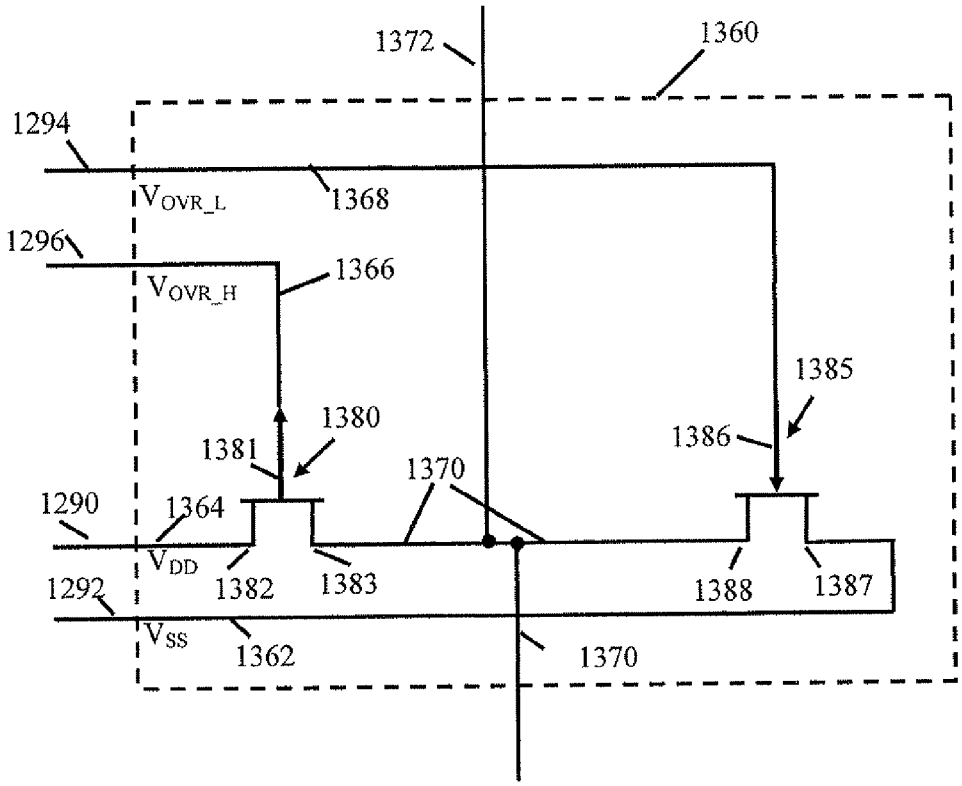
FIG. 8 is a schematic of a preferred storage element implemented in FIG. 5 in accordance with the present invention.

FIG. 8 is a schematic of a preferred embodiment of Pixel Voltage Override Circuit 1360. Pixel voltage override circuit 1360 comprises first p-channel MOSFET transistor 1380 and first n-channel MOSFET transistor 1385 with drains 1383 and 1388 coupled to output terminal 1372. Data input terminal 1370 is directly connected to data output terminal 1372. $V_{DD}$ terminal 1290 is coupled to input terminal 1364 and $V_{SS}$ terminal 1292 is coupled to input terminal 1362. $V_{DD}$ input terminal 1364 is coupled to source terminal 1382 of MOSFET transistor 1380 and $V_{SS}$ input terminal 1362 is coupled to source terminal 1387 of MOSFET transistor 1385. Voltage supply terminal (logic) 1294 is coupled to voltage override signal low terminal $V_{OVR_L}$ (logic) 1368 and voltage supply terminal (logic) 1296 is coupled to voltage override signal high terminal $V_{OVR_H}$ (logic) 1366. Terminal $V_{OVR_L}$ 1368 is coupled to gate 1386 of MOSFET transistor 1385 and terminal $V_{OVR_H}$ 1366 is coupled to gate 1381 of MOSFET transistor 1380.

Figure 9:
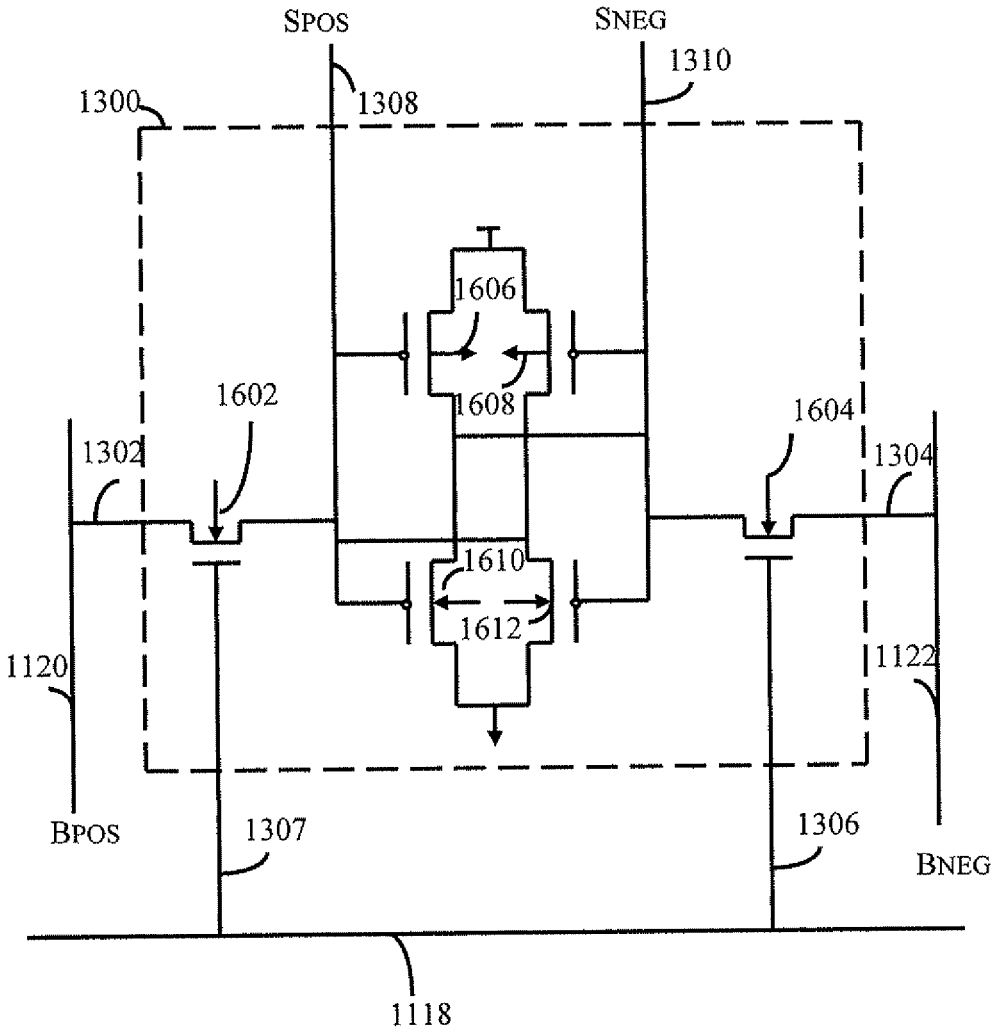
FIG. 9 is a schematic of a preferred pixel voltage override circuit implemented in FIG. 5 in accordance with the present invention.

FIG. 9 shows a preferred embodiment of a storage element 1300. The storage element 1300 is preferably a CMOS static ram (SRAM) latch device. Such devices are well known in the art. See DeWitt U. Ong, Modern MOS Technology, Processes, Devices, & Design, 1984, Chapter 95, the details of which are hereby fully incorporated by reference into the present application. A static RAM is one in which the data is retained as long as power is applied, though no clocks are running FIG. 9 shows the most common implementation of an SRAM cell in which six transistors are used. Transistors 1602, 1604, 1610, and 1612 are n-channel transistors, while transistors 1606, and 1608 are p-channel transistors. In this particular cell, the word line 1118 turns on the two pass transistors 1602 and 1604, allowing the ($B_{POS}$) 1120, and the ($B_{NEG}$) 1122 lines to remain at a pre-charged high state or be discharged to a low state by the flip flop (i.e., transistors 1606, 1608, 1610, and 1612). Differential sensing of the state of the flip-flop is then possible. In writing data into the selected cell, ($B_{POS}$) 1120 and ($B_{NEG}$) 1122 are forced high or low by additional write circuitry. The side that goes to a low value is the one most effective in causing the flip-flop to change state.

The six-transistor SRAM cell is desired in CMOS type design and manufacturing since it involves the least amount of detailed circuit design and process knowledge and is the safest with respect to noise and other effects that may be hard to estimate before silicon is available. In addition, current processes are dense enough to allow large static RAM arrays. These types of storage elements are therefore desirable in the design and manufacture of liquid crystal on silicon display devices as described herein. However, other types of static RAM cells are contemplated by the present invention, such as a four transistor RAM cell using a NOR gate, as well as using dynamic RAM cells rather than static RAM cells.

As configured in FIG. 6, DC balance control switch 1320, being responsive to a set of predetermined voltages on the first set of logic voltage supply terminals 1282 ($V_{SWB_H}$) and 1280 ($V_{SWB_L}$) and a predetermined set of voltages on the second set of logic voltage supply terminals 1278 ($V_{SWA_H}$) and 1276 ($V_{SWA_L}$), can selectively direct either one of the high or low data values that are stored in the storage element 1300, through the output terminal 1322 of DC balance control switch 1320 and into input terminal 1370 of pixel voltage override circuit 1360. Input terminal 1370 of pixel voltage override circuit 1360 is in turn coupled directly to output terminal 1372. Output terminal 1372 is coupled to input terminal 1348 of the inverter 1340. Pixel voltage override circuit 1360 is operated so as to not assert voltages to output terminal except when DC balance control switch 1320 is operated not to assert a voltage to input terminal 1370 of pixel voltage override circuit. Specifically, the voltages of the voltage supply terminals and the output voltage $V_{PIX}$ to the pixel electrodes after a pixel write operation corresponding to the states of the input terminals $B_{POS}$ 1120 and $B_{NEG}$ 1122 to the storage element (referring to FIG. 9) are shown in the table presented in FIG. 10. Additionally the voltages of the supply terminals and the output voltage $V_{PIX}$ to the pixel electrodes after application of a voltage by the pixel voltage override circuit are shown in the table presented in FIG. 10. Additionally certain defective combinations of voltage supply terminals are shown in the table presented in FIG. 10.

In FIG. 10 values marked as "On" correspond to that voltage which when applied to the gate of a MOSFET type transistor switch causes the transistor to couple the voltage present at its source terminal to its drain terminal. Values marked as "Off" correspond to that voltage which when applied to the gate of a MOSFET transistor switch causes the transistor not to couple the voltage present at its source terminal to its drain terminal. Specifically an "On" state voltage for an n-channel MOSFET transistor switch is a high voltage and an "Off" state voltage for a n-channel transistor is a low voltage. Likewise a "On" state voltage for a p-channel MOSFET transistor switch is a low voltage and an "Off" state voltage for a p-channel transistor is a high voltage.

In their most simplified form, transistors are nothing more than an on/off switch. In a CMOS type design, the gate of the transistor controls the passage of current between the source and the drain. In an n-channel transistor, the switch is closed or "on" if the drain and the source are connected. This occurs when there is a high value, or a digital "1" on the gate. The switch is open or "off" if the drain and the source are disconnected. This occurs when there is a low value, or a digital "0" on the gate. In a p-channel transistor, the switch is closed or "on" when there is a low value, or a digital "0", on the gate. The switch is open or "off" when there is a high value, or digital "1" on the gate. The p-channel and n-channel transistors are therefore "on" or "off" for complementary values of a gate signal.

In a first mode of operation of pixel circuit 1205 of FIG. 5, pixel voltage override circuit 1360 receives signals from DC balance control switch 1320 and is configured to an inactive state wherein the control voltage $V_{OVR_H}$ 2296 is configured to deliver a high voltage to p-channel transistor the control voltage and $V_{OVR_L}$ 2294 is configured to deliver a low voltage to n-channel transistor, thus shutting off both MOSFET transistors. The voltage applied to the output terminal 1322 of DC balance control switch 1320 is applied to input terminal 1370 of pixel voltage override circuit 1360 that in turn is applied to output terminal 1372 of pixel override circuit 1360. Output terminal 1372 is in turn coupled to input terminal 1348 of inverter 1340 where the applied voltage acts to select one of $V_0$ 2274 and $V_1$ 2272 to be applied to the output terminal 1346 of the inverter to be asserted to pixel mirror 1212. The resulting states are described in Columns 1 through 4 of FIG. 10. This mode is also referred to as "Normal" mode.

In a second mode of operation of pixel circuit 1205 DC balance control switch 1320 logic voltages $V_{SWA_L}$ 1276, $V_{SWA_H}$ 1278, $V_{SWB_L}$ 1280 and $V_{SWB_H}$ 1282 are all set to the voltage corresponding to an "Off" state. $V_{OVR_H}$ 1296 and $V_{OVR_L}$ 1294 are both set to the voltage corresponding to an "Off" state. In this state no voltage is asserted onto output terminal 1322 of DC balance control switch 1320 and therefore the circuit will hold at the last applied voltage until the charge decays. The line through input terminal 1370 and output terminal 1372 of pixel voltage override circuit 1360 is likewise charged to the last applied voltage, as is input terminal 1348 of inverter 1340. Until this voltage decays inverter 1348 will continue to assert either $V_0$ 1274 or $V_1$ 1272 onto output terminal $V_{PIX}$ 1346 for delivery to pixel mirror 1212. When operating in this mode 6T SRAM storage element 1300 may be rewritten without changing the output of the inverter. The mode may be terminated by activating a valid mode of DC balance control switch 1320 or by activating a valid mode of pixel voltage override circuit 1360. Because this mode is not driven it is not possible to conduct a DC balance operation during a single instance. A controller may be designed to coordinate these intervals and schedule consecutive or near-consecutive instances of this mode to occur in opposite DC balance states. This state is described in columns 5 and 6 of FIG. 10. This mode is also referred to as "Isolate" mode.

In a third mode of operation of pixel circuit 1205, DC balance control switch 1320 $V_{SWA_L}$ 1276, $V_{SWA_H}$ 1278, $V_{SWB_L}$ 1280, and $V_{SWB_H}$ 1282 are all set to the voltage corresponding to an Off state. One of $V_{OVR_H}$ 1296 and $V_{OVR_L}$ 1294 is set to the voltage corresponding to an Off state and the other is set to the voltage corresponding to an On state. The voltage asserted onto output terminal 1372 is one of approximately $V_{DD}$ 1290 or approximately $V_{SS}$ 1292. Those skilled in the art will recognize that the voltage delivered over output terminal 1372 to input terminal 1348 of inverter 1340 will vary slightly from $V_{DD}$ or $V_{SS}$ because of the secondary effects of the realization of the circuits. This slight difference is not important because inverter 1340 uses these voltages to select between $V_0$ and $V_1$. A circuit designer of ordinary skill will understand this and have the skill to implement an inverter circuit with the required tolerances. The display may be driven alternately between the states described in columns 9 and 10 of FIG. 10 in time intervals of equal duration with the result that the display will remain DC balanced for liquid crystal operation. This mode is also referred to as "Override" mode.

In a first defective state of operation of pixel circuit 1205, the operation of DC balance control switch 1320 places the pixel circuit in a state wherein the contents of storage element 1300 may be reset. The inventors have proven experimentally that placing state of $V_{SWA_L}$="On" at the same time or placing $V_{SWB_L}$="On" and the state of $V_{SWA_H}$="On" and $V_{SWB_H}$="On" at the same time will reset storage element 1300. This condition is avoided through the use of a "break before make" mode of control for the DC balance control switch as is explained later. These defective states are described in columns 7 and 8 of FIG. 10.

In a second defective state of operation of pixel circuit 1205, the operation of pixel voltage control circuit 1360 may connect $V_{DD}$ directly to $V_{SS}$ with a predictable and substantial increase in current flow that may result in component overheating and ultimately in latch-up. The defective condition exists when $V_{OVR_H}$ 1294 applied to gate 1381 of p-channel MOSFET 1280 is set to a low voltage thus applying $V_{DD}$ onto output terminal 1370 and $V_{OVR_L}$ 1296 asserted to gate 1386 of n-channel MOSFET 1385 is set to a high voltage thus applying $V_{SS}$ onto output terminal 1370 with a resultant short condition. Therefore it is a necessary part of this invention that the condition where both transistors are "On" be avoided. This defective state is described in column 11 of FIG. 10. A method for avoiding this condition is taught in a following part of this document.

The three distinct modes of operating pixel 1205 afford a system designer with great flexibility in implementing modulation schemes. It is possible, for example, to operate the pixel according to the principles disclosed in U.S. patent application Ser. No. 10/413,649, now U.S. Pat. No. 7,443,374, by operating according to the first mode of operation described above. It is possible to operate the pixel according to the principles disclosed in U.S. patent application Ser. No. 10/742,262, now U.S. Pat. No. 7,088,329, by operating according to the second mode of operation described above. It is further possible to operate according to the third mode of operation described above. It is also possible and desirable to operate according to all or part of the three modes as part of a general modulation scheme.

Figure 11:
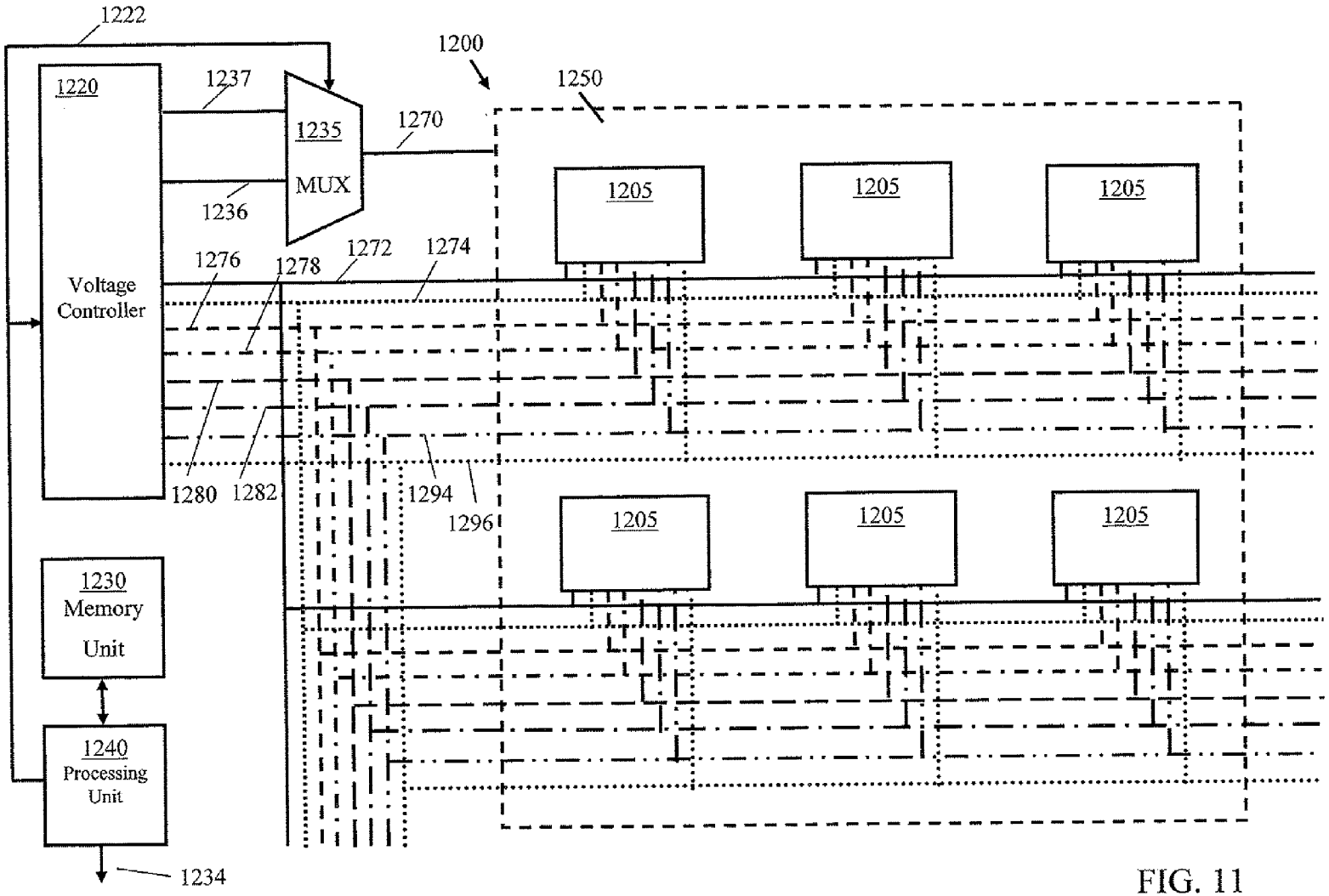
FIG. 11 is a diagram of a multi pixel liquid crystal array in accordance with the present invention.

FIG. 11 shows a display system 1200 in accordance with the present invention. Display system 1200 comprises an array comprising a plurality of pixel cells 1205, voltage controller 1220, processing unit 1240, memory unit 1230, and transparent common electrode 1250. Voltage controller 1220, processing unit 1240 and memory unit 1230 may form part of a subsystem referred to as a display controller. Other parts of such a display controller may include data receiving means and other functions. These components and associated functions are well known in the art. The particular choice of what functions are grouped with what other functions is normally an engineering decision. The common transparent electrode overlays the entire array of pixel cells 1205. In a preferred embodiment, pixel cells 1205 are formed on a silicon substrate or base material, and are overlaid with an array of pixel mirrors 1212, each single pixel mirror 1212 corresponding to a single pixel cell 1205. A substantially uniform layer of liquid crystal material is located in between the array of pixel mirrors 1212 and the transparent common electrode 1250. An alignment layer of a suitable material and orientation is applied to the array of pixel mirrors 1212 and to the transparent common electrode 1250 to control the orientation of the liquid crystal molecules at those surface. The transparent common electrode 1250 is preferably formed from a conductive glass material such as Indium Tin-Oxide (ITO). The memory 1230 is a computer readable medium including programmed data and commands. The memory is capable of directing the processing unit 1240 to implement various voltage modulation and other control schemes. The processing unit 1240 receives data and commands from the memory unit 1230, via a memory bus 1232, provides internal voltage control signals, via voltage control bus 1222, to voltage controller 1220, and provides data control signals (i.e., image data into the pixel array) via data control bus 1234. The voltage controller 1220, the memory unit 1230, and the processing unit 1240 may be located on a different portion of the display system than the array of pixel cells 1205.

Responsive to control signals received from the processing unit 1240, via the voltage control bus 1222, the voltage controller 1220 provides predetermined voltages to each of the pixel cells 1205 via a first voltage supply terminal ($V_1$) 1272, a second voltage supply terminal ($V_0$) 1274, a third (logic) voltage supply terminal ($V_{SWA_L}$) 1276, a fourth (logic) voltage supply terminal ($V_{SWA_H}$) 1278, a fifth (logic) voltage supply terminal ($V_{SWB_L}$) 1280, a sixth (logic) voltage supply terminal ($V_{SWB_B}$) 1282, a seventh (logic) supply terminal ($V_{OVR_L}$) 1294 and an eighth (logic) voltage supply terminal ($V_{OVR_H}$) 1296. The voltage controller 1220 also supplies predetermined voltages $V_{ITO_L}$ by voltage supply terminal 1236 and $V_{ITO_H}$ by voltage supply terminal 1237 to ITO voltage multiplexer unit 1235. Voltage multiplexer unit 1235 selects between $V_{ITO_L}$ and $V_{ITO_H}$ based on the logic state delivered over control line 1222 that is based on the same state information that determines ($V_{SWA_L}$) 1276, ($V_{SWA_H}$) 1278, ($V_{SWB_L}$) 1280, and ($V_{SWB_H}$) 1282. The ITO voltage multiplexer unit 1235 delivers $V_{ITO}$ to the transparent common electrode 1250, via a voltage supply terminal ($V_{ITO}$) 1270. Each of the voltage supply terminals ($V_1$) 1272, ($V_0$) 1274, ($V_{SWA_L}$) 1276, ($V_{SWA_H}$) 1278, ($V_{SWB_L}$) 1280, ($V_{SWB_H}$) 1282, ($V_{OVR_L}$) 1294, ($V_{OVR_H}$) 1296 are shown in FIG. 11 as global signals, where the same voltage is supplied to each pixel cell 1205 throughout the entire pixel array or to transparent common electrode 1250 only in the case of $V_{ITO}$ 1270. Those of ordinary skill will note that, in order to reduce current spikes, global signals may be asserted over a finite period of time that is near simultaneous but not exactly simultaneous. In one example the period of time required to assert the global signal is approximately 80 nanoseconds. The voltage supply terminals may be operated according to one or more of the previously defined three operating modes as presented in FIG. 10. Those of ordinary skill in the art will recognize that the grouping of the components in FIG. 11 may be based on financial considerations as well as on engineering design considerations. They will also recognize that additional functions such as the control of light emitting diodes may be integrated into such as a device. Nothing in this description should be considered as limiting the scope of such external integration.

In one embodiment the display processor causes the light emitting diodes of FIG. 3 to operate according to a predetermined schedule.

The supply of voltages $V_0$ and $V_1$ is of great importance to the design of the pixels. In one embodiment both $V_0$ and $V_1$ are voltages independent of rail voltages $V_{DD}$ and $V_{SS}$. In another embodiment $V_1$ may be set to $V_{DD}$ and $V_0$ is independent of $V_{SS}$. In another embodiment $V_0$ may be set to $V_{SS}$ and $V_1$ is independent of $V_{DD}$. In another embodiment $V_0$ is set to $V_{SS}$ and $V_1$ is set to $V_{DD}$. In those instances where a pixel voltage is equal to a rail voltage, an independent supply line may be retained or the independent supply line may be eliminated. It is possible that one or both of $V_0$ and $V_1$ may fall outside the range between $V_{DD}$ and $V_{SS}$. In those instances great care must be taken to insure that those voltage supply lines are substantially isolated from the other circuits on the device and that the inverter is well designed.

Figure 12:
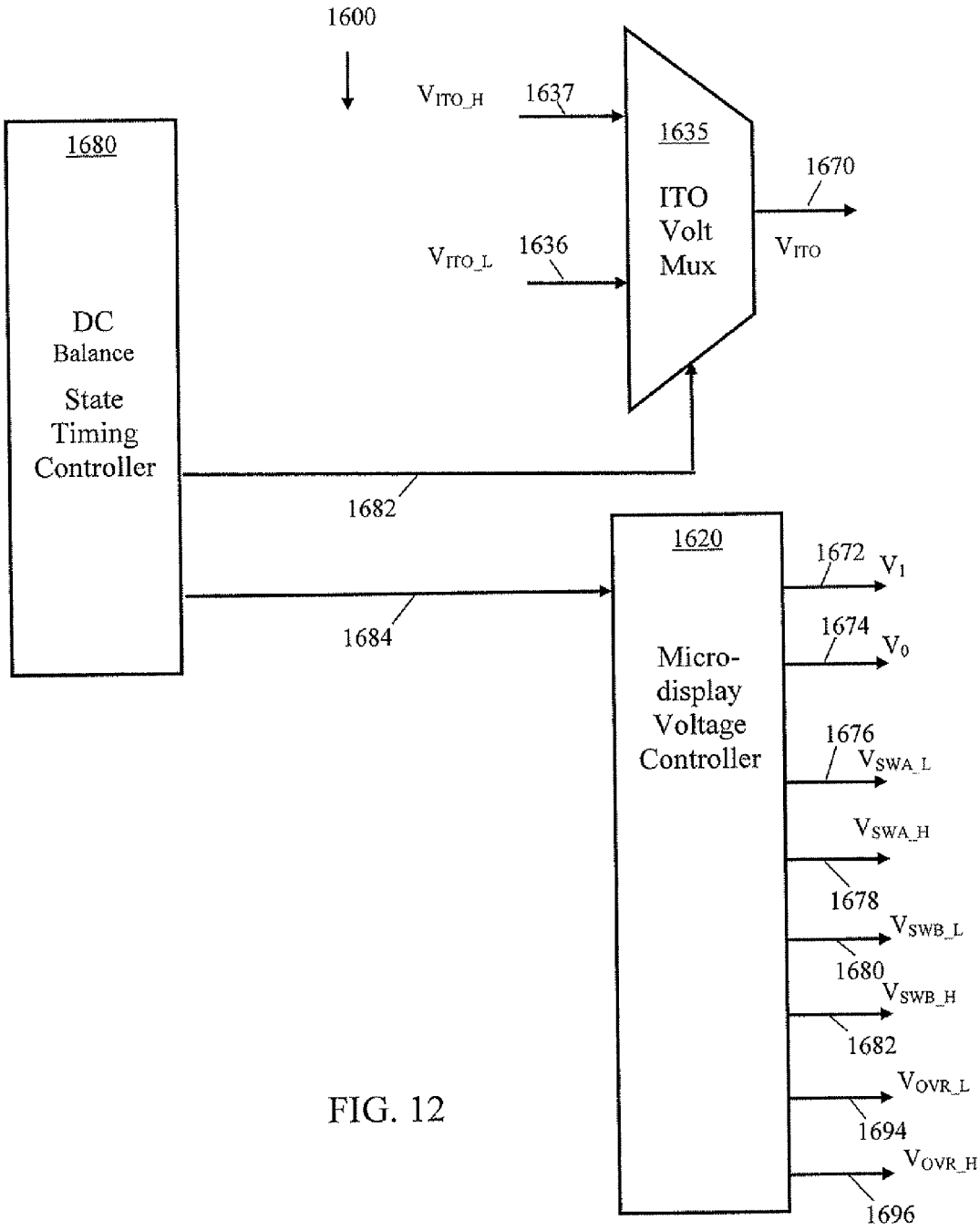
FIG. 12 is a diagram of an alternative implementation of a display controller for use with a multi pixel liquid crystal display in accordance with the present invention.

FIG. 12 shows an alternative embodiment 1600 for control of the ITO voltage multiplexer. In ITO voltage controller 1600 the DC balance timing controller 1680 controls ITO voltage multiplexer 1635 via the control line 1682. In like manner the timing of state changes of $V_{SWA_L}$ 1676, $V_{SWA_H}$ 1678, $V_{SWB_L}$ 1680, $V_{SWB_H}$ 1682, $V_{OVR_L}$ 1694 and $V_{OVR_H}$ 1696 are controlled by control line 1684. Through exercise of control in this manner, minor differences in the timing of changes to VITO and selection between $V_0$ and $V_1$ are enabled. This may be beneficial because the transparent common electrode has a surface area in the range of 50 to 100 square millimeters whereas the surface area of each pixel electrode is in the range of 0.001 square millimeters. The states of the DC balancing in response to the state changes of $V_{SWA_L}$ 1676, $V_{SWA_H}$ 1678, $V_{SWB_L}$ 1680, $V_{SWB_H}$ 1682, $V_{OVR_L}$ 1694 and $V_{OVR_H}$ 1696 by the control line 1684 and in response to changes of VITO in response to control line 1682 are shown in the table of FIG. 10.

Figure 13A:
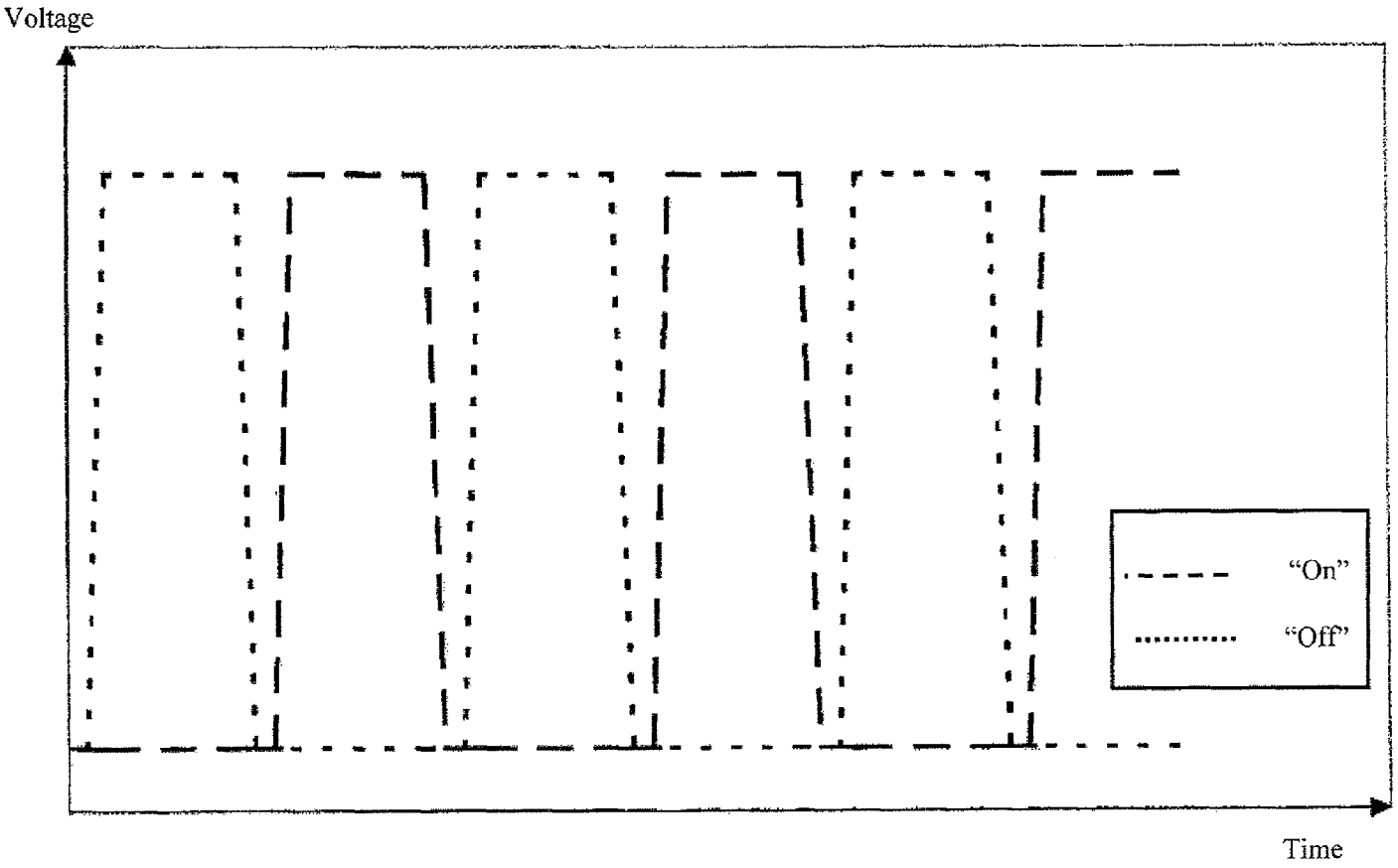
FIG. 13A depicts the timing of voltages in a break-before-make sequence for a four-transistor DC balance control switch.
Figure 13B:
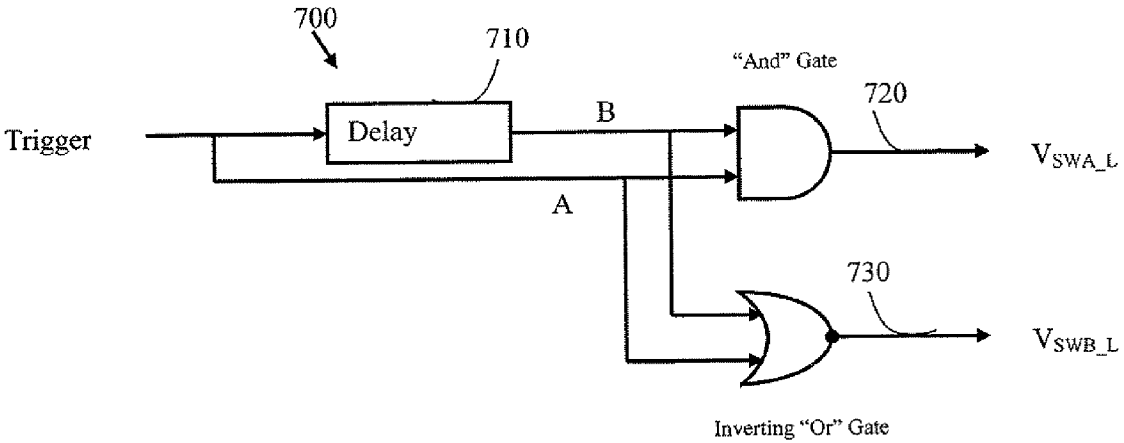
FIG. 13B depicts a break-before-make circuit for a first two voltage control (logic) signals for a four-transistor DC balance control switch.
Figure 13C:
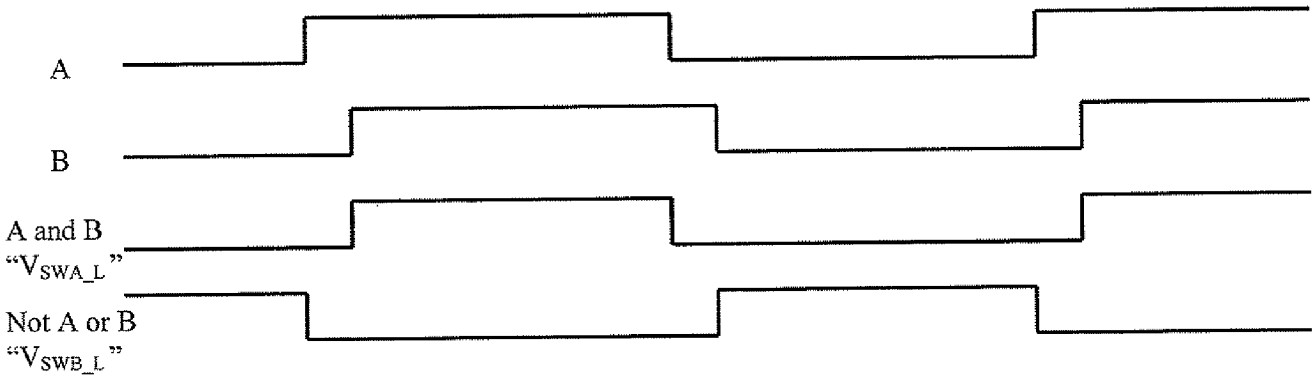
FIG. 13C depicts the timing of a first two voltage control (logic) signals for a break-before-make circuit for a four-transistor DC balance control switch.

There is a restriction that must be followed by the logic controller 1220 to assure that controlling voltages $V_{SWA_L}$ and $V_{SWB_L}$ cannot be high at the same time and that controlling voltages $V_{SWA_H}$ and $V_{SWB_H}$ cannot be low at the same time. Therefore, the circuit must be driven by a logic circuit to assure a time sequence to achieve "break before make" as that shown in FIG. 13A where two different kinds of dotted lines voltage-timing diagram represent the high and low state of two controlling voltages $V_{SWA_L}$ and $V_{SWB_L}$. A similar relationship exists between the high and low state of two controlling voltage $V_{SWA_H}$ and $V_{SWB_H}$. In order to achieve this break before make voltage sequences, a timing control circuit 700 is implemented as that shown in FIG. 13B that comprises a delay element 310 connected to an AND gate 720 for outputting the voltage $V_{SWA_L}$ and an inverting OR gate 730 for outputting the voltage $V_{SWB_L}$. As shown in FIG. 13C, the output B is delayed by the delay element 710 and the AND gate and the inverting OR gate generate two output voltages A-AND-B and NOT-A-OR-B as $V_{SWA_L}$ and $V_{SWB_L}$ respectively that have a break-before-make timing relationship.

Figure 13D:
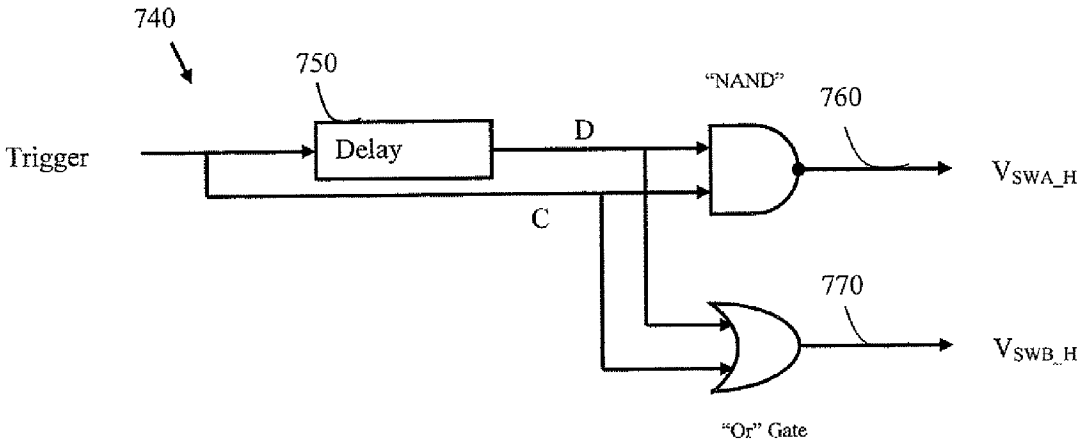
FIG. 13D depicts a break-before-make circuit for a second two voltage control (logic) signals for a four-transistor DC balance control switch.
Figure 13E:
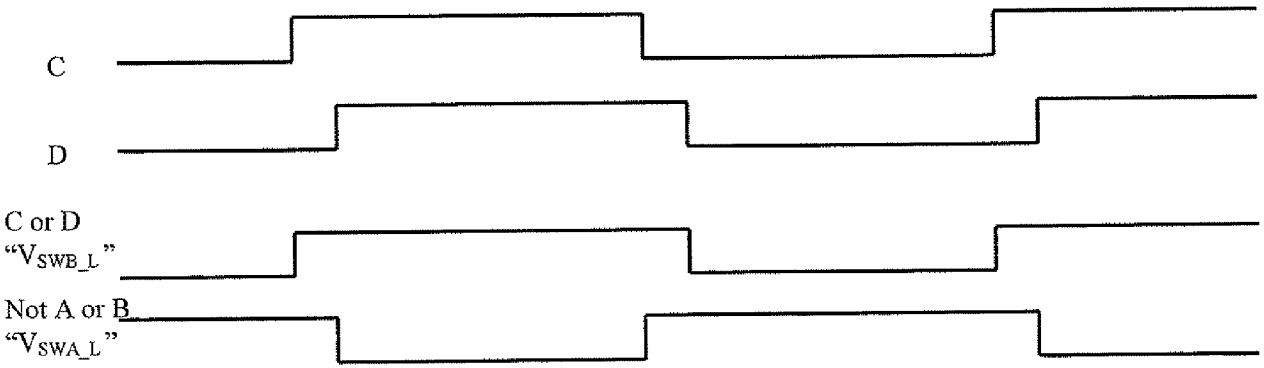
FIG. 13E depicts the timing of a second two voltage control (logic) signals for a break-before-make circuit for a four transistor DC balance control switch.

FIG. 13D presents a break-before-make implementation 740 for the p-channel transistors that provides the voltages presented in FIG. 13E. As shown in FIG. 13E the output D is delayed by delay element 750 and the NAND gate and the OR gate generate two output voltages NOT-C-AND-D and C-OR-D that have a break-before-make timing relationship.

Figure 13F:
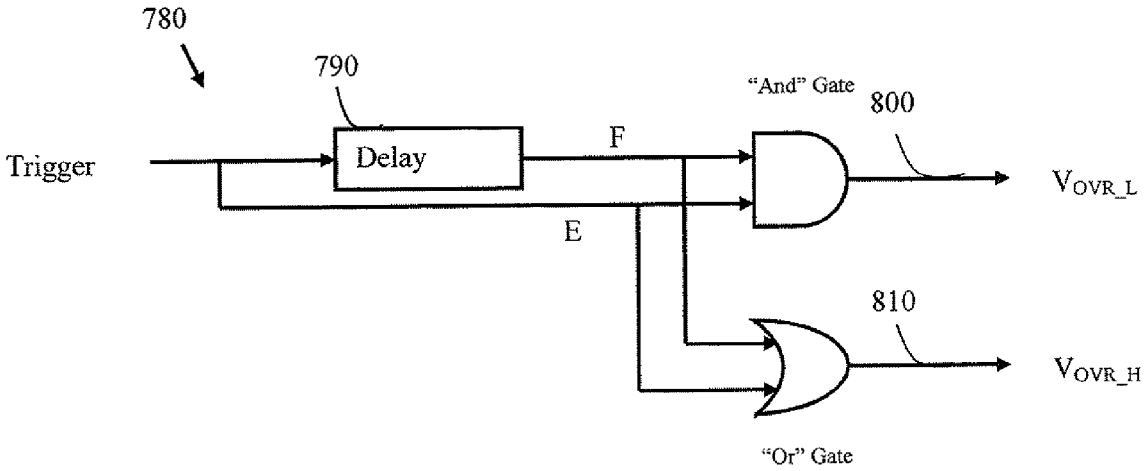
FIG. 13F a circuit for two voltage control (logic) signals for a two-transistor pixel voltage override circuit.
Figure 13G:
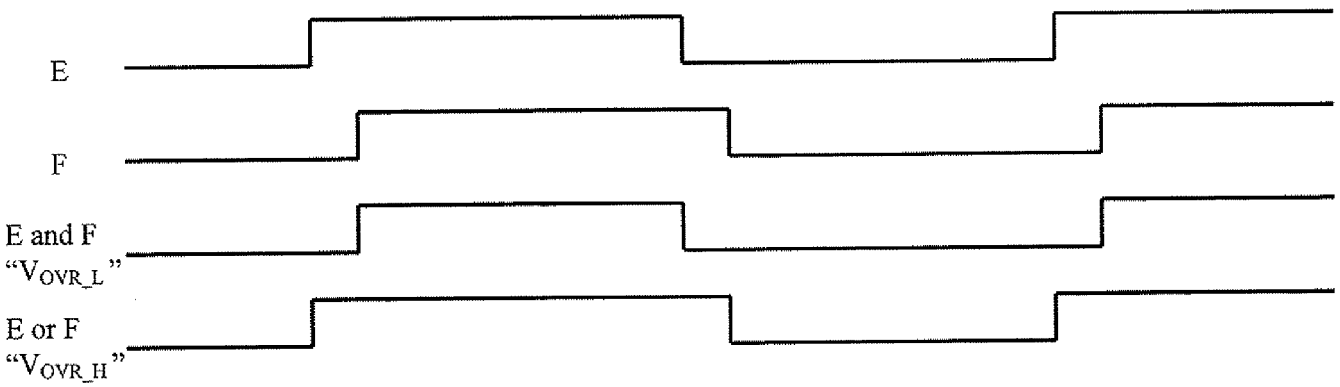
FIG. 13G depicts the timing of two voltage control (logic) signals for a circuit for a two-transistor pixel voltage override circuit.

There is a restriction on the operation of pixel voltage override circuit 1360 that $V_{OVR_H}$ not switch to 0 when $V_{OVR_L}$=1 and that $V_{OVR_L}$ not switch to 1 when $V_{OVR_H}$=0. This state causes a direct short from $V_{DD}$ to $V_{SS}$ with associated high current flow. FIG. 13F presents a break-before-make implementation 780 for pixel voltage override circuit 1360 that provides the voltages presented in FIG. 13G. As shown in FIG. 13E the output F is delayed by delay element 790 and the AND gate and the OR gate generate two output voltages C-AND-D and C-OR-D that have a break-before-make timing relationship that satisfies the condition previously stated. The inclusion of this circuit is not mandatory for implementation of the design. Alternatively the display controller may operate pixel override circuit 1360 in such a manner that the hazard condition does not occur.

Figure 13H:
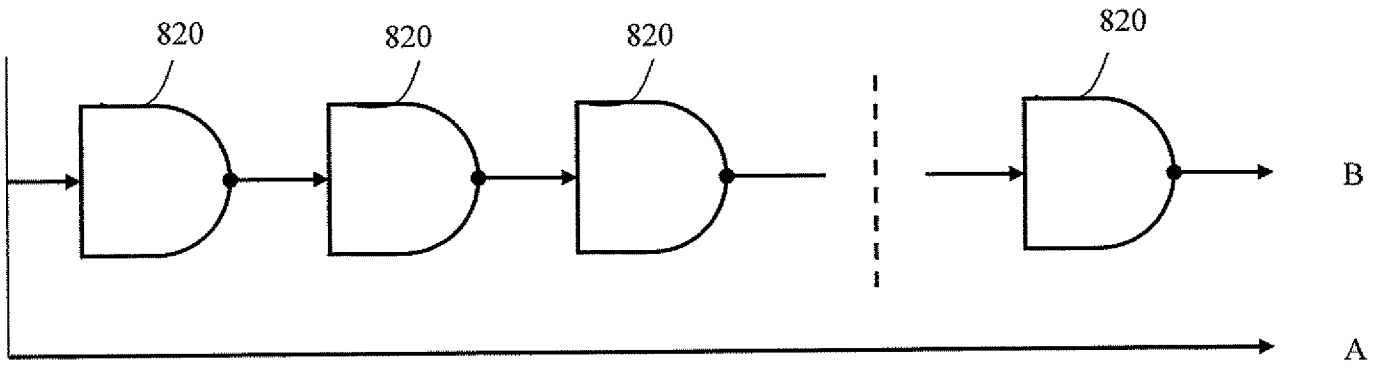
FIG. 13H to 13J depict the circuit implementations of the delay elements by employing inverters and flip-flop circuits and combinations of both circuits respectively.
Figure 13I:
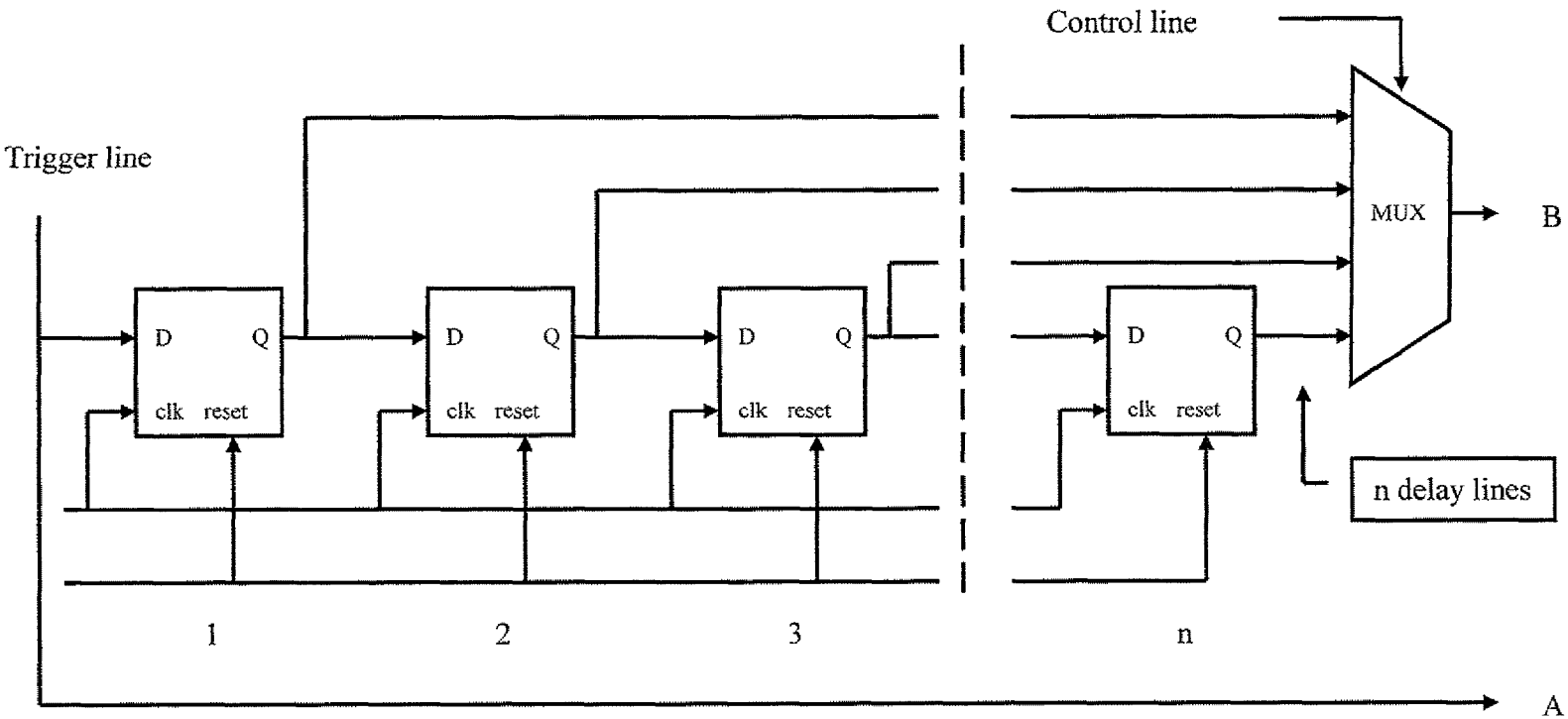
Figure 13J:
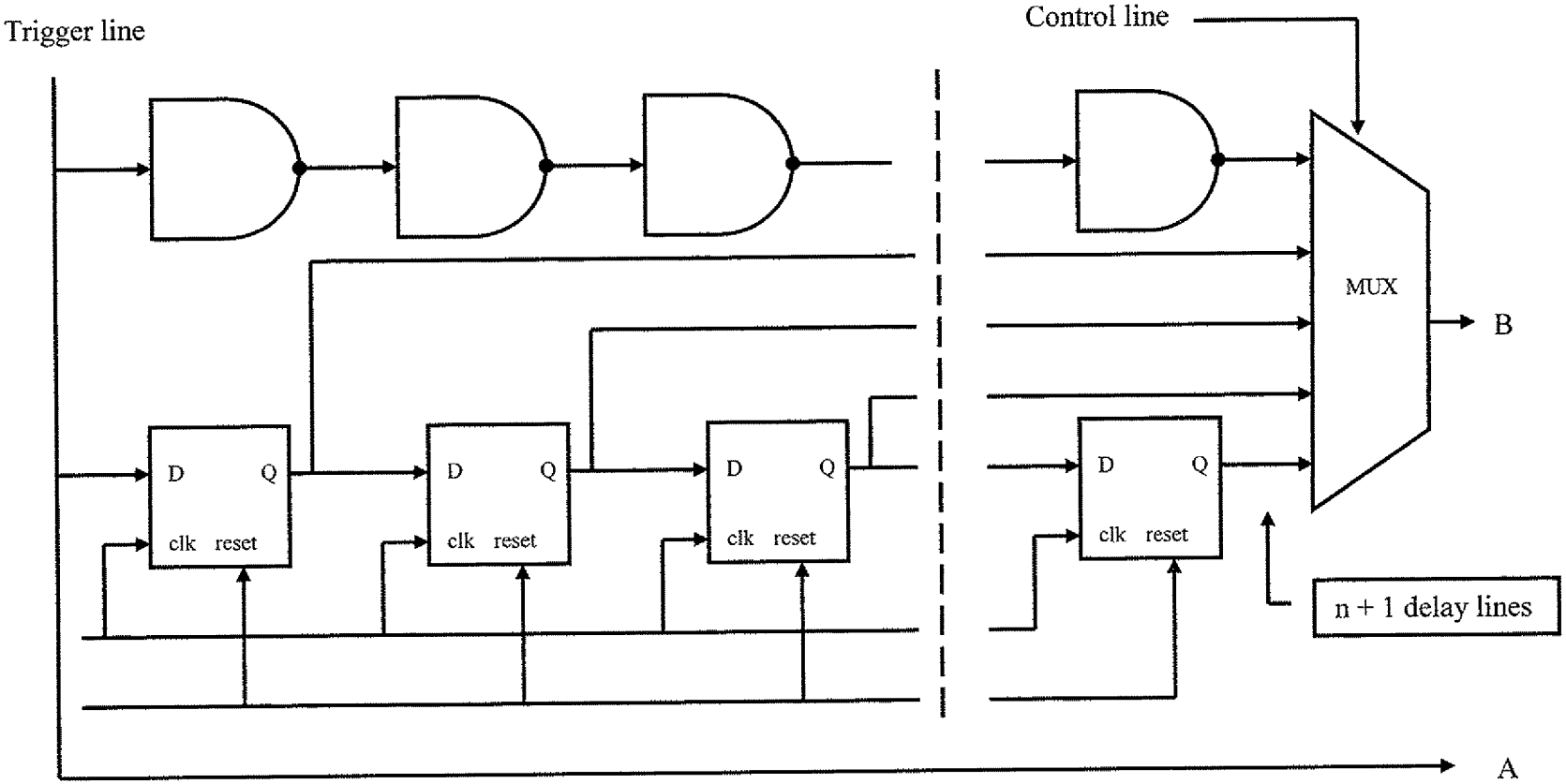

In order to implement delay elements 710, 750 and 790, FIG. 13H shows one preferred embodiment by using delay-timing circuit where the delay is created by successive execution delay of a series of inverters. The delay resulted from the execution operation of the inverter 820 is of fixed delay duration not tied to clock cycles. To assure that the output of the circuit along the time line B' has the same polarity as the input signal, the number of inverters must be even. This type of time delay circuits may be used at startup to assure that the chip does not enter into a latch-up or other hazard condition during the initialization stage as the system clock first starts to run. The delay time line is marked as B' and the non-delay time line is marked as A'. In FIG. 13I, anther delay element with selectable delay is illustrated. The flip-flop circuits are "D" type device. This relieves the requirement to have an even number of devices. The output of each flip-flop (except the last) feeds another flip-flop that adds further delay. Additional each output is tapped and fed into a multiplex selector circuit that enables the system to be configured to permit selectable delay. The number of flip-flops required can be determined during design by skew analysis and during operation through a trial and error or analysis or a combination thereof. The period of the clock, for example, might be set to be near the value of the break cycle off time to minimize the number of flip-flops. Other combinations are possible. FIG. 13I shows one preferred embodiment with n flip-flops here. The output of the delay line is B". The non-delayed parallel signal is A". FIG. 13J shows another embodiment of the delay element by combining two types of delay circuits as shown in FIGS. 13H and 13I. The inverter chain may be used to establish delay during the power up phase when clocks are unsettled. After that the system can switch to the appropriate flip-flop circuit tap. This substantially reduces the startup hazard by reducing the likelihood of the risk that a latch-up occurs during chip initialization. The number of flip-flops and the number of inverters need not be equal. The number of each will be determined by the timing delay required. Each chain can receive the same input—the selection between one and the other is done in the multiplexer. Again, time-line B"' is for the delayed signal and time line A"' is for the non-delayed signal.

Figure 14:
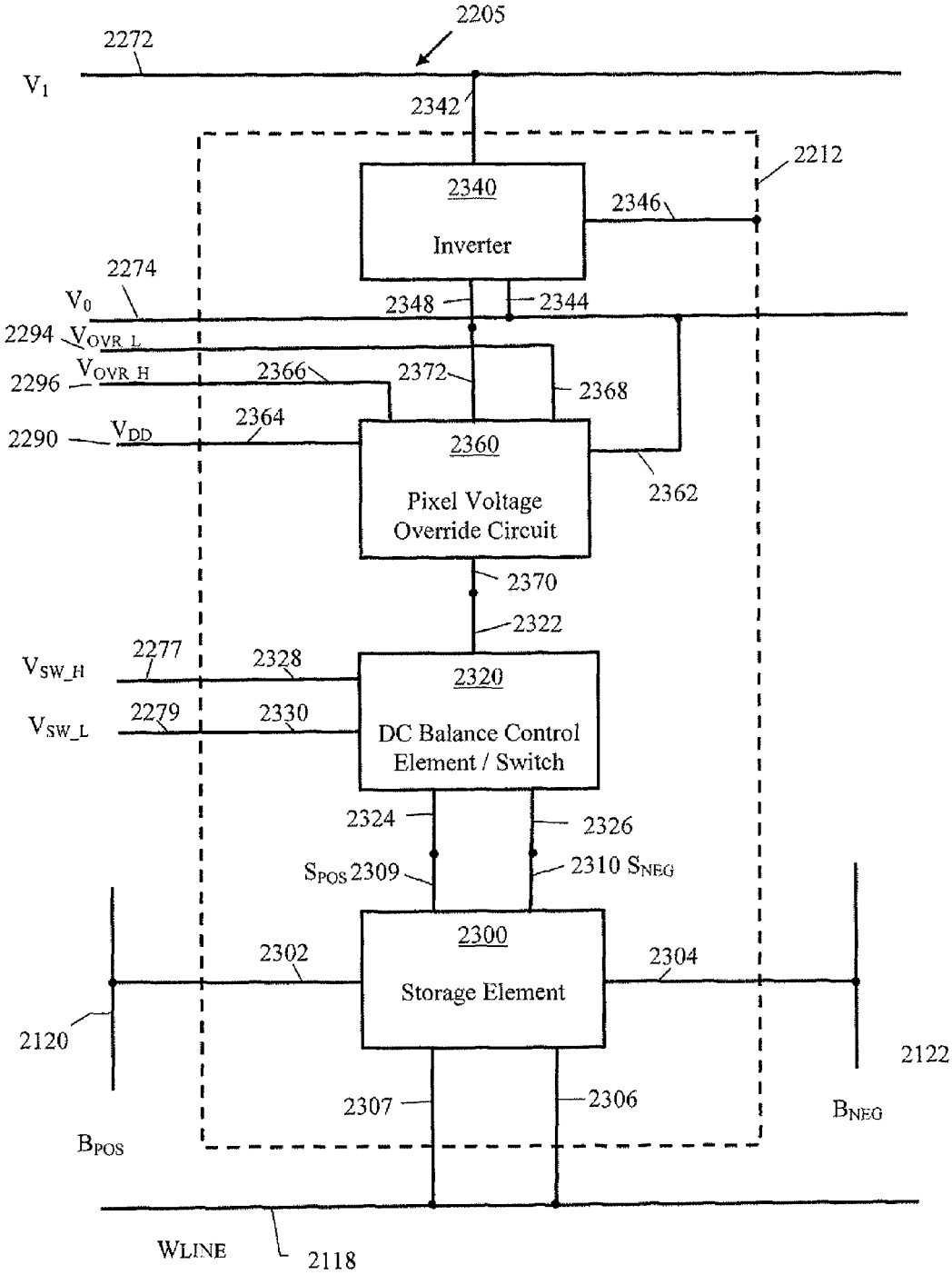
FIG. 14 is a block diagram for showing an independent control and buffering of a binary bit for driving a single pixel.

FIG. 14 shows a block diagram of a single pixel cell 2205 of a display in accordance with the present invention. The pixel cell 2205 comprises storage element 2300, DC balance control switch 2320, pixel voltage override circuit 2360 and inverter 2340. The DC balance control switch 2320 is preferably a CMOS based logic device that can selectively pass to another device one of several input voltages. The storage element 2300 comprises complementary input terminals 2302 and 2304, respectively coupled to data lines ($B_{POS}$) 2120 and ($B_{NEG}$) 2122. The storage element also comprises complementary enable terminals 2306 and 2307 coupled to word line ($W_{LINE}$) 2118, and a pair of complementary data output terminals ($S_{POS}$) 2308, and ($S_{NEG}$) 2310. In the present embodiment, storage element 2300 is an SRAM latch, but those skilled in the art will understand that any storage element capable of receiving a data bit, storing the bit, and asserting the complementary states of the stored bit on complementary output terminals may be substituted for the SRAM latch storage element 2300 described herein.

DC balance control switch 2320 comprises a pair of complementary data input terminal 2324 and 2326 which are coupled respectively to data output terminals ($S_{POS}$) 2308 and ($S_{NEG}$) 2310 of storage element 2300. DC balance control switch 2320 also comprises a first voltage supply terminal 2328, and a second voltage supply terminal 2330, which are coupled respectively to the third voltage supply terminal ($V_{SW_H}$) 2277, and the fourth voltage supply terminal ($V_{SW_L}$) 2279 of voltage control switch 2320. DC balance control switch 2320 further comprises a data output terminal 2322.

Pixel voltage override circuit 2360 comprises a data input terminal 2370 that is coupled to data output terminal 2322 of DC balance control switch 2320. Pixel voltage override circuit further comprises a first voltage supply terminal 2362 that is coupled to global voltage supply $V_{SS}$ 2292, a second voltage supply terminal 2364 that is coupled to global voltage supply $V_{DD}$ 2290, a third voltage supply terminal 2366 that is coupled to voltage (logic) supply $V_{OVR_H}$ 2296 a fourth voltage supply terminal 2368 that is coupled to voltage (logic) supply $V_{OVR_L}$ 2294 and a voltage (logic) output terminal 2372 that is coupled to input voltage supply terminal 2348 of inverter 2340.

Figure 19:
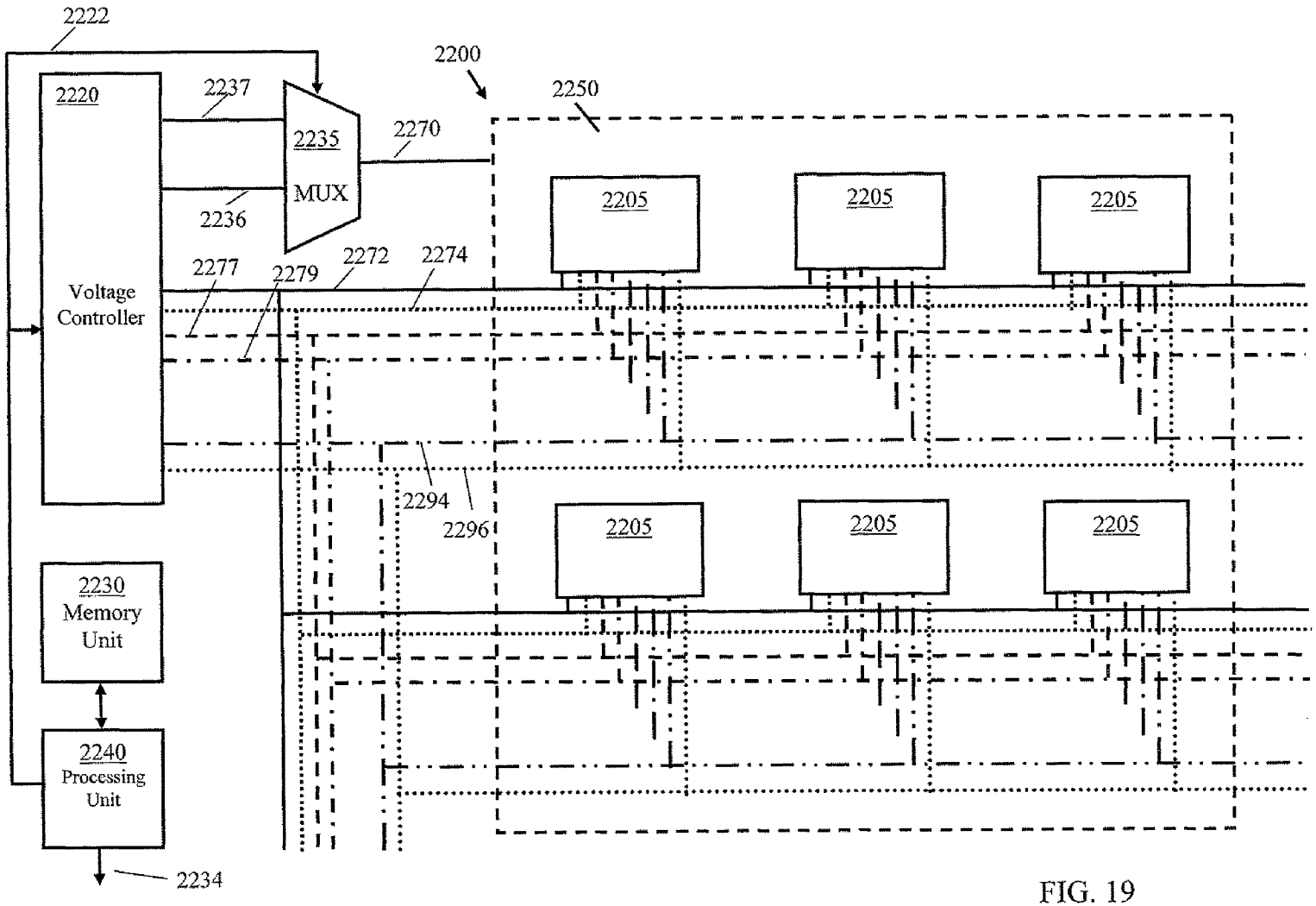
FIG. 19 is a diagram of a multi pixel liquid crystal array in accordance with the present invention.

Inverter 2340 comprises a first voltage supply terminal 2342, and a second voltage supply terminal 2344, which are coupled respectively to a first voltage supply terminal ($V_1$) 2272, and a second voltage supply terminal ($V_0$) 2274 of the voltage controller 2220 (referring to FIG. 19). The inverter 2340 also comprises a data input terminal 2348 coupled to data output terminal 2372 of pixel voltage override circuit 2360, and a pixel voltage output terminal ($V_{PIX}$) 2346 coupled to the pixel mirror 2212. The function of the inverter and voltage application circuit is to insure that the correct voltage between $V_0$ and $V_1$ is delivered to the pixel mirror.

Figure 15:
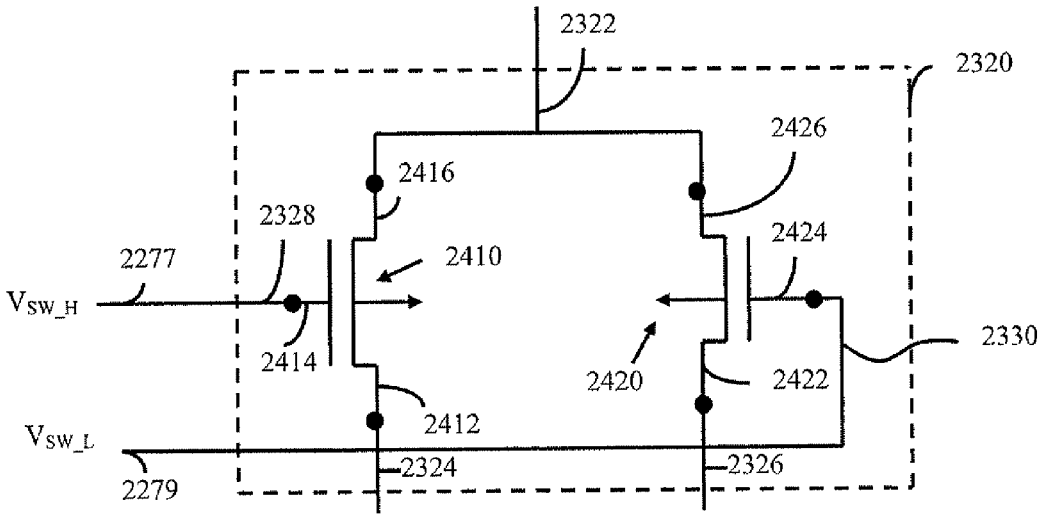
FIG. 15 is a schematic diagram of a preferred DC balance control switch implemented in FIG. 14 in accordance with the present invention.

FIG. 15 shows a schematic of a preferred embodiment of DC balance control switch 2320. DC balance control switch 2320 comprises a first p-channel CMOS transistor 2410 and a second p-channel CMOS transistor 2420. The first transistor 2410 comprises source terminal 2412 coupled to data input terminal 2324, gate terminal 2414 coupled to a first voltage supply terminal 2328, and a drain terminal 2416 coupled to data output terminal 2322. The second transistor 2420 comprises a source terminal 2422 coupled to input terminal 2326, a gate terminal 2424 coupled to the second voltage supply terminal 2330, and a drain terminal 2426 coupled to the data output terminal 2322.

Figure 16:
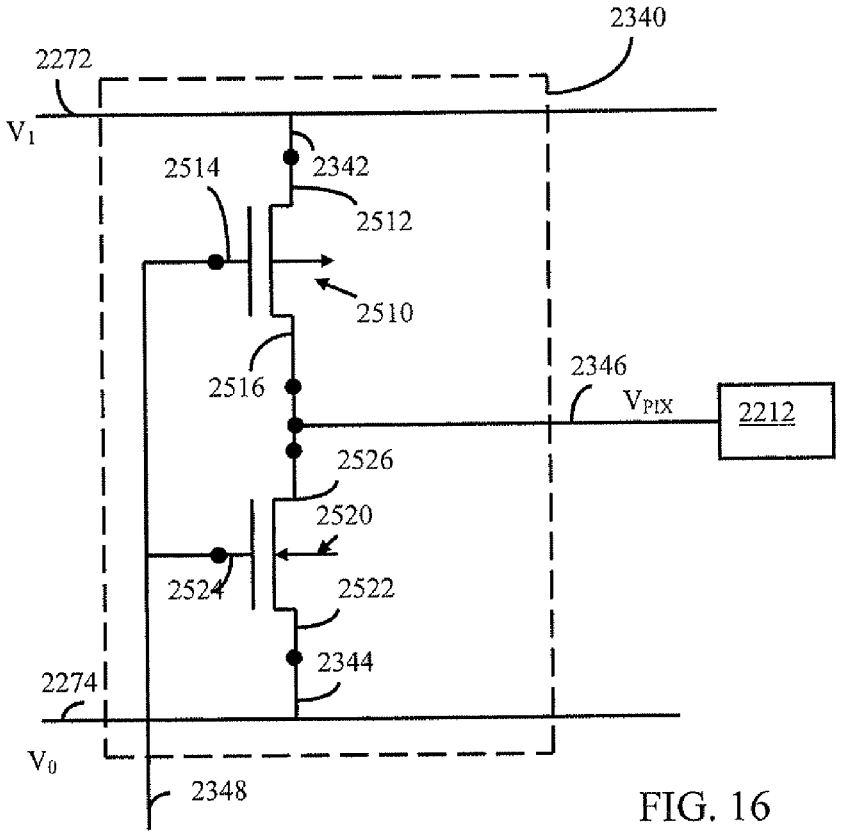
FIG. 16 is a schematic diagram of a preferred buffering and voltage application circuit implemented in FIG. 14 in accordance with the present invention.

FIG. 16 shows a schematic of a preferred embodiment of inverter 2340. The inverter 3240 comprises p-channel CMOS transistor 510 and n-channel transistor 2520. P-channel transistor 2510 comprises source terminal 512 connected to a first voltage supply terminal 2342, gate terminal 2514 coupled to the data input terminal 2348, and a drain terminal 2516 coupled to pixel voltage output terminal ($V_{PIX}$) 2346. N-channel transistor 2520 comprises a source terminal 2522 coupled to the second voltage supply terminal 2344, a gate terminal 2524 coupled to data input terminal 2348, and drain terminal 2526 coupled to pixel voltage output terminal ($V_{PIX}$) 2346.

Figure 17:
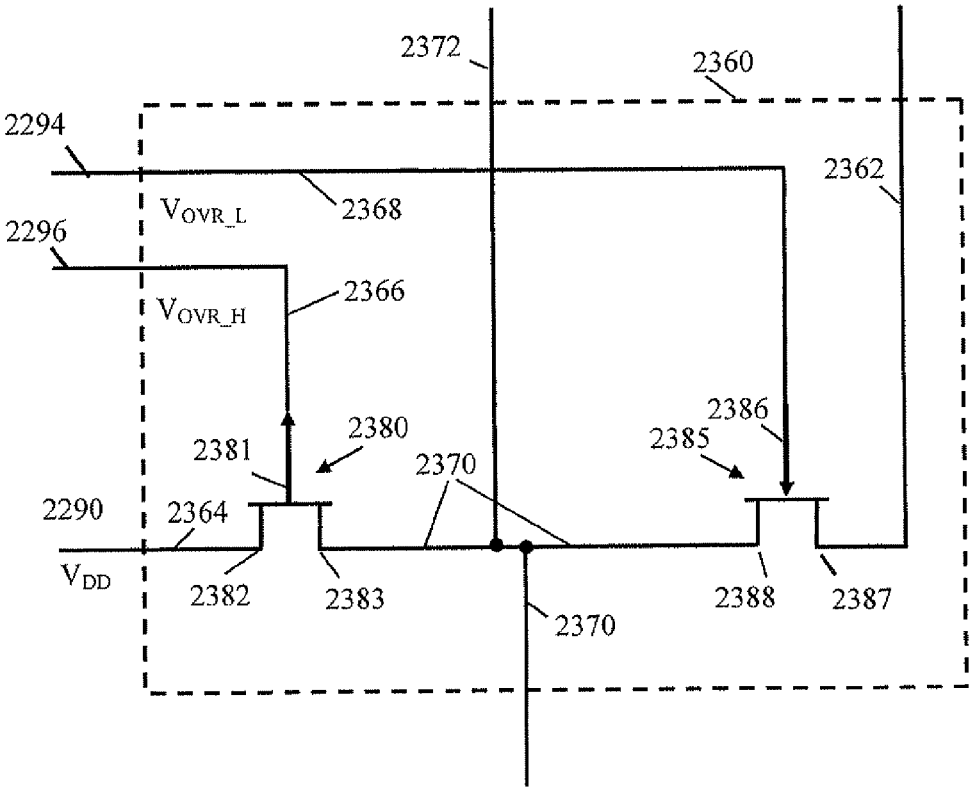
FIG. 17 is a schematic of a preferred pixel voltage override circuit implemented in FIG. 14 in accordance with the present invention.

FIG. 17 is a schematic of a preferred embodiment of pixel voltage override circuit 2360. Pixel voltage override circuit 2360 comprises a first p-channel MOSFET transistor 2380 and a first n-channel MOSFET transistor 2385 with drains 2383 and 2388 coupled to output terminal 2372. Input terminal 2370 is directly connected to output terminal 2372. $V_{DD}$ terminal 2290 is coupled to input terminal 2364 and $V_0$ 2274 (referring to FIG. 19) is coupled to input terminal 2362. It is necessary to use $V_0$ and not $V_{SS}$ because of circuit effects in DC balance control switch 2320 previously noted experimentally. Input terminal 2364 is coupled to source terminal 2382 of MOSFET transistor 2380 and input terminal 2362 is coupled to source terminal 2387 of MOSFET transistor 2385. Voltage supply terminal 2294 is coupled to voltage override signal low terminal $V_{OVR_L}$ 2368 and Voltage supply terminal 2296 is coupled to voltage override signal high terminal $V_{OVR_H}$ 2366. Terminal $V_{OVR_L}$ 2368 is coupled to gate 2386 of MOSFET transistor 2385 and terminal $V_{OVR_H}$ 2366 is coupled to gate 2381 of MOSFET transistor 2380.

Figure 18:
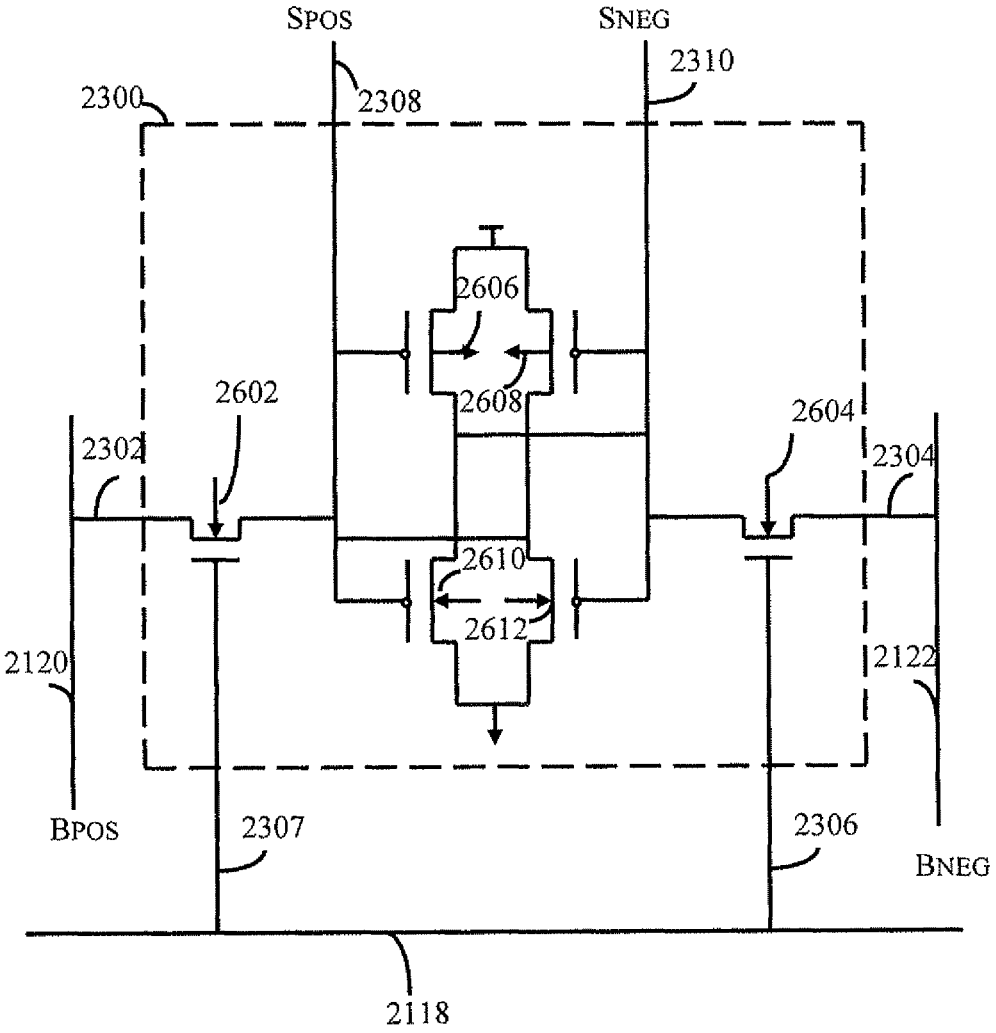
FIG. 18 is a schematic of a preferred storage element implemented in FIG. 14 in accordance with the present invention.

FIG. 18 shows a preferred embodiment of storage element 2300. Storage element 2300 is preferably a CMOS static ram (SRAM) latch device. Such devices are well known in the art. See DeWitt U. Ong, Modern MOS Technology, Processes, Devices, & Design, 1984, Chapter 9-5, the details of which are hereby fully incorporated by reference into the present application. A static RAM is one in which the data is retained as long as power is applied, though no clocks are running FIG. 16 shows the most common implementation of an SRAM cell in which six transistors are used. Transistors 2602, 2604, 2610, and 2612 are n-channel transistors, while transistors 606, and 608 are p-channel transistors. In this particular cell, word line 118 turns on pass transistors 602 and 604, allowing the ($B_{POS}$) 2120 and ($B_{NEG}$) 2122 lines to remain at a pre-charged high state or be discharged to a low state by the flip flop (i.e., transistors 2606, 2608, 2610, and 2612). Differential sensing of the state of the flip-flop is then possible. In writing data into the selected cell, ($B_{POS}$) 2120 and ($B_{NEG}$) 2122 are forced high or low by additional write circuitry. The side that goes to a low value is the one most effective in causing the flip-flop to change state.

The six-transistor SRAM cell is desired in CMOS type design and manufacturing since it involves the least amount of detailed circuit design and process knowledge and is the safest with respect to noise and other effects that may be hard to estimate before silicon is available. In addition, current processes are dense enough to allow large static RAM arrays. These types of storage elements are therefore desirable in the design and manufacture of liquid crystal on silicon display devices as described herein. However, other types of static RAM cells are contemplated by the present invention, such as a four transistor RAM cell using a NOR gate, as well as using dynamic RAM cells rather than static RAM cells.

As configured, the switch 2320, being responsive to a predetermined voltage on a first logic voltage supply terminal ($V_{SW_H}$) 2277, and a predetermined voltage on a second logic voltage supply terminal ($V_{SW_L}$) 2279, can selectively direct either one of the high or low data values that are stored in the storage element 2300, through the output terminal 2322 of the switch 2320 and into the input terminal 2348 of the inverter 2340.

In their most simplified form, transistors are nothing more than an on/off switch. In a CMOS type design, the gate of the transistor controls the passage of current between the source and the drain. In an n-channel transistor, the switch is closed or "on" if the drain and the source are connected. This occurs when there is a high value, or a digital "1" on the gate. The switch is open or "off" if the drain and the source are disconnected. This occurs when there is a low value, or a digital "0" on the gate. In a p-channel transistor, the switch is closed or "on" when there is a low value, or a digital "0", on the gate. The switch is open or "off" when there is a high value, or digital "1" on the gate. The p-channel and n-channel transistors are therefore "on" and "off" for complementary values of the gate signal.

FIG. 19 shows a display system 2200 in accordance with the present invention. The display system 2200 comprises an array of pixel cells 2205, a voltage controller 2220, a processing unit 2240, a memory unit 2230, and a transparent common electrode 2250. The common transparent electrode overlays the entire array of pixel cells 2205. In a preferred embodiment, pixel cells 2205 are formed on a silicon substrate or base material, and are overlaid with an array of pixel mirrors 2212 and each single pixel mirror 2212 corresponding to each of the pixel cells 2205. A substantially uniform layer of liquid crystal material is located in between the array of pixel mirrors 2212 and the transparent common electrode 2250. The transparent common electrode 2250 is preferably formed from a conductive glass material such as Indium Tin-Oxide (ITO). The memory 2230 is a computer readable medium including programmed data and commands. The memory is capable of enabling processing unit 2240 to implement various voltage modulation and other control schemes. Processing unit 2240 receives data and commands from memory unit 2230, via a memory bus 2232, provides internal voltage control signals, via voltage control bus 2222, to voltage controller 2220, and provides data control signals (i.e. image data into the pixel array) via data control bus 2234. Voltage controller 2220, memory unit 2230, and processing unit 2240 are preferably located on a different portion of the display system away from pixel cells 2205.

Responsive to control signals received from processing unit 2240, via voltage control bus 2222, voltage controller 2220 provides predetermined voltages to each of the pixel cells 2205 via a first voltage supply terminal ($V_1$) 2272, a second voltage supply terminal ($V_0$) 2274, a third (logic) voltage supply terminal ($V_{SW_H}$) 2277, a fourth (logic) voltage supply terminal ($V_{SW_L}$) 2279, a fifth (logic) voltage supply terminal ($V_{OVR_L}$) 2294 and a sixth (logic) voltage supply terminal ($V_{OVR_H}$) 2296. Voltage controller 2220 also supplies predetermined voltages $V_{ITO_L}$ by voltage supply terminal 2236 and $V_{ITO_H}$ by voltage supply terminal 2237 to ITO voltage multiplexer unit 2235. Voltage multiplexer unit 2235 selects between $V_{ITO_L}$ and $V_{ITO_H}$ based on the logic state of DC balance commands from processing unit 2220 . The ITO voltage multiplexer unit 2235 delivers $V_{ITO}$ 2270 to the transparent common electrode 2250, via a voltage supply terminal ($V_{ITO}$) 2270. Each voltage supply terminal ($V_1$) 2272, ($V_0$) 2274, ($V_{SW_H}$) 2277, ($V_{SW_L}$) 2279, ($V_{OVR_L}$) 2294 ($V_{OVR_H}$), 2296 and ($V_{ITO}$) 2270 is shown in FIG. 14 as being a global signal, where the same voltage is supplied to each pixel cell 2205 throughout the entire pixel array or to the transparent common electrode 2250 only in the case of $V_{ITO}$ 2270.

In one embodiment the display processor causes the light emitting diodes of FIG. 3 to operate according to a predetermined schedule.

The supply of voltages $V_0$ and $V_1$ is of great importance to the design of the pixels. In one embodiment both $V_0$ and $V_1$ are voltages independent of rail voltages $V_{DD}$ and $V_{SS}$ with the stated restriction that $V_0$ be separated from $V_{SS}$ by some level. In another embodiment $V_1$ may be set to $V_{DD}$ and $V_0$ remains independent of $V_{SS}$. In those instances where $V_1$ is equal to $V_{DD}$ an independent supply line may be retained or the independent supply line may be eliminated. It is possible that $V_1$ be set outside the range between the rail voltages of the pixel cell circuit. In those instances great care must be taken to insure that $V_1$ supply lines are substantially isolated from the other circuits on the device and that the inverter is well designed.

Figure 20:
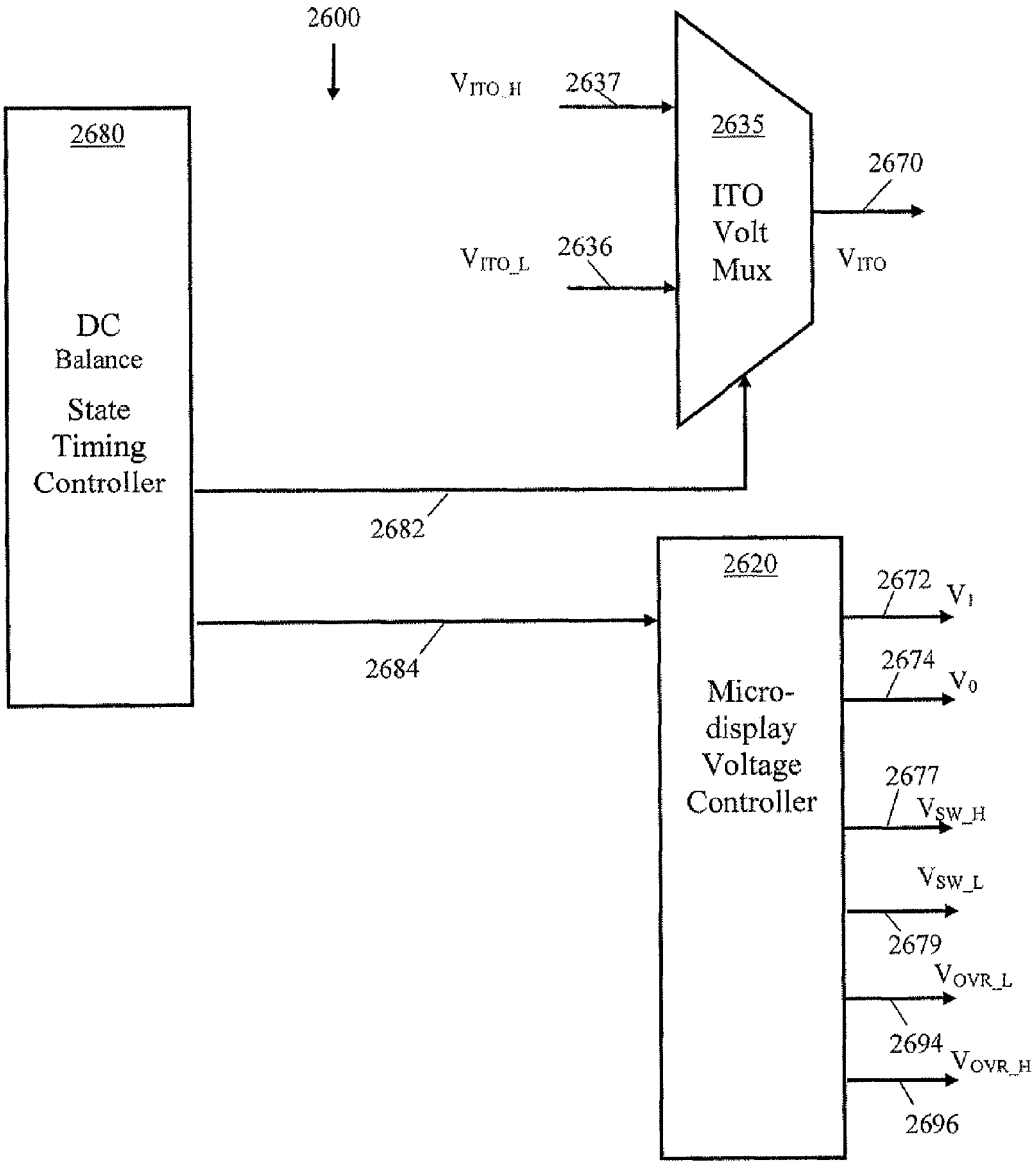
FIG. 20 shows an alternative embodiment of the control of the ITO voltage multiplexer.

FIG. 20 shows an alternative embodiment for control of the ITO voltage multiplexer. In FIG. 20 DC balance timing controller 2680 controls ITO voltage multiplexer 2635 via the control line 2682. ITO Voltage Multiplexer 2635 selects between $V_{ITO_L}$ 2636 and $V_{ITO_H}$ 2637. In like manner the timing of state changes of $V_{SW_H}$ 2677 and $V_{SW_L}$ 2679 are controlled by control line 2684. Through exercise of control in this manner, minor differences in the timing of changes to $V_{ITO}$ 2670 and selection between $V_0$ 2674 and $V_1$ 2672 are enabled. This may be necessary because the transparent common electrode has a surface area in the range of 50 to 100 square millimeters whereas the surface area of each pixel electrode is in the range of 0.001 square millimeters.

FIG. 21 depicts the outcomes of various operating states of the various control lines on the operation of the pixel. In a first mode of operation of pixel circuit 2205 pixel voltage override circuit 2360 receives signals from the DC balance control switch 2320 and is configured to an inactive state wherein the control voltage $V_{OVR_H}$ 2296 is configured to deliver a high voltage to p-channel transistor the control voltage and $V_{OVR_L}$ 2294 is configured to deliver a low voltage to n-channel transistor, thus shutting off both MOSFET transistors. The voltage applied to output terminal 2322 of DC balance control switch 2320 is applied to input terminal 2370 of pixel voltage override circuit 2360 that in turn is applied to output terminal 2372 of pixel override circuit 2360. Output terminal 2372 is in turn coupled to input terminal 2348 of inverter 2340 where the applied voltage acts to select one of $V_0$ 2274 and $V_1$ 2272 to be applied to the output terminal $V_{PIX}$ 2346 of the inverter to be asserted to pixel mirror 2212. The resulting states are described in Columns 1 through 4 of FIG. 21. This mode is also referred to as "Normal" mode.

In a second mode of operation of pixel circuit 2205 DC balance control switch 2320 $V_{SW_L}$ 2279, $V_{SW_H}$ 2277 are both set to the voltage corresponding to an "Off" state (high voltage). $V_{OVR_H}$ 2296 and $V_{OVR_L}$ 2294 are both set to the voltage corresponding to an "Off" state. In this state no voltage is asserted onto output terminal 2322 of DC balance control switch 2320 and therefore the circuit will hold at the last applied voltage until the charge decays. The line through input terminal 2370 and output terminal 2372 of pixel voltage override circuit 2360 is likewise charged to the last applied voltage, as is input terminal 2348 of inverter 2340. Until this voltage decays inverter 2348 will continue to assert either $V_0$ 2274 or $V_1$ 2272 onto output terminal $V_{PIX}$ 2346 for delivery to pixel mirror 2212. When operating in this mode 6T SRAM storage element 2300 may be rewritten without changing the output of the inverter. The mode may be terminated by activating a valid mode of DC balance control switch 2320 or by activating a valid mode of pixel voltage override circuit 2360. Because this mode is not driven it is not possible to conduct a DC balance operation during a single instance. A controller may be designed to coordinate these intervals and schedule consecutive or near-consecutive instances of this mode to occur in opposite DC balance states. This state is described in columns 5 and 6 of FIG. 21. This mode is referred to as "Isolate" mode.

In a third mode of operation of pixel circuit 2205, DC balance control switch 2320 $V_{SW_L}$ 2279, $V_{SW_H}$ 2277 are both set to the voltage corresponding to an Off state. One of $V_{OVR_H}$ 2296 and $V_{OVR_L}$ 2294 is set to the voltage corresponding to an Off state and the other is set to the voltage corresponding to an On state. The voltage asserted onto output terminal 2372 is one of approximately $V_{DD}$ 1290 or approximately $V_0$ 2274. Those skilled in the art will recognize that the voltage delivered over output terminal 2372 to input terminal 2348 of inverter 2340 will vary slightly from $V_{DD}$ or $V_0$ because of the secondary effects of the realization of the circuits. This slight difference is not important because inverter 2340 uses these voltages to select between $V_0$ and $V_1$. A circuit designer of ordinary skill will understand this and have the skill to implement an inverter circuit with the required tolerances. The display may be driven alternately between the states described in columns 8 and 9 of FIG. 21 in time intervals of equal duration with the result that the display will remain DC balanced as is preferred for liquid crystal operation. This mode of operation is referred to as "Override" mode.

In a first defective state of operation of pixel circuit 2205, the operation of DC balance control switch 2320 places the pixel circuit in a state wherein the contents of storage element 1300 may be reset. The inventors have proven experimentally that placing that state of $V_{SW_L}$="On" (low voltage) while at the same time placing $V_{SW_H}$="On" (low voltage) will result in connecting the output of $S_{POS}$ 2309 to its complement $S_{NEG}$ 2310 and thereby reset storage element 1300. This condition is avoided switching both elements at the same time and by restricting the range of voltage to which $V_0$ can be set to be above a threshold voltage approximately 1.2 volts above $V_{SS}$. This defective state is described in column 7 of FIG. 21.

In a second defective state of operation of pixel circuit 2205, the operation of pixel voltage control circuit 2360 may connect $V_{DD}$ directly to $V_0$ with a predictable and substantial increase in current flow that may result in component overheating and ultimately in latch-up. The defective condition exists when $V_{OVR_H}$ 2294 applied to gate 2381 of p-channel MOSFET 2280 is set to a low voltage thus applying $V_{DD}$ onto output terminal 2370 and $V_{OVR_L}$ 2296 asserted to gate 2386 of n-channel MOSFET 2385 is set to a high voltage thus applying $V_0$ onto output terminal 2370 with a resultant short condition. Therefore it is a necessary part of this invention that the condition where both transistors are "On" be avoided. This defective state is described in column 10 of FIG. 21. A method for avoiding this condition is taught in FIGS. 13G, 13H, 13I and 13J and associated text.

Figure 22:
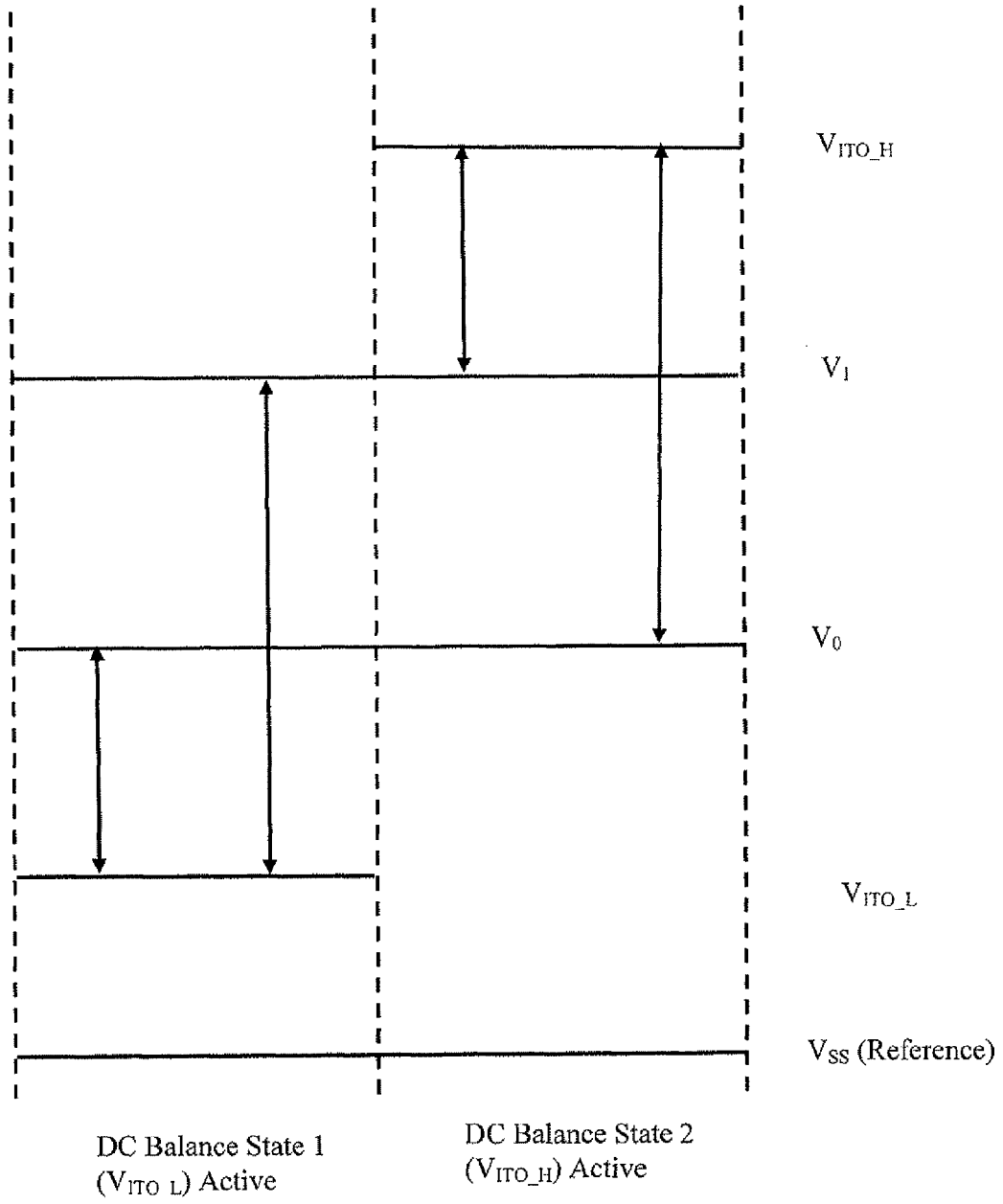

FIG. 22 shows a relative scale of voltages generated by the voltage controller starting from $V_{SS}$ as a reference voltage that is then followed by $V_{ITO_H}$, $V_0$, $V_1$, and $V_{ITO_L}$. Using circuits similar to that shown in FIG. 19, the voltage levels shown in FIG. 22 can be generated. For this example a liquid crystal normally white mode with voltage performance similar to that described in FIG. 4 is assumed for discussion. Those of ordinary experience in the art will recognize that a normally black liquid crystal mode could be operated in a similar manner with the sole difference being that dark states would be associated with low voltage differences between the voltage on the common plane ($V_{ITO}$) and the drive voltage applied to the pixel and that bright states would require a higher voltage. In the first instance, referred to below as DC Balance State 1, $V_{ITO}$ is set to $V_{ITO_L}$, $V_0$ corresponds to a bright state voltage and $V_1$ corresponds to a dark state voltage. In the second instance, referred to below as DC Balance State 2, $V_{ITO}$ is set to $V_{ITO_H}$, $V_0$ corresponds to a dark state voltage and $V_1$ corresponds to a bright state voltage Inspection of FIG. 22, although not to scale, clearly shows that except for the polarity of the field across the gap, DC Balance State 1 and DC Balance State 2 are of equal magnitude and therefore completely equivalent in the context of modulating a nematic liquid crystal.

The multiplexing of the voltage applied to the common electrode 2250 is necessary to the proper DC balancing operations of the liquid crystal display. As can be seen from FIG. 22, in DC Balance State 1 the display operates in a first mode wherein the common plane is set to $V_{ITO_L}$, $V_0$ is corresponds to a bright state setting and $V_1$ corresponds to a dark state setting. In this mode the effective voltage across the liquid crystal cell for pixels set to the black state is the difference between $V_1$ and $V_{ITO_L}$ and the effective voltage across the liquid crystal cell for pixels set to the bright state is the difference between $V_0$ and $V_{ITO_L}$. The polarity of the field across the pixels cells is established by the depiction of both $V_0$ and $V_1$ as being "higher" than $V_{ITO_L}$. To achieve DC Balance State 1, the circuit is FIG. 19 is configured with logic signal $V_{SW_H}$ to the high state and $V_{SW_L}$ to the low state. With the logic signals so set, the common plane voltage 2270 ($V_{ITO}$) is set to $V_{ITO_L}$. Likewise in the pixel structure presented in FIG. 14, with logic signal $V_{SW_H}$ set to the high state and $V_{SW_L}$ set to the low state, the cell level multiplexer is set such that $V_0$ is connected to pixels where the cell data state is set to 0 or "bright" and $V_1$ is connected to pixels where the cell data state is set to 1 or "dark." This results in the effective voltages across the liquid crystal cell being those depicted in FIG. 21 as DC Balance State 1. In the foregoing discussion the convention of using a bit value of 0 to designate "off" and using a bit value of 1 to designate "on" is purely arbitrary. The reverse convention may be recognized to be the case if the circuit of FIG. 14 is investigated in detail. The convention used in the text is for clarity since the convention is arbitrary.

In DC Balance State 2, as can be clearly seen from FIG. 22, the display operates in a second mode similar to the first mode but with the direction of the electric field across the display reversed. In this second mode the common plane is connected to a second voltage source, $V_{ITO_H}$, pixel set to the dark state are now connected to $V_0$ and pixels set to the bright state are connected to $V_1$. For the magnitude of the fields in DC Balance State 1 and DC Balance State 2 to be of equal magnitude but opposite polarity, it is necessary for $V_{ITO_H}$ to be positioned above $V_1$ by the same absolute value of voltage that $V_{ITO_L}$ is positioned below $V_0$. Maintaining this relationship establishes that DC Balance State 1 and DC Balance State 2 are mirror images of one another. State 1 is effectuated as shown in FIG. 22 when $V_{SW_H}$ is set to low and $V_{SW_L}$ is set to high. In this instance the pixel structure presented in FIG. 14 is configured so that the pixel multiplexer circuit provides $V_0$ to the pixel mirror when the pixel data state is set to 1 or "bright" and the multiplexer circuit provides $V_1$ to the pixel mirror when the pixel data state is set to 0 or "dark".

The liquid crystal cell may be considered as fully DC balanced when the liquid crystal cell dwells in DC Balance State 1 and DC Balance State 2 for equal intervals of time. The multiplexing of the common plane voltage from two source voltages thus completes the DC balancing of the cell when said multiplexing of the common plane takes place in time synchronized with the multiplexing of the individual pixels of the liquid crystal cell.

All the above elements together provide a pixel design and liquid crystal device where the DC balancing of the device is not directly tied to the writing of data. The display controller controls logic lines $V_{SW_H}$ and $V_{SW_L}$ to control the DC balance state of the liquid crystal device when operated in conjunction with ITO voltage multiplexer 2235 by controlling the ITO voltage and the selection of pixel mirror voltage independently of the data state of the individual pixels on the display.

Figures 23A, 23B, 23C:
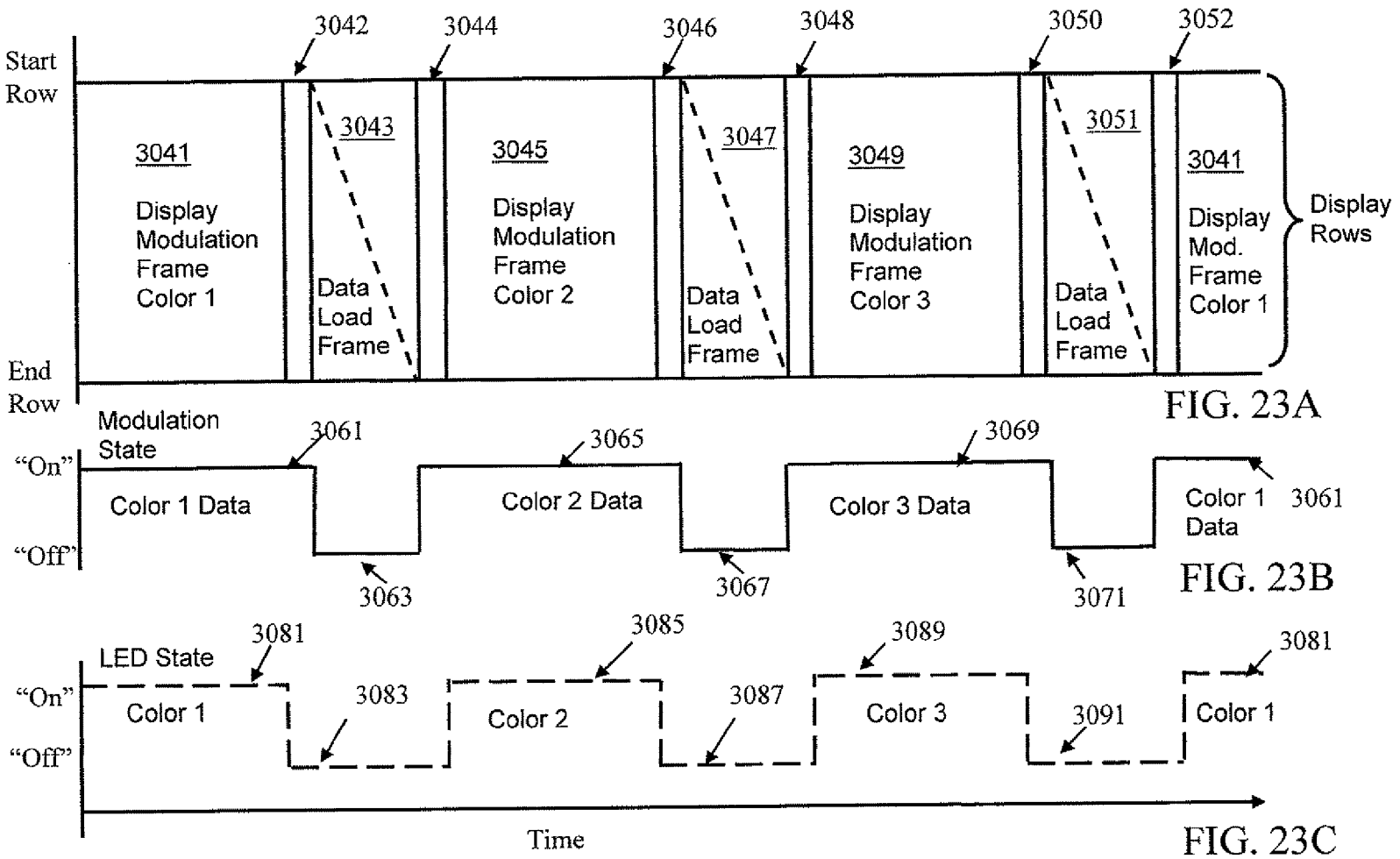
FIGS. 23A, 23B and 23C present a generic field sequential color modulation method based on a multi-color LED based illumination system.

FIGS. 23A, 23B and 23C present a modulation arrangement for a field sequential color display such as the projection system disclosed in FIG. 4. A display controller must control both the display assembly and the LEDs and sequence the data onto the display in concert with the illuminating of the correct LED. In FIG. 23A a first modulation frame 3041 for Color 1 is active and the modulation state 3061 is active at the same time as is LED State 3081. The three elements do not necessarily end at precisely the same moment. Color data 3061 may continue to be asserted during a portion of brief transition period 3042 as may be the case with LED state 3081. The selection of termination point may depend on a variety of factors such as liquid crystal decay time. During data load frame 3043 a preload of data for the next display period is placed in the storage element of the display. The modulation state 3063 may be considered to be off during this period as the LED state 3083 is off and any modulation would not affect the displayed image. In some implementations the display is actually driven to a predetermined state to facilitate reducing the residual effects of the data for the previous color. During a second transition period 3044 setting of the modulation state 3045 to the data for color 2 is completed. In some field sequential color displays known in the prior art the gray scale intensity is primarily determined by the duration of the on time of the LED in preference to the state of the liquid crystal.

At the end of transition period 3044 the display modulation frame 3045 for color 2 is initiated and LED segment 3085 for color 2 is active. Color 2 data 3065 is displayed during segment 3045 until transition segment 3046 is initiated. LED color 2 segment 3085 illuminates the display during this period. At the conclusion of the display modulate frame 3045 for color 2 the display enters a transition period 3046 during which color data 3065 is suppressed and LED color 2 makes its transition to off state 3087. During data load frame 3047 image data for color 2 is pre-loaded onto the display. Again the display may be gated off in frame 3067 and the LED is gated off for period 3087. At the conclusion of data load 3047 during transition period 3048 color 3 data 3069 is asserted during modulation frame 3049 for color 3 and the LED color 3 segment 3089 is configured to on. At the conclusion of the color 3 display period 3049 the display enters a transition period 3050 during which data 3069 for color 3 is terminated and LED illumination segment 3089 for color 3 ends. During data load frame 3051 color data for color 1 is pre-loaded. Data segment 3071 remains off and the LED emission is suppressed during period 3091. At the conclusion of data load frame 3051 the display briefly enters transition segment 3052 prior to entering display modulation frame 3041 for color 1 again. During transition segment 3052 color data 3061 is asserted onto the display and the LED transitions to on state 3081.

Variations on this order are well known. For example, the number of primary colors may exceed the three disclosed in this example. An individual color may be repeated before the end of the full sequence or all colors may be repeated. Various reasons for this are well known in the art.

Figures 24A, 24B, 24C:
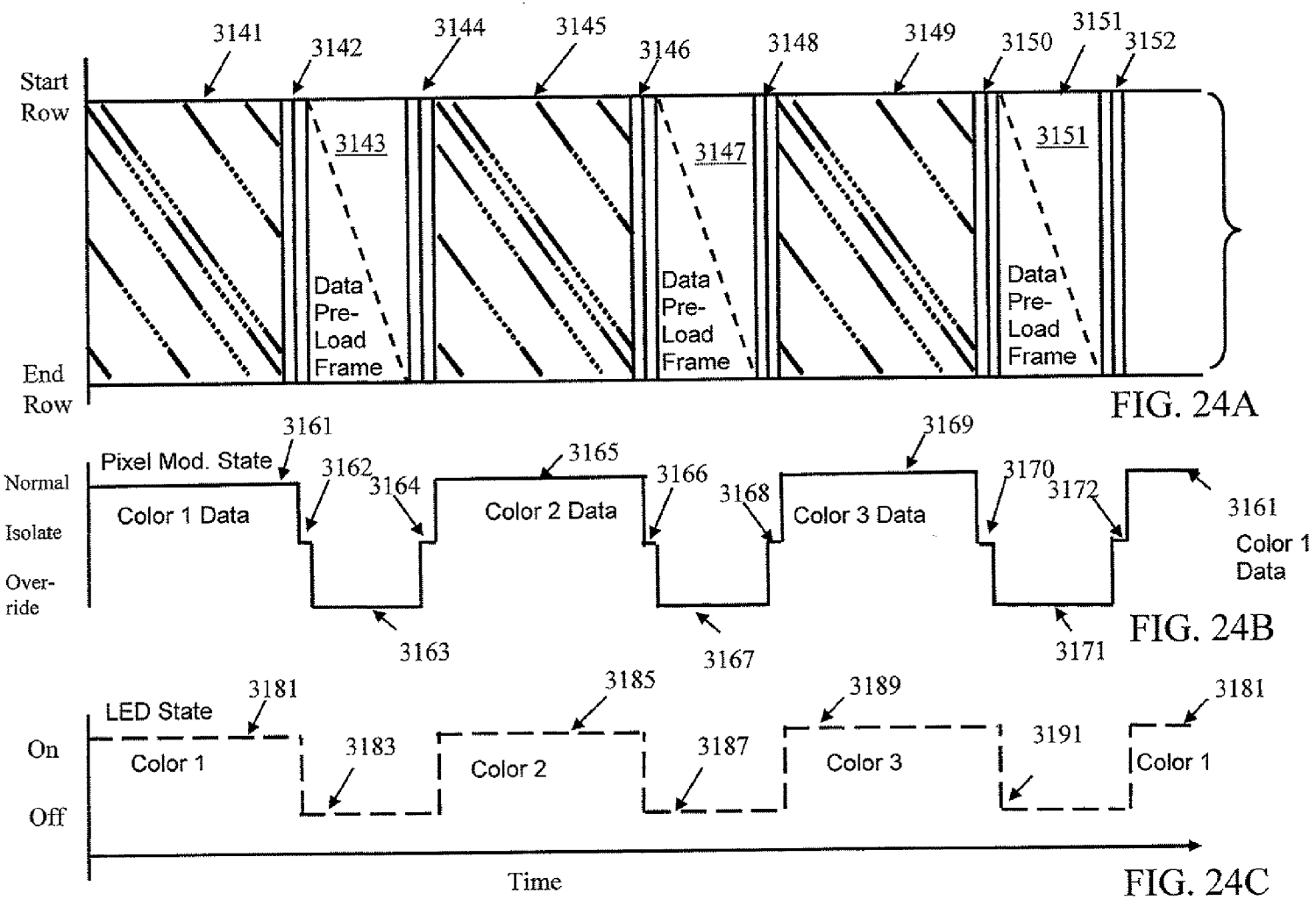
FIGS. 24A, 24B and 24C present a field sequential color modulation method wherein the gray scale modulation is created through a scrolling color mode.

FIGS. 24A through 24H present various aspects of a modulation method for a single panel color sequential liquid crystal projector based in part on a modulation method previously disclosed in pending patent application Ser. No. 10/425,427. The modulation method is compatible with either of the pixel types disclosed in FIGS. 5 and 14. A statement that a modulation applies to one pixel type is to be construed as meaning that it applies to both types. FIGS. 24A through 24H depict the modulation operation of the pixels within a color frame and the means for transitioning from a first color to a second color. The field sequential display presented in FIG. 3 is typical of the display used in the following example, particularly comprising LED illumination and a microdisplay all under the coordinated control of a display controller. Other field sequential color projection architectures are known in the art and fall within the scope of the present invention FIGS. 24A, 24B and 24C present a few frames of a sequential color operation on a common time scale. The vertical axis of FIG. 24A represents rows on the display with the first row written at the top and the last row written at the bottom. The vertical axis of FIG. 24B represents the modulation state of the pixel cell with "on" meaning that the data written to the storage element asserts a voltage on the pixel mirror through the intervening circuitry after FIG. 5 or FIG. 14 while "off" indicates that the voltage applied to the pixel mirror is determined by the pixel voltage override circuit 1360 (from FIG. 5) or pixel voltage override circuit 2360 (from FIG. 14). During modulation frame 3141 modulation data is actively driven to a display while Color 1 LED is set to "on" state 3181. Color 1 data 3161 remains on the display for a brief interval after the end of active modulation. Optionally the "on" state for Color 1 LED may extend until the start of the overwrite of Color 1 data by the initial state for Color 2 data 3143 to compensate to a degree for the rise time of this data at the beginning of the modulation frame. Requirement for this optional "on" state is foreseen although other correcting method are available. Transition state 3142 lasts from the end of modulation frame time 3141 until the beginning of data load frame 3143. DC balance switch 1340 (2340 from FIG. 14) may be placed to override at the beginning of transition state 3142 and pixel voltage override circuit 1360 (2360 from FIG. 14) may be operated to override during data load frame 3143. Data for the second modulation frame is loaded during data modulation frame 3143. At the conclusion of data load frame 3143 pixel override circuit 1360 from FIG. 5 or 2360 from FIG. 14 may be deactivated and DC balance switch 1340 from FIG. 5 or 2340 from FIG. 14 may be operated as previously noted to maintain DC balance.

Figure 24E:
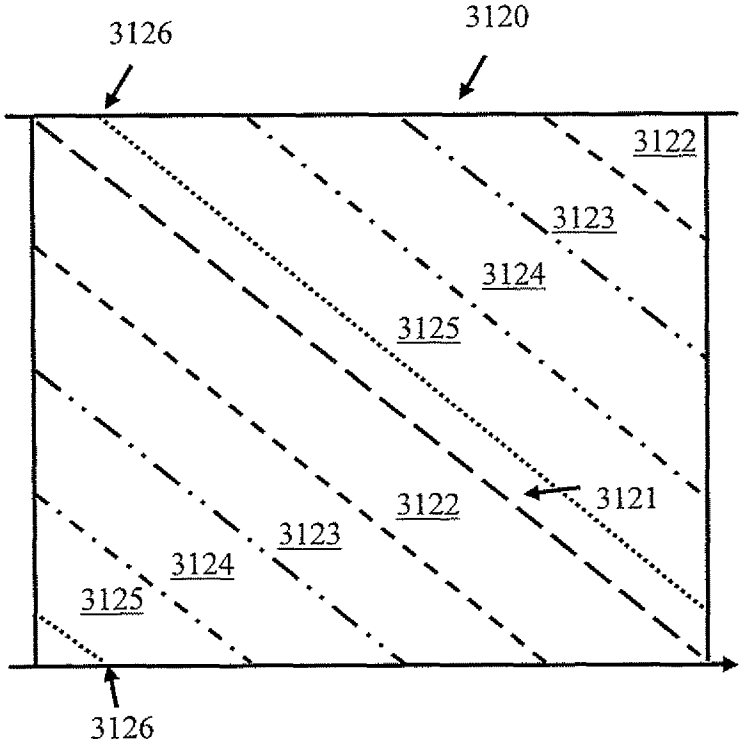
FIGS. 24D and 24E present two implementations of a scrolling color modulation with interlaced write pointers able to create gray scale modulation
Figure 24D:
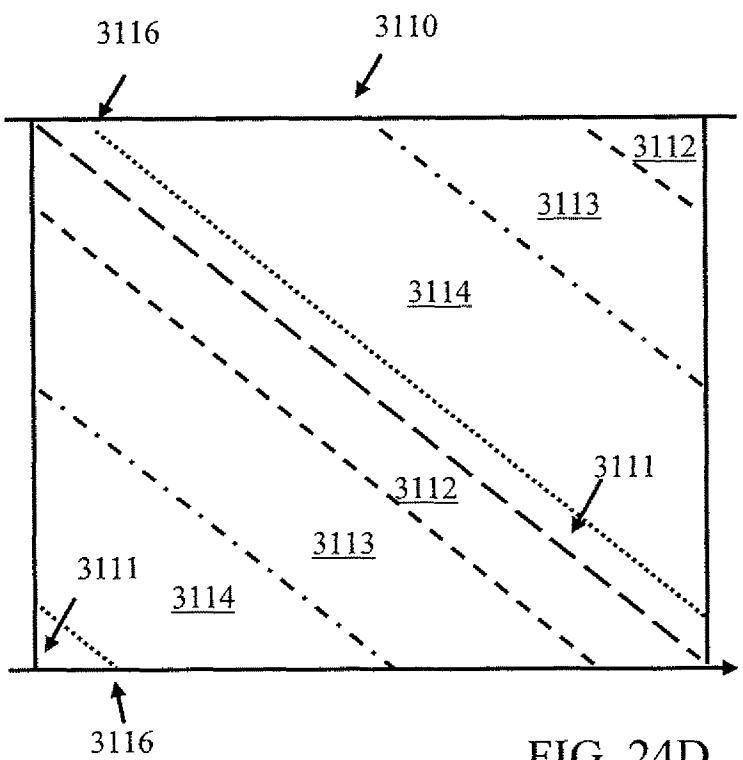

FIGS. 24D and 24E present two implementations of a modulation sequence after U.S. patent application Ser. No. 10/435,427 as extended by U.S. patent application Ser. No. 11/740,244 (244), now U.S. Pat. No. 7,852,307, the contents of which are fully incorporated into this application by reference. '244 discloses a method for reducing the duration of modulation of a selected row by loading abbreviated row write data onto a portion of an address instruction cycle for a different row. The abbreviated instruction sets all storage elements on the selected row to the same value that forms part of the abbreviated instruction.

FIG. 24D presents a scrolling modulation in which the duration of each modulation sequence element is approximately binary weighted. The horizontal axis represents time and the vertical axis represents row position on the display with the start of the sequence starting at the top of the display. Sequence element 3111 represents the least significant bit of modulation display with a nominal value of 1. Sequence element 3112 represents a bit weighting of about 2 bits and modulation element 3113 represents a bit weighting of about four bits. Modulation element 3114 represents a bit weighting of about eight bits. In this example the duration of least significant bit element 3111 is established through use of a terminated write pointer 3116. This instruction is asserted in conjunction with one of the other write pointers active on the display as previously described. An initial address data instruction identifies a row to be written with subsequent data that follows the address data. By convention a second address data instruction immediately following the first address data instruction includes the address of the row to be terminated with fixed data and the specific single data value to be written to all pixels on that row. The choice of row to be terminated is not related to the address of the first row to be written with subsequent data. Note that the spacing between the lines representing the boundaries of the individual modulation sequence elements are proportional to the bit weighting of the sequence elements along the y axis. Further note that the spacing and order of spacing may be arbitrary or empirical to satisfy objectives such as artifact reduction.

FIG. 24E presents a scrolling modulation sequence in which the duration of the lesser bit elements are approximately binary weighted and the duration of the upper bit elements are approximately equal to one another, thus forming thermometer bits. Modulation element 3121 presents a least significant bit with a bit weighting of approximately 1. Modulation element 3122 represents a bit weighting of about 2 bits. The remaining modulation elements 3123, 3124, and 3125 also present a bit weighting of about 2 bits each. Redundant weightings such as this may be operated in non-binary fashion as thermometer bits wherein a first segment, for example 3122, is always populated first, a second element, for example 3123, is always populated second, a third element, for example 3124, is always populated third, and a fourth element, for example 3125, is always populated fourth. Methods for populating in this order are described in U.S. patent application Ser. No. 10/435,427. Dotted line 3126 represents a terminated write pointer used to establish a least significant bit as previously noted.

A person of ordinary skill in the art may easily conceive of other implementations of a scrolling modulation sequence after reading this disclosure. Such variations fall within the scope of this disclosure.

Figure 24F:
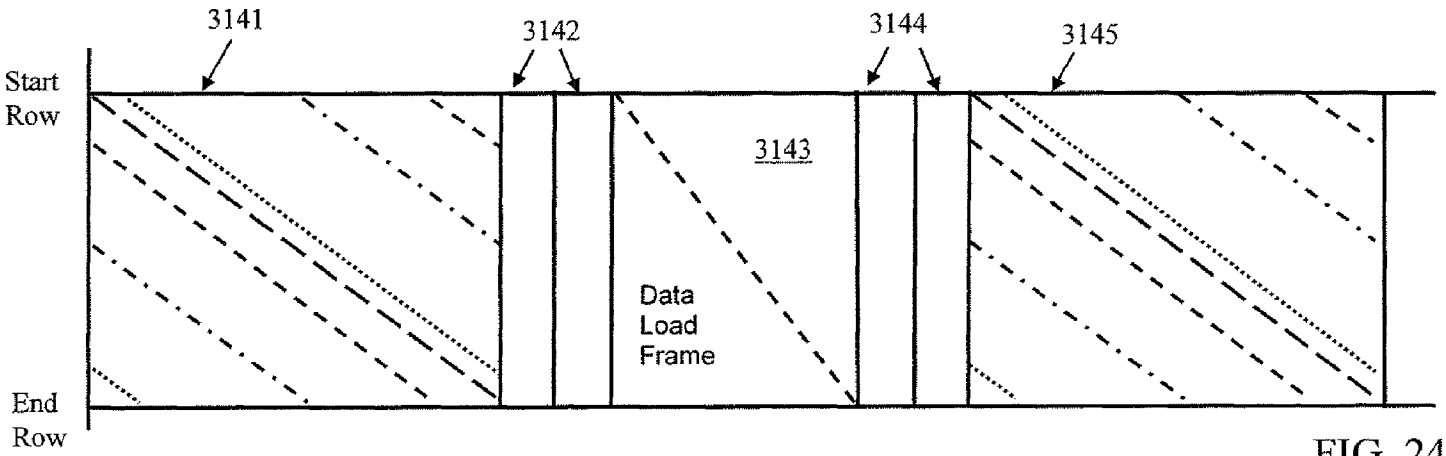
FIGS. 24F, 24G and 24H present a detailed view of the operations that must take place when a field sequential color switches from a color to a different color
Figure 24G:
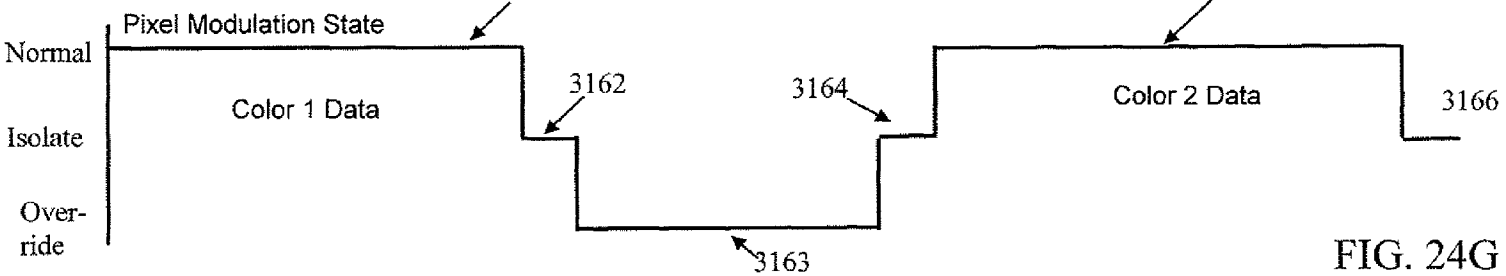
Figure 24H:
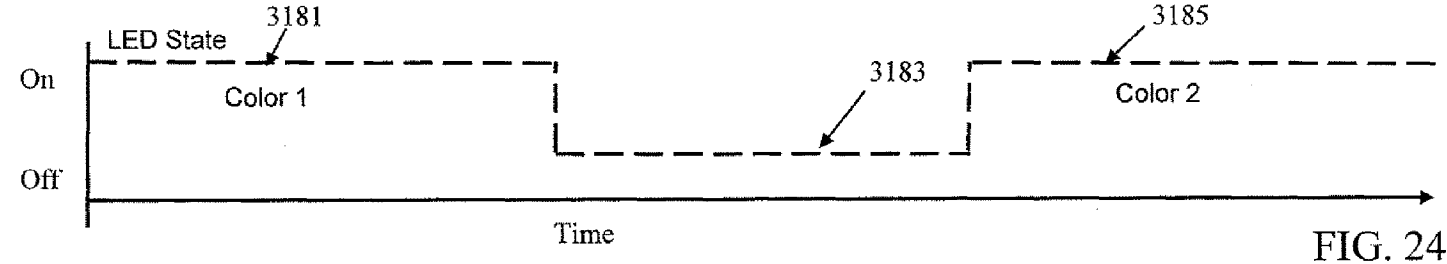

FIGS. 24F, 24G and 24H present an expanded view of the operation of the components of a pixel during a single color frame transition on a x-axis common time line. The y-axis of FIG. 24F presents the first row written at the top and the last row written at the bottom, this normally representing the top and the bottom of the display with intervening rows between. The y-axis of FIG. 24G represents three states of the pixel drive. The following description repeats information presented previously in this application. Normal mode is the mode of operation wherein a data value stored in storage element 1320 of FIG. 5 or storage element 2320 of FIG. 14 through intervening circuitry is asserted upon the pixel mirror 1212 of FIG. 5 or pixel mirror 2212 of FIG. 14 and wherein DC balance control switch 1320 of FIG. 5 or DC balance control switch 2320 switches between the two DC balance states described in FIG. 22 according to a predetermined scheme. Isolate mode is a mode of operation wherein all the transistors of DC balance control switch 1320 of FIG. 5 or 2320 of FIG. 14 are set to an off setting and the pixel voltage for each pixel is the last voltage actively applied to the pixel. The charge creating this voltage will decay over a period of time due to electron-hole pair generation so it is only used for brief periods. Override mode is a mode wherein the DC balance control switches of the pixels of the display are placed in Isolate mode and the pixel voltage override circuit 1360 of FIG. 5 or pixel voltage override circuit 2360 of FIG. 14 is then activated and the voltages applied to all pixel mirrors are a single predetermined voltage among $V_0$ or $V_1$ determined by inverter 1340 of FIG. 5 or inverter 2340 of FIG. 14 based on the voltage delivered by pixel override circuit 1360 of FIG. 5 or pixel voltage override circuit 2360 of FIG. 14 as depicted on FIG. 5 or FIG. 14.

Display modulation frame 3141 of color field 1 drives the display to create gray scale during a period when the pixel is actively modulated in Normal mode 3161 of FIG. 24G and when the LED state is in FIG. 24H set to on with color 1 in radiation. At the conclusion of display modulation frame 3141 the row operation changes to transition mode 3142. At the start of transition mode 3142 the pixel modulation state is changed to Isolate state 3162 and the LED state 3181 remains on to Color 1. After a brief interval in Isolate state 3162 the pixel voltage override circuit 1360 of FIG. 5 or 2360 of FIG. 14 is operated as previously described to form override state 3163, during which time the LED is off during interval 3183 and data loading frame 3143 is initiated to pre-load data for color 3 into the storage element of the pixel element 1320 of FIG. 5 or 2320 of FIG. 14. Entering transition mode 3144, the pixel override circuit 1360 of FIG. 5 or 2360 of FIG. 14 is switched to Off leaving the pixel circuits in Isolate mode 3164 with LED state remaining in Off state 3183 briefly. The pixel circuit modulation state returns to normal 3165 by operating the DC balance switch in DC balance mode and the LED is now switch to On state 3185 for color 2. The display remains in modulation state 3145 for another color frame with pixel modulation state 3165 and LED state 3185 active until the modulation time ends at which point the DC balance switch is changes to Isolate mode 3166. The process is repeated for as long as the display is active.

Figure 25A:
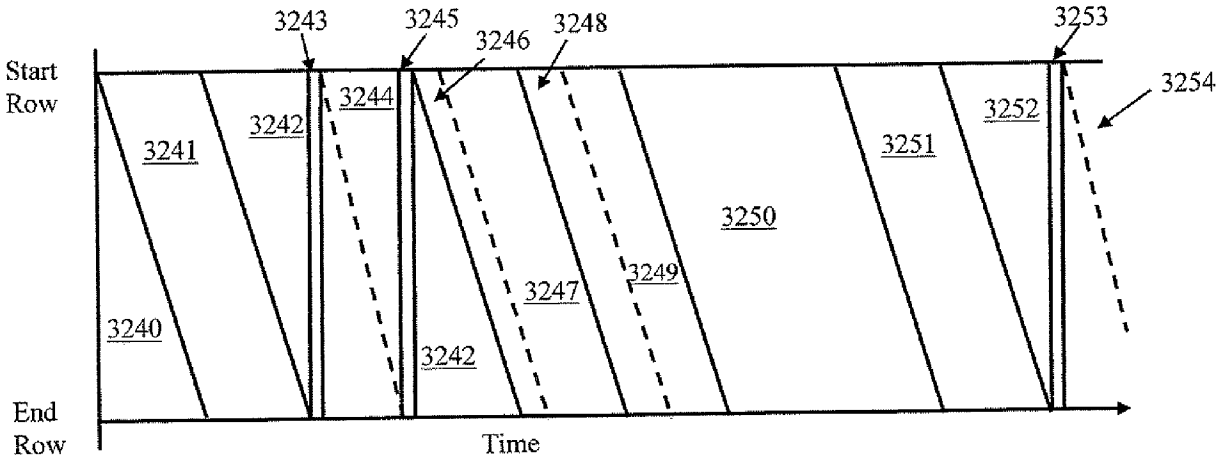
FIGS. 25A and 25B present two implementations of a scrolling color modulation with non-interlaced write pointers able to create gray scale modulation.
Figure 25B:
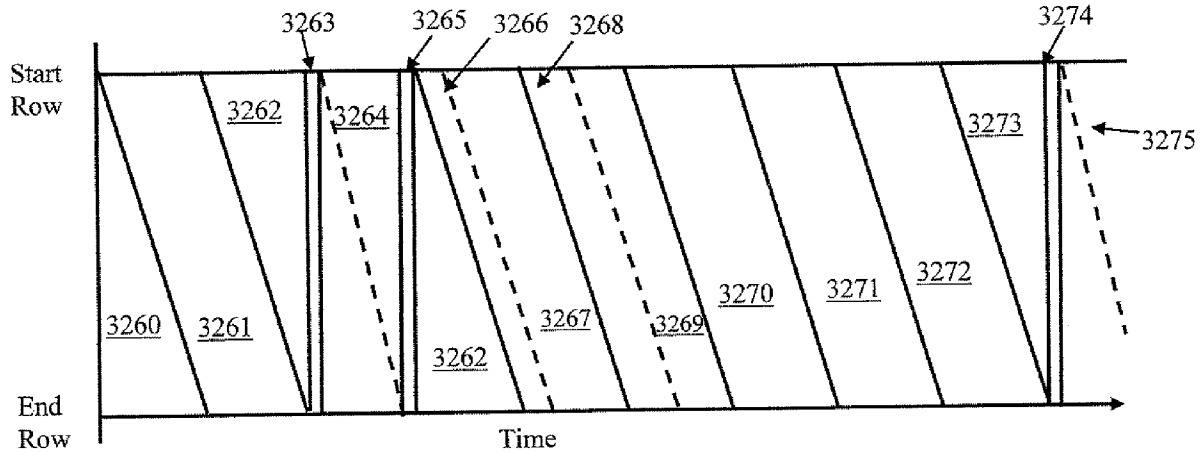

FIGS. 25A and 25B present a alternative modes of operation to generate gray scale during a display modulation frame such as 3041, 3045, or 3049 of FIG. 23A. The operation of the color transition period, the preliminary load period, the pixel modulation state and the LED state are unchanged from that disclosed in detail in FIGS. 24A, 24B, 24C, 24F, 24G, and 24H and are not repeated here. Minor variations to this may be easily conceived and encompassed within the disclosure of this invention.

FIG. 25A presents a modulation method wherein the weighting of the duration of the modulation segments is approximately binary in nature. The modulation method differs from that presented in FIG. 24D in that each modulation plane is written in a single sweep down the display as is typical of prior art devices. The feasibility of such a modulation method depends heavily on the effective bandwidth available to drive the display. Modulation segments 3240 and 3241 are binary weighted in a manner similar to that described in the following text for modulation segments 3250 and 3251. Modulation segments 3242 and 3252 are segments in which the storage elements of the display are written to a dark state. This begins the process of reducing the memory effect within a nematic liquid crystal and thus reducing color cross coupling. During transition interval 3243 the pixels are operated first to the Isolate mode and then to the Override mode. Data may optionally be written to the pixel during this period 3244 but its primary purpose is to continue the drive to dark state on the liquid crystal to reduce color cross coupling. At the conclusion of the interval 3244 the pixels are operated through transition interval 3245 during which the pixel voltage override circuit is switched to off after which the DC balance switch is operated. Once the DC balance switch is operating data for modulation segment 3246 may be written. During this time the data below the first row is progressively overwritten to modulation segment 3246 but meanwhile the data remains in the state established in interval 3243 unless overwritten during interval 3244.

Modulation segment 3246 represents an approximate binary weighting of one lsb. In this example the duration of this interval is less than the minimum duration of a directly modulated segment. Therefore the previously described terminated write pointer is used. At approximately the 25% point down the screen the TWP data begins overwriting the data just written to terminate it without needed to do a full rewrite of the rows. This creates a second interval 3247 in which the modulation is set to dark state. Once the original write pointer reaches the end of the display the terminated write point action continues on the write pointer that is used to create segment 3248 until the pointer is 25% down the screen. Segment 3248 is weighted to approximately 2 bits. At the start of write sequence 3248 the sequence is still writing terminated write points to complete TWP 3247. This action ends at the 25% of the screen previously noted. No further terminated write pointer are generated until the write pointer used to create 3248 is 50% down the screen at which it starts terminating rows written with data earlier in the sequence and initiates dark state segment 3249. Once the writing of segment 3248 is complete the writing of segment 3250 begins at the top of the display. The terminated write pointer needed to terminate 3247 continues until the write pointer for 3250 reaches 50% down the screen. The bit weighting of 3250 is approximately 8 bits. At the completion of the writing of segment 3250 the write pointers for the display are inactive until the appropriate time for 8 bits has lapsed, at which point it being terminated by the write pointer at the top of the screen that initiates modulation segment 3251, weighted at approximately 4 bits. Once the writing of 3251 is completed the next write pointer creates segment 3252 by writing the successive rows to a dark state. Once all rows have been written the display enters transition segment 3253 as before; first to Isolate mode and then to Override mode, following which override segment 3254 is active. The process continues with data for each color for as long as the display operates.

FIG. 25B presents a modulation method wherein the weighting of the duration of the modulation segments is a mixture of non-binary thermometer bits and bits that are approximately binary in nature. The modulation method differs from that presented in FIG. 24D in that each modulation plane is written in a single sweep down the display as is typical of prior art devices. The feasibility of such a modulation method depends heavily on the effective bandwidth available to drive the display. Modulation segments 3260 and 3261 are thermometer-weighted bits of approximately equal duration similar to that described in the following text for modulation segments 3270, 3271, and 3272. Modulation segments 3262 and 3272 are segments in which the storage elements of the display are written to a dark state. This begins the process of reducing the memory effect within a nematic liquid crystal and thus reducing color cross coupling. During transition interval 3263 the pixels are operated first to the Isolate mode and then to the Override mode. Data may optionally be written to the pixel during this period 3264 but its primary purpose is to continue the drive to dark state on the liquid crystal to reduce color cross coupling. At the conclusion of the interval 3264 the pixels are operated through transition interval 3265 during which the pixel voltage override circuit is switch to off after which the DC balance switch is operated. Once the DC balance switch is operating data for interval 3266 may be written. During this time the data below the first row is progressively overwritten to state 3266 but meanwhile the data remains in the state established in 3262 unless overwritten during 3264.

Modulation segment 3266 represent an approximate binary weighting of one lsb. In this example the duration of this interval is less than the minimum duration of a directly modulated segment. Therefore the previously described terminated write pointer is used. At approximately the 25% point down the screen the TWP data begins overwriting the data just written to terminate it without needed to do a full rewrite of the rows. This creates a second interval 3267 in which the modulation is set to dark state. Once the original write pointer reaches the end of the display the terminated write point action continues on the write pointer that is used to create segment 3268 until the pointer is 25% down the screen. Segment 3268 is weighted to approximately 2 bits. No terminated write pointer are required until the write pointer used to create 3268 is 50% down the screen at which it starts terminating its own top rows and initiates dark state segment 3269. Once the writing of segment 3268 is complete the writing of segment 3270 begins at the top of the display. The terminated write pointer needed to terminate 3267 continues until the write pointer for 3270 reaches 50% down the screen. The bit weighting of segments 3270, 3271 and 3272 is approximately 4 bits. At the completion of the writing of segment 3270 the write pointer for segment 3271 begins. When the writing of segment 3271 is completed the writing of segment 3272 begins. Once the writing of segment 3272 is completed the writing of segment 3273 begins, that writes the rows to a dark state. Once all rows have been written the display enters transition segment 3274 as before; first to Isolate mode and then to Override mode, following which override segment 3275 is active and the process begins again.

Figure 26A:
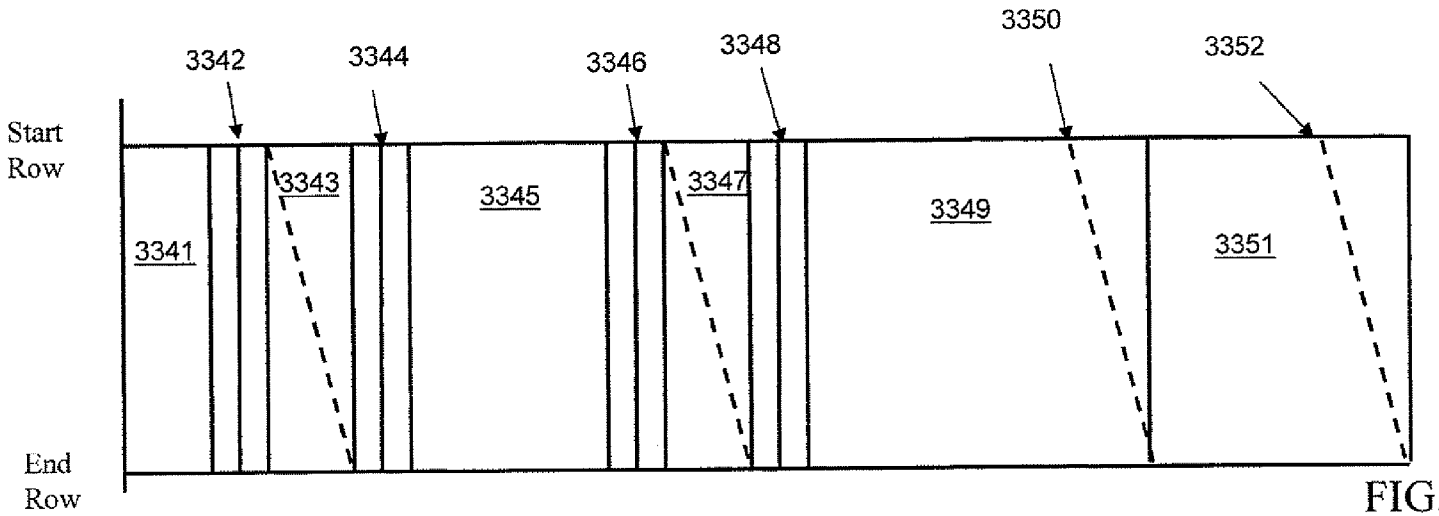
FIGS. 26A, 26B and 26C present an implementation of a planar-update modulation method for a display.
Figure 26B:
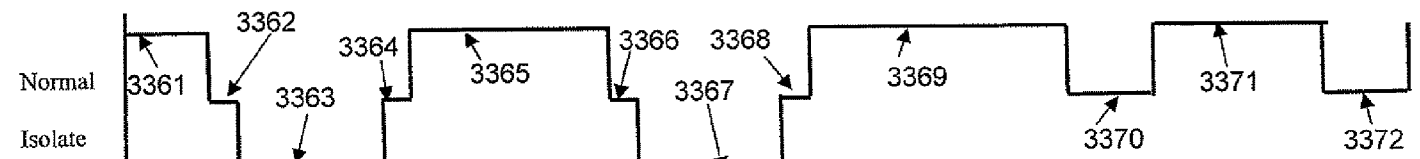
Figure 26C:
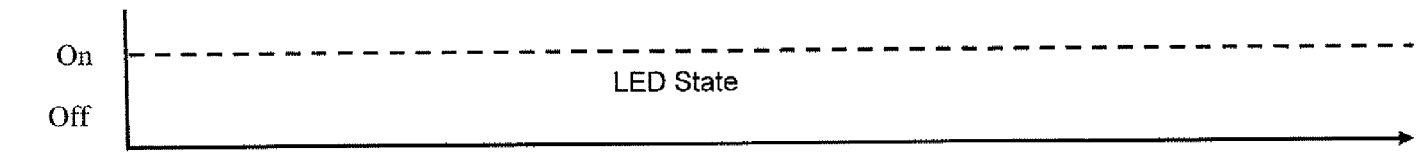

FIGS. 26A, 26B, and 26C present an alternative means of creating gray scale within a single color. The transition between colors may be operated as previously described for FIGS. 24F, 24G, and 24H. Throughout the present example the LED remains on in a single color state as depicted in FIG. 26C. In FIG. 26A data segment 3341 represents a weighted modulation cycle wherein the pixel circuit is operated in normal mode. The duration of data segment 3341 is stated to be less than or approximately equal to the time required to load the backplane. At the predetermined time for segment 3341 to end, each pixel circuit is placed in transition segment 3342 by operating the DC balance switch to Isolate mode 3362 and then to Override mode 3363 by activating the pixel voltage override switch. At this time data load segment 3343 takes place and all pixels are rewritten without modifying the voltages applied to the pixel mirrors. At the conclusion of data load segment 3343 the display is placed into transition segment 3344 wherein the pixel voltage override circuit is placed to off at segment 3364 and then the DC balance switch is operated during segment 3365 to deliver voltages during display segment 3345 that are predetermined by the state of the data loaded into the pixel storage element to the pixel according to the state of the pixel components.

At the conclusion of data display segment 3345 the display enters transition segment 3346 wherein the DC balance switch is first operated to Isolate mode 3366 and then the pixel voltage override circuit is operated to Override segment 3367. While in Override segment 3367 data load segment 3347 takes place. After data load segment 3347 is completed the display enters transition segment 3348 during which the pixel voltage override circuit is switched off and the pixel enters Isolate mode 3368 followed by the operation of the DC balance switch in normal mode 3369.

Display segment 3349 is determined to be substantially longer than the load time required for the array. At some time before the end of modulation segment 3349 the DC balance override switch is placed to Isolate mode 3370 and data load 3350 takes place to the storage elements of the pixel array while display segment 3349 is active on the display. At the conclusion of the required duration for display segment 3349 the DC balance switch is operated back to Normal mode 3371 and the data loaded during data load 3350 is asserted onto the pixel mirror, thus initiating display data segment 3351. The DC balance switch remains in normal state 3371 until a time before the end of 3351 that is sufficient for a data load operation. At this point the DC balance switch enters Isolate mode 3372 and pixel data load 3352 takes place while the pixels continue to show the previously loaded data. At the conclusion of the predetermined duration of data segment 3351 the DC balance switch is operated to the normal position.

The modulation method of FIGS. 26A, 26B and 26C may be implemented using binary weighted modulation segments, non-binary weighted modulation segments, or a mixture of the two as in previous examples.

This invention discloses a pixel display element for displaying an image data as a single pixel that comprises a voltage control means within the display element for multiplexing and selecting an electrode voltage for applying to an electrode of the pixel display element. The pixel element further provides means to isolate the voltage applied to the pixel mirror from the underlying storage element. The pixel element further comprises a pixel voltage override circuit that may be operated to enable delivery of a single predetermined voltage to the entire array without rewriting the storage element of the display. This invention further discloses a display control means that provides control signals to a pixel element to operate it to assert a voltage from a predetermined set of voltages and further provides control signals to an ITO voltage multiplexer to operate it to assert a voltage from a predetermined set of voltage onto a common counter electrode plane. In a preferred embodiment, the voltage control means further comprising a multiplexing means for receiving a plurality of input signals for multiplexing and selecting the electrode voltage for applying to the electrode of the display element and onto the common counter electrode plane. In another preferred embodiment ITO voltage multiplexing means receives signals from a series of input signals for multiplexing and selecting a voltage from a sets of predetermined voltages for application to a common counter electrode plane. In another preferred embodiment, the display system further comprises a data buffering means for buffering data to be displayed while continuing to display the data displayed immediately prior. In another preferred embodiment, the image display system further comprises a storage element for storing a data bit for inputting to the voltage control means. In another preferred embodiment the pixel element comprises means for asserting a globally determined voltage onto the pixel mirror without rewriting the data stored on the pixel memory element. In another preferred embodiment, the voltage control means is a CMOS based logic device. In another preferred embodiment, the voltage control means is provided for inputting a binary signal of a high or a low voltage to the electrode. In another preferred embodiment, the storage element comprises a means for asserting one of two complementary states to the voltage control means. In another preferred embodiment, the storage element further comprises a CMOS based memory device. In another preferred embodiment, the storage element further comprises a static random access memory (SRAM).

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

What is claimed is:

1. A display system comprising a display controller, a display unit comprising a plurality of pixel cells and a transparent common electrode, and a light source;

wherein said display controller comprises a processor unit, a memory device and a voltage source, and where said display controller is operative to cause a voltage source to deliver logic and control voltages and data to said display unit, including at least one voltage to the transparent common electrode;

wherein said display unit comprises a plurality of pixel cells and peripheral circuitry to receive data, and logic and drive voltages from a voltage source and operate the display according to those voltages and data, the transparent common electrode, liquid crystal alignment layers on the transparent common electrode and on the array of pixel cells, and a liquid crystal layer between the transparent common electrode and the array of pixel cells; and wherein said pixel cell comprises a storage element, a DC balance control switch, a pixel voltage override circuit, an inverter configured to select one voltage from at least two voltages available to it and a pixel mirror configured to receive the output of an inverter;

wherein said pixel cell, in one mode, delivers, based on the data state of the memory element as intermediated by the DC balance control switch, a voltage to the inverter to select one of the at least two voltages to be applied to the pixel mirror; and wherein, in a second mode, no voltage is delivered to the input of the inverter and no voltage asserted onto the pixel mirror; and wherein, in a third mode of operation a voltage from the pixel voltage override circuit is delivered to the input to the inverter to select one of the at least two voltages to be asserted onto the pixel mirror.

2. The display system of claim 1 wherein the pixel cell, in a normal mode of operation, operates such that a storage element responds to data provided by a voltage controller and asserts complementary data voltages onto two inputs of a DC balance control switch; wherein said DC balance control switch in a normal mode of operation, selects one of the two complementary inputs, based on logic voltages originated by a voltage source, onto a single input terminal of a pixel voltage override circuit; wherein said pixel voltage override circuit, in a normal mode of operation, passes the voltage asserted onto its input terminal to its output terminal; and wherein said inverter receives a voltage from pixel voltage override circuit and selects one of at least two pixel drive voltages and asserts the selected voltage onto a pixel mirror.

3. The display system of claim 1 wherein the pixel cell, in an isolate mode of operation, operates such that a DC balance control switch, based on logic voltages originated by a voltage source, asserts no voltage from the storage element onto the input of a pixel voltage override unit; and wherein pixel voltage override circuit asserts no voltage onto a pixel mirror.

4. The display system of claim 1 wherein the pixel cell, in an override mode of operation, operates such that a DC balance control switch, based on logic voltages originated by a voltage source, asserts no voltage from the storage element onto the input of a pixel voltage override circuit, and wherein, in an override mode of operation, pixel voltage override circuit, responsive to control voltages originated by a voltage source, asserts one of at least two voltages onto the input of an inverter.

5. The display system of claim 1 wherein the memory element is a 6 transistor SRAM cell.

6. The display system of claim 1 wherein the DC balance control switch operates according to a break-before-make logic.

7. The display system of claim 1 wherein the DC balance circuit is configured and operated so as to enable a range of voltages up to $V_{DD}$ and $V_{ss}$ to be asserted on the pixel mirror.

8. The display system of claim 1 wherein the voltage source, responsive to signals from a processing unit, asserts logic and control voltages and pixel voltages on the plurality of pixel cells and voltages onto the transparent common electrode, such that the display unit is operated in a DC balanced manner.

9. The display system of claim 8 wherein the voltage source, responsive to signals from a processing unit, operates the display in normal mode, displaying images according to the data placed in the storage element.

10. The display system of claim 8 wherein the voltage source, responsive to signal from a processing unit, operates the display in override mode, asserts signals onto the pixel voltage override circuit, thereby causing it to assert one of at least two voltages onto the inverter, and wherein the inverter, responsive to a signal from the pixel voltage override circuit, delivers one of at least two voltages onto all pixel mirrors of the array.

11. The display system of claim 1 wherein the light source comprises a plurality of light emitting diode units of at least two different colors that may be switched by color.

12. The display system of claim 11 wherein the display controller causes the light emitting diodes to radiate according to a predetermined schedule.

13. The display system of claim 1 wherein the liquid crystal layer is approximately one half wave thick at a selected wavelength of coherent light and the orientation of the alignment layers on the two surface are parallel to the polarization of said coherent light and antiparallel to each other.

14. A method of modulating a display system comprising a display controller, a display unit comprising a plurality of pixel cells, a transparent common electrode and a light source;

wherein said display controller comprises a processor unit, a memory device and a voltage source, and where said display controller is operative to cause a voltage source to deliver logic and control voltages and data to said display unit, including at least one voltage to the transparent common electrode;

wherein said display unit comprises a plurality of pixel cells and peripheral circuitry to receive data, and logic and drive voltages from a voltage source and operate the display according to those voltages and data, the transparent common electrode, liquid crystal alignment layers on the transparent common electrode and on the array of pixel cells, and a liquid crystal layer between the transparent common electrode and the array of pixel cells;

wherein said pixel cell comprises a storage element, a DC balance control switch, a pixel voltage override circuit, an inverter configured to select one voltage from at least two voltages available to it and a pixel mirror configured to receive the output of an inverter;

wherein said pixel cell, in one mode, delivers, based on the data state of the memory element as intermediated by the DC balance control switch, a voltage to the inverter to select one of the at least two voltages to be applied to the pixel mirror; and wherein, in a second mode, no voltage is delivered to the input of the inverter and no voltage asserted onto the pixel mirror; and wherein, in a third mode of operation a voltage from the pixel voltage override circuit is delivered to the input to the inverter to select one of the at least two voltages to be asserted onto the pixel mirror;

wherein in a first period of operation in a normal mode of operation, a storage element of each pixel of the display unit receives data from a voltage source and assert complementary data on a DC balance switch; wherein said DC balance switch, according to its logic configuration determined by the voltage source, asserts one of the two complementary outputs onto the pixel voltage override circuit; wherein the pixel voltage override circuit asserts the voltage it receives onto its output terminal, and wherein an inverter received the voltage asserted on its input terminal and asserts one of at least two voltages onto the pixel mirror; wherein said display of data continues during the first period of operation according to a predetermined program; wherein a display controller causes a light emitting diode to operate according to a predetermined schedule;

wherein in a second period of operation in an isolate mode of operation, a storage element of each pixel may receive data from a voltage source and assert complementary data on a DC balance switch; wherein said DC balance switch is operated in an isolate mode that isolates the storage element; wherein a pixel voltage override circuit is operated in the off condition according to logic from a voltage source; wherein no voltage is asserted onto the input to the inverter; and wherein in a third period of operation in an override mode of operation; a DC balance switch is operative to isolate a storage element from the other circuits of the pixel;

wherein a pixel voltage override switch is operated so as to assert a voltage onto the input to the inverter; wherein the inverter selects one of at least two voltages to be asserts onto the pixel mirror/electrode.

15. The method of modulating a display system of claim 14 wherein the light source comprises a plurality of light emitting diode units of at least two different colors that may be switched by color.

16. The method of modulating a display system of claim 15 wherein the display controller causes a light emitting diode to radiate according to a predetermined schedule substantially contemporaneous with a period of modulation in a normal state of operation.

17. The method of modulating the display system of claim 15 wherein the display controller causes a light emitting diode to not radiate according to a predetermined schedule contemporaneous with periods of modulation in isolate mode and in override mode.

18. The method of modulating a display system of claim 14 wherein the display controller causes data for a subsequent normal mode interval to be loaded to a storage element when that display system is operating in a prior interval in isolate or override mode.

19. The method of modulating a display system of claim 14 wherein the display system is operated in a normal mode of operation, wherein a display controller according to a predetermined method writes a first row of data to initiate a first gray level and writes a subsequent row of data at an interval selected to reset the first row after a period of time has elapsed corresponding to a desired modulation segment; subsequent row writes occur at intervals varying from the first interval wherein the spacing between rows is proportional to a desired bit depth for the data written to the previous row; wherein after a set of rows are written the same pattern of row spacings is repeated but with a single row offset from the earlier group of row write action, repeating this pattern until all members of a set of row write actions has been written to all rows of the display, thereby providing all rows with required gray scale levels.

20. The method of modulating a display system of claim 19 wherein the order of the spacings between subsequent row write actions is arbitrary or empirical.

21. The method of modulating a display system of claim 19 wherein some modulation intervals correspond to binary weighted steps and some modulation intervals do not correspond to binary weighted steps.

22. The method of modulating a display system of claim 19 wherein the data written during some time intervals is terminated through application of a terminated write pointer to a second address data that occupies an extra time slot in the addressing phase for a first, unrelated row; wherein the addressing protocol for a terminated write pointer comprises a row to be terminated and the single data value to be written to all pixels of the terminated row.

23. The method of modulating a display system of claim 14 wherein the entire array of pixels is written in a single write action spanning the entire display, and additional steps are subsequently written to the entire display in the same manner.

24. The method of modulating a display system of claim 23, wherein the data written during some time intervals is terminated through application of a terminated write pointer to a second row identified in address data that occupies an extra time slot in the addressing phase for a first, unrelated row; and wherein the addressing protocol for a terminated write pointer comprises a row to be terminated and the single data value to be written to all pixels of the terminated row.

25. The method of modulating a display system of claim 14 wherein the liquid crystal layer is approximately one half wave thick at a selected wavelength of coherent light and the orientation of the alignment layers on the two surface are parallel to the polarization of said coherent light and antiparallel to each other.

* * * * *